US011166517B2

(12) United States Patent
Hoying et al.

(10) Patent No.: US 11,166,517 B2
(45) Date of Patent: Nov. 9, 2021

(54) METHOD FOR MANUFACTURING A SHOE UPPER

(71) Applicant: adidas AG, Herzogenaurach (DE)

(72) Inventors: Brian Hoying, Herzogenaurach (DE); Andrew Leslie, Portland, OR (US)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 16/231,180

(22) Filed: Dec. 21, 2018

(65) Prior Publication Data

US 2019/0231021 A1 Aug. 1, 2019

(30) Foreign Application Priority Data

Dec. 22, 2017 (DE) ..... 10 2017 223 737.6

(51) Int. Cl.

| | |
|---|---|
| ***A43B 1/04*** | (2006.01) |
| ***A43B 23/02*** | (2006.01) |
| ***A43B 23/04*** | (2006.01) |
| ***A43D 21/00*** | (2006.01) |
| ***D04B 1/24*** | (2006.01) |

(52) U.S. Cl.

CPC ..... *A43B 1/04* (2013.01); *A43B 23/0205* (2013.01); *A43B 23/027* (2013.01); *A43B 23/0265* (2013.01); *A43B 23/0275* (2013.01); *A43B 23/042* (2013.01); *A43D 21/00* (2013.01); *D04B 1/24* (2013.01); *D10B 2501/043* (2013.01)

(58) Field of Classification Search

CPC ... A43B 1/04; A43B 23/0205; A43B 23/0265; A43B 23/027; A43B 23/0275; A43B 23/042; A43D 21/00; A43D 3/00; A43D 3/02; A43D 3/04; A43D 3/08

See application file for complete search history.

(56) References Cited

U.S. PATENT DOCUMENTS

| | | | | |
|---|---|---|---|---|
| 2,147,197 | A | 2/1939 | Glidden | |
| 3,181,316 | A * | 5/1965 | Auton | D04B 9/26 66/179 |
| 4,134,955 | A | 1/1979 | Hanrahan, Jr. et al. | |
| 4,317,292 | A | 3/1982 | Melton | |
| 6,308,438 | B1 * | 10/2001 | Throneburg | A43B 1/02 36/11 |
| 10,098,409 | B1 * | 10/2018 | Cross | A43B 23/028 |
| 2008/0110048 | A1 | 5/2008 | Dua et al. | |

(Continued)

FOREIGN PATENT DOCUMENTS

| | | | |
|---|---|---|---|
| CN | 106 037 119 | A | 10/2016 |
| DE | 69018485 | T2 | 7/1995 |

(Continued)

OTHER PUBLICATIONS

Extended European Search Report issued in European Patent Application No. 18215005.2, dated Apr. 18, 2019, 8 pages.

*Primary Examiner* — Ted Kavanaugh

(74) *Attorney, Agent, or Firm* — Sterne, Kessler, Goldstein & Fox P.L.L.C.

(57) ABSTRACT

The present invention relates to a method for manufacturing a shoe upper, including the steps of: providing at least one stretchable portion on the shoe upper; stretching the at least one stretchable portion of the shoe upper for adapting a size of the shoe upper; and permanently attaching at least one rigid element at least partly on the stretched stretchable portion so that the stretched stretchable portion is locked.

13 Claims, 75 Drawing Sheets

(56) References Cited

U.S. PATENT DOCUMENTS

Figure 1:
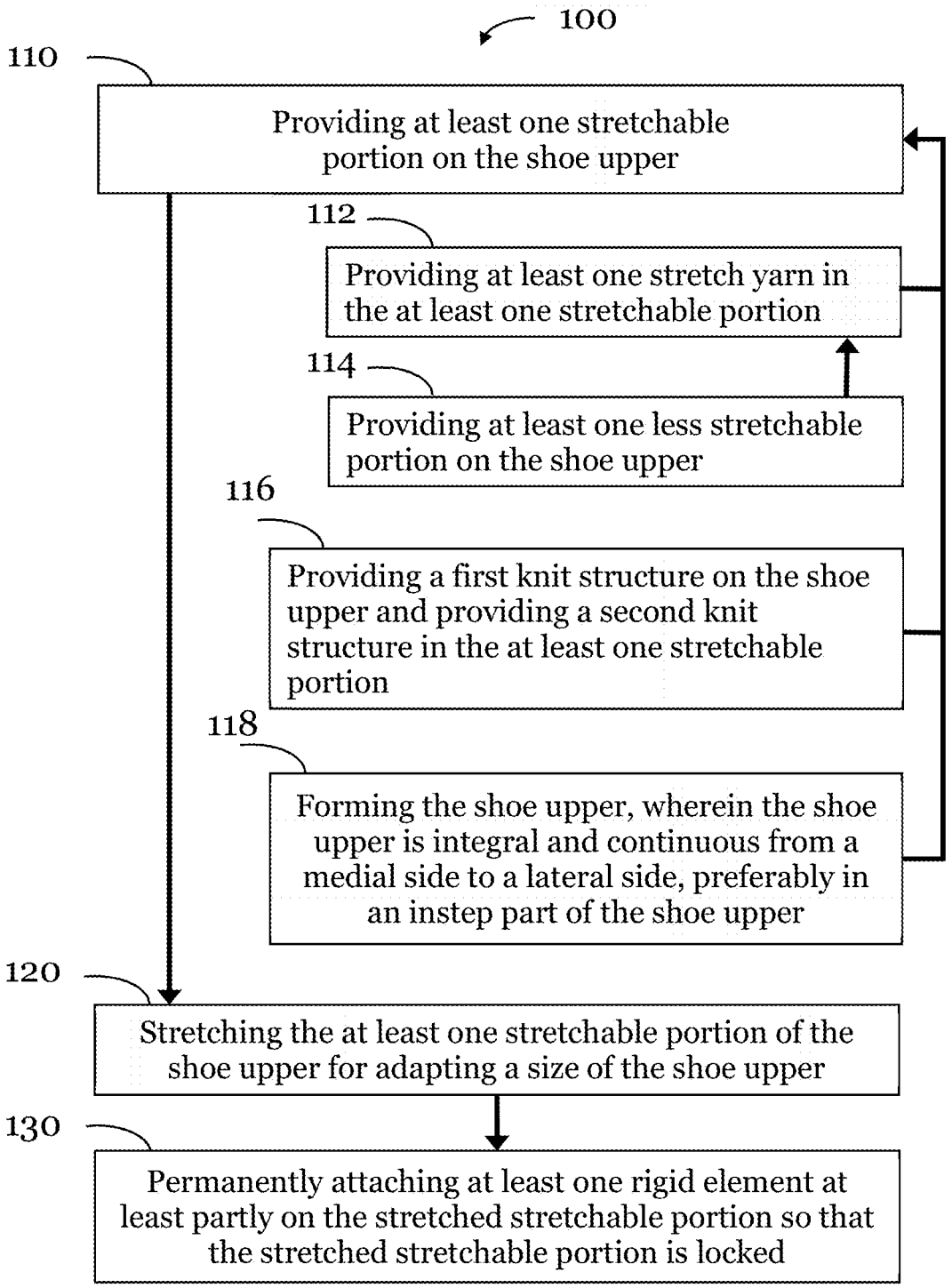

| | | | | |
|---|---|---|---|---|
| 2011/0277250 | A1* | 11/2011 | Langvin | A43D 3/1408 12/133 R |
| 2014/0150292 | A1* | 6/2014 | Podhajny | A43B 23/0205 36/50.1 |
| 2015/0007451 | A1* | 1/2015 | Bruce | A43B 23/0295 36/83 |
| 2015/0101134 | A1* | 4/2015 | Manz | G06F 30/00 12/142 R |
| 2015/0223552 | A1* | 8/2015 | Love | D04B 1/22 36/134 |
| 2015/0342285 | A1 | 12/2015 | Huffman et al. | |

FOREIGN PATENT DOCUMENTS

| | | | |
|---|---|---|---|
| DE | 10022254 | A1 | 11/2001 |
| DE | 102012206062 | A1 | 10/2013 |
| DE | 102013221020 | A1 | 4/2015 |
| EP | 2815668 | A1 | 12/2014 |

* cited by examiner

| Min | | Max |
|---|---|---|
| 1 | # No. Yarn Plies [ - ] | 5 |
| 1 | Yarn Tension [cN] | 24 |
| 280 | K Knock Over Depth [-] | 80 |
| 0 | Amount Tuck [%] | 50 |
| 0 | Amount Miss [%] | 50 |

| Min | | Max |
|---|---|---|
| 1 | # No. Yarn Plies [ - ] | 5 |
| 1 | Yarn Tension [cN] | 24 |
| 280 | k Knock Over Depth [-] | 80 |
| 0 | Amount Tuck [%] | 50 |
| 0 | Amount Miss [%] | 50 |

| Min | | Max |
|---|---|---|
| 1 | # No. Yarn Plies [ - ] | 5 |
| 1 | Yarn Tension [cN] | 24 |
| 280 | k Knock Over Depth [-] | 80 |
| 0 | Amount Tuck [%] | 50 |
| 0 | Amount Miss [%] | 50 |

| | | Zone B1 - strength | Zone B2 - elasticity | Zone B3 - cushioning | Zone B4 – air permeab. |
|---|---|---|---|---|---|
| **Requirement** | **Unit** | | | | |
| **Strength $F_{\varepsilon 20}$ - SR** | [N] | **≥ 30** | ≤ 5 | ≥ 10 | - |
| **Strength $F_{\varepsilon 20}$ - SW** | [N] | **≥ 30** | ≤ 5 | ≥ 10 | - |
| **Max. Strength $F_{max}$ - SR** | [N] | **≥ 1300** | ≥ 300 | ≥ 500 | ≥ 100 |
| **Max. Strength $F_{max}$ - SW** | [N] | **≥ 1300** | ≥ 300 | ≥ 500 | ≥ 100 |
| **Max. Elongat. $\varepsilon_{max}$ - SR** | [%] | - | **≥ 150** | - | - |
| **Max. Elongat. $\varepsilon_{max}$ - SW** | [%] | - | **≥ 150** | - | - |
| **Mass per Unit Area *m*** | [g/m²] | ≤ 750 | ≤ 750 | ≤ 750 | ≤ 750 |
| **Thickness** | [mm] | 2 ± 0.2 | 2 ± 0.2 | **≥ 2.5** | 2 ± 0.2 |
| **Air permeab. *R*** | [mm/s] | - | ≥ 600 | ≥ 600 | **≥ 600** |
| | | | | | *main requirements of each zone* |

Table 4

Fig. 53

| Parameter | Value | Unit | Icon |
|---|---|---|---|
| No. of yarn plies | 1 ply | [-] | # |
| Yarn tension | 6 | [cN] | |
| Knock over depth | 130 | [-] | k |
| Amount tuck | 0 | [%] | |
| Amount miss | 0 | [%] | |

Table 5: Default machine parameters

Fig. 54

| Min | | Max |
|---|---|---|
| 1 | # No. Yarn Plies [ - ] | 5 |
| 1 | Yarn Tension [cN] | 24 |
| 280 | k Knock Over Depth [-] | 80 |
| 0 | Amount Tuck [%] | 50 |
| 0 | Amount Miss [%] | 50 |

Table 6: Range of parameter values

Fig. 55

| **Influence on strength $I_{F\varepsilon 20}$ – SR** | | | | ← $F_{\varepsilon 20}$ $F_{\varepsilon 20}$ → |
|---|---|---|---|---|
| Parameter | | $\Delta F\varepsilon_{20}$ [N] | Equation | $R^2$ |
| No. of yarn plies | # | Δ313 | Linear<br>y = 5145.3x - 446.96 | 0.96 |
| Yarn tension | | Δ7 | Linear<br>y = 132.01x - 32.411 | 0.96 |
| Knock over depth | k | Δ11 | Cubic<br>$y = 276.86x^3 - 83.04x^2 + 26.273x - 91.037$ | 0.99 |
| Amount tuck | | Δ3 | Cubic<br>$y = -715.16x^3 + 1114.3x^2 - 465.17x + 1.2726$ | 0.94 |
| Amount miss | | Δ2 | 4. Polyn.<br>$y = 2154.9x^4 - 4538x^3 + 3044.9x^2 - 670.52x + 0.5896$ | 0.99 |

Table 7: Influence of Parameters on Strength at 20% Elongation along a Knitted Row

FIG. 56

| Influence on strength $I_{F\varepsilon 20}$ – SW | | | | $F_{\varepsilon 20}$ / $F_{\varepsilon 20}$ |
|---|---|---|---|---|
| Parameter | | $\Delta F_{\varepsilon 20}$ [N] | Equation | $R^2$ |
| No. of yarn plies | # | Δ46 | Linear<br>y = 1030.5x - 43.619 | 0.98 |
| Yarn tension | | Δ1.61 | Linear<br>y = 58.677x - 15.355 | 0.96 |
| Knock over depth | k | Δ3.16 | Linear<br>y = 123.25x - 90.042 | 0.97 |
| Amount tuck | | Δ2.77 | Cubic<br>$y = 430.21x^3 - 386.6x^2 + 1.7922x - 2.6649$ | 0.99 |
| Amount miss | | Δ0.80 | Cubic<br>$y = -290.57x^3 + 475.5x^2 - 194.7x + 0.0011$ | 0.97 |

Table 8: Influence of parameters on strength at 20% elongation along a wale

Fig. 57

| **Influence on strength $I_{Fmax}$ – SR** | | | | ← $F_{max}$ $F_{max}$ → |
|---|---|---|---|---|
| Parameter | | $\Delta F_{max}$ [N] | Equation | $R^2$ |
| No. of yarn plies | # | Δ1340 | Linear<br>y = 385.25x + 11.092 | 0.99 |
| Yarn tension | | Δ190 | Linear<br>y = 53.185x - 16.007 | 0.90 |
| Knock over depth | k | Δ373 | Quadratic<br>$y = 110.1x^2 + 7.0133x - 72.19$ | 0.99 |
| Amount Tuck Row | | Δ150 | Cubic<br>$y = -440.8x^3 + 589.55x^2 - 180.37x + 0.8484$ | 0.95 |
| Amount miss | | Δ110 | 4. Polyn.<br>$y = 1063.1x4 - 2173.3x^3 + 1365.1x^2 - 231.1x + 0.660$ | 0.95 |

Table 9: Influence of Parameters on Maximum Strength along Row

Fig. 58

| Influence on strength $I_{F_{max}}$ – SW | | | | |
|---|---|---|---|---|
| Parameter | | $\Delta F_{max}$ [N] | Equation | $R^2$ |
| No. of yarn plies | # | Δ1500 | Linear<br>y = 790.13x + 73.882 | 0.96 |
| Yarn tension | | Δ52 | Linear<br>y = 23.639x - 5.8467 | 0.90 |
| Knock over depth | k | Δ172 | Linear<br>y = 65.066x - 50.065 | 0.96 |
| Amount tuck | | Δ120 | Cubic<br>$y = 267.5x^3 - 263.67x^2 + 7.6756x - 0.9207$ | 0.91 |
| Amount miss | | Δ90 | 4. Polyn.<br>$y = 809.35x^4 - 1639.2x^3 + 987.84x^2 - 173.24x - 0.0953$ | 0.99 |

Table 10: Influence of Parameters on Maximum Strength along Wale

Fig. 59

| Parameter | | $\Delta\varepsilon_{max}$ [%] max / min | Equation | $R^2$ |
|---|---|---|---|---|
| No. of yarn plies | # | Δ45 | Linear<br>y = -48.937x + 16.15 | 0.99 |
| Yarn tension | | Δ38 | Linear<br>y = -32.807x + 8.32 | 0.94 |
| Knock over depth | k | Δ150 | Linear<br>y = -184.05x + 144.48 | 0.94 |
| Amount tuck | | Δ68 | Cubic<br>$y = 301.62x^3 - 346.72x^2 + 105.86x - 0.4674$ | 0.97 |
| Amount miss | | Δ36 | 4. Polynom<br>y = -730.16x4 + 1533x3 - 1107.8x2 + 300.75x + 0.1037 | 0.94 |

Table 11 Influence of Parameters on Elongation along a Row ($\Delta\varepsilon_{max\ row}$)

Fig. 60

| Parameter | | $\Delta\varepsilon_{max}$ [%] | Equation | $R^2$ |
|---|---|---|---|---|
| No. of yarn plies | # | Δ40 | Linear<br>y = -24.444x + 2.676 | 0.94 |
| Yarn tension | | Δ45 | Linear.<br>y = -24.444x + 2.676 | 0.92 |
| Knock over depth | k | Δ77 | Linear<br>y = 74.185x - 50.694 | 0.97 |
| Amount tuck | | Δ68 | Cubic<br>y = -218.19x3 + 216.38x2 - 23.567x + 1.6142 | 0.91 |
| Amount miss | | Δ169 | Cubic<br>y = 306.42x3 - 464.6x2 + 238.59x - 2.8742 | 0.92 |

Table 12: Change in Elongation along a Wale ($\Delta\varepsilon_{max\ wale}$)

Fig. 61

| Influence on mass per unit area $l_m$ | | | | |
|---|---|---|---|---|
| Parameter | | $\Delta m$ [g/m²] | Equation | $R^2$ |
| No. of yarn plies | # | Δ430 | Linear<br>y = 359.76x + 13.32 | 0.99 |
| Yarn tension | | Δ38 | Linear<br>y = 37.92x - 4.303 | 0.96 |
| Knock over depth | k | Δ77 | Linear<br>y = 71.819x - 45.435 | 0.96 |
| Amount tuck | | Δ25 | Linear<br>y = 26.334x + 2.5658 | 0.95 |
| Amount miss | | Δ40 | Linear<br>y = 37.34x + 3.5525 | 0.90 |

Table 13: Influence of Parameters on Mass/Area

Fig. 62

| Influence on thickness $l_T$ | | | | |
|---|---|---|---|---|
| Parameter | | $\Delta T$ [mm] max / min | Equation | $R^2$ |
| No. of yarn plies | # | Δ0.29 | Linear<br>y = 41.112x + 0.926 | 0.97 |
| Yarn tension | | Δ0.06 | Linear<br>y = 7.6111x + 2.6612 | 0.91 |
| Knock over depth | k | Δ0.09 | Linear<br>y = 10.122x + 2.3064 | 0.90 |
| Amount tuck | | Δ0.34 | Quadratic<br>$y = -153.52x^2 + 183.41x + 1.4222$ | 0.92 |
| Amount miss | | Δ0.62 | Quadratic<br>$y = -320.96x^2 + 351.36x + 0.135$ | 0.97 |

Table 14: Influence of Parameters on Textile Thickness

Fig. 63

| Influence on air permeability $l_R$ | | | | |
|---|---|---|---|---|
| Parameter | | $\Delta R$ [mm/s] max / min | Equation | $R^2$ |
| No. of yarn plies | # | Δ1900 | Linear<br>y = -32.192x - 49.125 | 0.99 |
| Yarn tension | | Δ1860 | Linear<br>y = -35.54x + 5.4267 | 0.94 |
| Knock over depth | k | Δ4800 | Linear<br>y = -80.98x + 52.797 | 0.97 |
| Amount tuck | | Δ2000 | Linear<br>y = -30.795x + 3.9633 | 0.95 |
| Amount miss | | Δ2590 | Linear<br>y = -46.941x + 14.119 | 0.94 |

Table 15: Influence of Parameters on Air Permeability

Fig. 64

| → Process parameters<br>↓ Characteristics | | | Machine Opt. | | Sturcture Options | | |
|---|---|---|---|---|---|---|---|
| | | | No. Of plies (→ More) | Yarn tension (→ Higher) | Knock over depth (→ Red. Stitch size) | Amount TUCK (→ Higher) | Amount MISS (→ Higher) |
| Strength | Course | [N] | ↑↑ | ↑ | | → | → |
| | Course (at $\varepsilon_{20\%}$) | [N] | ↑↑ | | ↑↑ | ↘ | ↘ |
| | Wale | [N] | ↑↑ | → | | → | → |
| | Wale (at $\varepsilon_{20\%}$) | [N] | ↑↑ | | | → | → |
| Strain | Course | [%] | | | ↓↓ | ↗ | → |
| | Wale | [%] | → | ↗ | | → | |
| Air permeability | | [mm/s] | ↓ | | ↓ | | ↓ |
| Material thickness | | [mm] | | → | → | | |
| Mass per unit area | | [g/sqm] | ↑↑ | | | | |

Decreasing ⟷ Influence ⟷ Increasing

| ↓↓ high | ↓ med | ↘ low | → neut. | ↗ low | ↑ med | ↑↑ high |
|---|---|---|---|---|---|---|
| + > 150% | + 50..150% | + 25..50% | ± 25% | - 25..50% | - 50..150% | - > 150% |

Table 16: The effect of the parameters on the textile properties

Fig. 65

| Min | | Max |
|---|---|---|
| 1 | # No. Yarn Plies [ - ] | 5 |
| 1 | Yarn Tension [cN] | 24 |
| 280 | k Knock Over Depth [-] | 80 |
| 0 | Amount Tuck [%] | 50 |
| 0 | Amount Miss [%] | 50 |

Table 17: Knit Parameter Values for a Lightweight Running Shoe

Fig. 66

| Influence on strength $I_{Fe20}$ – SR | | | | ⬅ $F_{e20}$ $F_{e20}$ ➡ |
|---|---|---|---|---|
| Parameter | | $\Delta F\varepsilon_{20}$ [N] | Equation | $R^2$ |
| No. of yarn plies | # | Δ313 | Linear<br>y = 5145.3x - 446.96 | 0.96 |
| Yarn tension | | Δ7 | Linear<br>y = 132.01x - 32.411 | 0.96 |
| Knock over depth | k | Δ11 | Cubic<br>$y = 276.86x^3 - 83.04x^2 + 26.273x - 91.037$ | 0.99 |
| Amount tuck | | Δ3 | Cubic<br>$y = -715.16x^3 + 1114.3x^2 - 465.17x + 1.2726$ | 0.94 |
| Amount miss | | Δ2 | 4. Polyn.<br>$y = 2154.9x4 - 4538x^3 + 3044.9x^2 - 670.52x + 0.5896$ | 0.99 |

Table 19: Average Benchmark Values for Properties of Textiles

Fig. 67

| Icon | Parameter | Unit | ZONE A - *high strength* |
|---|---|---|---|
| | Yarn material | [-] | Base: PA66 78f23/2 SET (rd.)<br>Elastic: PA66 118f30/1 Covered Lyc.<br>Plating: PA66 44f13/2 SET (rd.) |
| # | No. of plies | [-] | Base: 5<br>Elastic: 1<br>Plating: 1 |
| k | Knock over depth | [-] | L100 (130 – 30 local reduction) |
| | Yarn feed tension | [cN] | Base: 8<br>Elastic: 3<br>Plating: 8 |
| | Amount Miss | [%] | 25 |
| | Amount Tuck | [%] | 25 |
| | Pattern<br>knit<br>tuck<br>miss<br>knit+<br>Plush | [-] | |

Table 20: Parameters for use in Shoe Upper Strength Zone

Fig. 68

| Icon | Parameter | Unit | ZONE B – *Maximum elasticity* |
|---|---|---|---|
| | Yarn material | [-] | Base: PA66 78f23/2 SET (rd.)<br>Elastic: PA66 118f30/1 Covered Lyc.<br>Plating: PA66 44f13/2 SET (rd.) |
| # | No. of plies | [-] | Base: 2<br>Elastic: 1<br>Plating: 1 |
| k | Knock over depth | [-] | L150 |
| | Yarn feed tension | [cN] | Base: 8<br>Elastic: 3<br>Plating: 8 |
| | Amount Miss | [%] | 0 |
| | Amount Tuck | [%] | 25 |
| | Pattern<br>knit, knit+, tuck, Plush, miss | [-] | |

Table 21: Parameters for use in Shoe Upper Elastic Zone

Fig. 69

| Icon | Parameter | Unit | ZONE C – *High thickness* |
|---|---|---|---|
| | Yarn material | [-] | Base: PA66 78f23/2 SET (rd.)<br>Plating: PA66 44f13/2 SET (rd.) |
| # | No. of plies | [-] | Base: 3<br>Plating: 1 |
| k | Knock over depth | [-] | L250 (Plush) |
| | Yarn feed tension | [cN] | Base: 14<br>Plating: 14 |
| | Amount Miss | [%] | 0 |
| | Amount Tuck | [%] | 0 |
| | Pattern<br>knit<br>tuck<br>miss<br>knit+ Plush | [-] | |

Table 22: Parameters for use in Shoe Upper Cushion Zone

Fig. 70

| Icon | Parameter | Unit | ZONE D – *Soft collar* |
|---|---|---|---|
| | Yarn material | [-] | Base: PA66 78f23/2 SET (rd.)<br>Elastic: PA66 118f30/1 Covered Lyc.<br>Plating: PA66 44f13/2 SET (rd.) |
| # | No. of plies | [-] | Base: 2<br>Elastic: 1<br>Plating: 1 |
| k | Knock over depth | [-] | L250 (Plush) |
| | Yarn feed tension | [cN] | Base: 8<br>Elastic: 3<br>Plating: 8 |
| | Amount Miss | [%] | 50 |
| | Amount Tuck | [%] | 0 |
| | Pattern<br>knit<br>tuck<br>miss<br>knit+ Plush | [-] | |

Table 23: Parameters for use in Shoe Upper Collar Zone

Fig. 71

| Icon | Parameter | Unit | ZONE E – *High Air permeability* |
|---|---|---|---|
| | Yarn material | [-] | Base: PA66 78f23/2 SET (rd.)<br>Plating: PA66 60f1/1 monofil (rd.) |
| # | No. of plies | [-] | Base: 2<br>Plating: 1 |
| k | Knock over depth | [-] | L130 |
| | Yarn feed tension | [cN] | Base: 8<br>Plating: 5 |
| | Amount Miss | [%] | 0 |
| | Amount Tuck | [%] | 50 |
| | Pattern<br>knit<br>tuck<br>miss<br>knit+<br>Plush | [-] | |

Table 24: Parameters for use in Shoe Upper High Permeability Zone

Fig. 72

METHOD FOR MANUFACTURING A SHOE UPPER

TECHNICAL FIELD

The present invention relates to a method for manufacturing a shoe upper, a shoe upper and a shoe.

PRIOR ART

Generally, a shoe upper provides a covering for the foot that comfortably receives and securely positions the foot with respect to the shoe sole. In addition, the shoe upper may have a configuration that protects the foot and provides ventilation, thereby cooling the foot and removing perspiration. Therefore, as the requirements for shoe uppers become more demanding to provide high stability for sport applications and sufficient comfort during the everyday activities, the manufacturing of the shoe uppers is getting more difficult.

Methods for manufacturing shoes uppers such as those disclosed for example in GB 1,235,960 A, U.S. Pat. No. 4,134,955, US 2005/0115284 A1, US 2012/0255201 A1 are typically very complicated and labor intensive. In addition, manufacturing different sizes of the shoe uppers depending on the sizing system of the country in which they will be sold pushes the manufacturing costs higher.

U.S. Pat. No. 5,123,181 A discloses a shoe construction which affords manually operable girth adjustment by a shoe upper having a widthwise adjustable bottom section and a substantially hidden girth adjusting removably attachable fastener positioned between the bottom section of shoe upper and the sole.

However, such a known method does not provide a shoe upper with the desired stability and comfort as hook and loop fasteners and stiff leather are used.

Therefore, the underlying problem of the present invention is to provide an improved method for the manufacture of shoe uppers, in order to at least partly overcome the above mentioned deficiencies of the prior art.

SUMMARY OF THE INVENTION

The above mentioned problem is at least partly solved by a method for manufacturing a shoe upper according to the present invention. In one embodiment, the method comprises the steps of (a) providing at least one stretchable portion on the shoe upper, (b) stretching the at least one stretchable portion of the shoe upper for adapting a size of the shoe upper and (c) permanently attaching at least one rigid element at least partly on the stretched stretchable portion so that the stretched stretchable portion is locked.

The claimed invention allows to manufacture an adjustable shoe upper providing stability and comfort for sports applications more efficiently. Providing at least one stretchable portion on the shoe upper significantly simplifies the process of providing shoe uppers with different sizes as there is no longer the need to manufacture many different sizes of shoe uppers. Rather, only certain sizes of shoe uppers can be manufactured and can be stretched to desired intermediate sizes. For example, it would be sufficient to provide uppers in even integer sizes of the European size system (Paris points) like for example 36, 38, 40, 42, 44 and so on, and then to stretch these sizes to intermediate sizes like 36⅔, 37⅓, 38⅔, 39⅓, 40⅔ and so on. The stretching is facilitated by the stretchable portion and then permanently fixed in its intermediate size thanks to the rigid element.

In the context of the present invention, the expression "rigid element" is used to indicate a non-stretchable element, i.e. an element that is dimensionally stable when an external tensile stress is applied to it.

Thus, stretching the at least one stretchable portion of the shoe allows to create a configurable sizing system, e.g. only a half, a third, a quarter, etc. of the usual sizes of the shoe upper may be provided, so that only a half, third or quarter, etc. of lasts are needed and thus the manufacturing costs may be significantly reduced.

Moreover, permanently attaching at least one rigid element at least partly on the stretched stretchable portion enables that the stretched stretchable portion is locked so that the shoe upper may provide sufficient stability of the shoe upper. For example, the rigid element and the stretched stretchable portion may be permanently attached to each other by a seam so that the size and/or the width of the shoe upper may be fixed. Moreover, if a shoe sole is used as rigid element, even more stability for the entire shoe upper may be provided. In addition, the permanently attaching may provide increased comfort for a wearer. Thus, the shoe upper may fit tightly to the last and thus may provide excellent comfort in order to avoid skin irritations during wearing such a shoe upper. Therefore, these aspects are important for sports applications, e.g. playing soccer, as well as for leisure applications, e.g. walking through the city during a trip.

As a result, the overall process time, the labor costs as well as the manufacturing costs for manufacturing a shoe upper are significantly reduced as the reduced number of different sizes of shoe uppers reduces the storage costs.

In one embodiment, the at least one stretchable portion is provided at least partly in a bottom part of the shoe upper. This aspect of the present invention significantly improves the stability of the shoe upper as the bottom part represents the interface of the shoe upper with the sole. If the shoe sole is used as the rigid element, the step of locking the size of the shoe upper and the step of attaching the shoe sole to the shoe upper may be carried out in only one single manufacturing step. Thus, the overall process may be further optimized. Moreover, by providing the stretchable portion in the bottom part of the shoe upper the stretchable portion may not be visible and would not be located at a sensitive portion of a foot so that overall impression of the manufactured shoe may be more attractive and blisters on the foot may be avoided.

In some embodiments, the method may further comprise the step of forming the shoe upper, wherein the shoe upper is integral and continuous from a medial side to a lateral side, preferably in an instep part of the shoe upper. In contrast to conventional shoe uppers, wherein a tongue opening of the shoe upper is stretched for adjusting the shoe upper to a last, omitting a tongue and a corresponding opening is more simple as further method steps of forming the tongue and the tongue opening can be omitted. In addition, such a method may be more efficient as faulty inserting of the last into the shoe upper in an automated process due to a disturbing tongue element may be avoided. Moreover, it is also possible to manufacture a shoe upper without laces providing extraordinary stability for the foot of a wearer inside the shoe upper, especially for sports applications.

In one embodiment, the at least one stretchable portion is more stretched than any other portion on the shoe upper during the step of stretching the stretchable portion.

This is obtained in particular by the stretchable portion being more stretchable than the remaining portions of the shoe upper. Advantageously, this ensures that most of the forces during stretching apply to the stretchable portion of the shoe upper so that any other portion on the shoe upper might not be damaged before locking the stretched stretchable portion. Therefore, the error rate of the manufacturing process and possible manufacturing waste is significantly minimized.

In one embodiment, the shoe upper is a sock-like shoe upper. For example, for a sock-like shoe upper no seams have to be provided which further significantly simplifies the manufacturing process. Thus, there is no need of certain manufacturing steps and/or machines for sewing together the shoe upper.

In one embodiment, the shoe upper is knitted. Moreover, the shoe upper may be formed with a small circular knit technique. For example, a small circular knit machine may weft knit the shoe upper in one piece as a sock. In more detail, the settings of such a machine may be specific to provide a sock with specific technical features that allow to use it as a shoe upper of a shoe, in particular of an athletic shoe. The inventors have realized for the first time that such a shoe upper further improves the whole manufacturing process without any loss in the stability and comfort of the shoe upper. The small circular knit machine may manufacture shoe uppers in a fully automated way.

Alternatively, the shoe upper may be formed with a large circular knit technique or with a flat knit technique and obtained starting from a flat knitted component. Such initial flat knitted component is then shaped on a 3-D form by means of a stitching step. In this particular embodiment the stretchable portion of the upper may be defined by sections that are separated on the flat knitted component and that are joined together by means of the stitching step.

In one embodiment, the attached rigid element covers entirely the stretchable portion. Moreover, the rigid element may be a shoe sole. Therefore, the shoe upper may be even locked in a more stable configuration. In addition, such a rigid element further simplifies the manufacturing of a shoe upper, as no further additional element other than the shoe sole has to be attached to the shoe upper which is anyway needed to manufacture a complete shoe. Thus, the method provides the highest stability for a shoe upper while the minimum number of key elements, namely the shoe upper and the shoe sole, is used so that the overall process time is further reduced.

In one embodiment, two or more stretchable portions are provided. Such providing of several stretchable portions may further improve the process of adjusting the shoe upper as described before because the forces occurring during stretching are absorbed by more than one stretchable portion. Thus, the increments of different sizes of the shoe upper may be enlarged, e.g. only every second or third full size has to be provided during the manufacturing process, so that further manufacturing costs may be saved.

In one embodiment, the step of stretching the stretchable portion is carried out by inserting a last into the shoe upper. Using a last for stretching can ensure that the stretched shoe upper better conforms to the anatomy of a human foot. Alternatively or additionally, the last may be individually manufactured according to data of a customer's foot so that the stretching step may provide a shoe upper fitting more tightly to the customer's foot.

Moreover, the last may be inflatable. Such usage of an inflatable last may further improve the stretching step after forming the shoe upper as the size of the shoe upper may be adapted more selectively and with high precision. Furthermore, an inflatable last which may be inflated to different sizes avoids the need to provide a different last for each and every size. This saves overall manufacturing costs and simplifies the manufacturing process.

In some embodiments, the method may further comprise the step of providing at least one stretch yarn in the at least one stretchable portion. Moreover, the method may also further comprise the step of providing at least one portion without the stretch yarn on the shoe upper. The inventors have realized that such yarns provide better stretching properties so that the manufacturing process may be further optimized. In addition, they have realized that some areas of the foot have to be fixed inside the shoe upper, i.e. such areas might need lower stretchability in order to provide sufficient stability of the foot in each direction during movements.

In some embodiments, the method may further comprise the step of providing a first knit structure on the shoe upper and providing a second knit structure in the at least one stretchable portion, wherein the second knit structure is more stretchable than the first knit structure. Such embodiments allow to manufacture a shoe upper with high stability properties in appropriate portions as the advantages of different knit structures may be used. For example, a first knit structure may be a coarse meshed fabric providing a better breathability, wherein a second knit structure may be more stretchable to allow a stretching of the shoe upper during the manufacturing process.

A further aspect of the present invention relates to a shoe upper manufactured as described before. As explained above, such a shoe upper provides a high stability and comfort to a wearer as the stretchable portion allows for the adjusting the size of the shoe upper to the dimensions of a foot of the wearer.

A still further aspect of the present invention relates to a shoe comprising a shoe upper as described before.

SHORT DESCRIPTION OF THE FIGURES

Possible embodiments of the present invention are further described in the following detailed description, with reference to the following figures:

FIG. 1 presents a flow diagram illustrating exemplary method steps for manufacturing shoe uppers in accordance with certain aspects of the present disclosure.

Figure 2A:
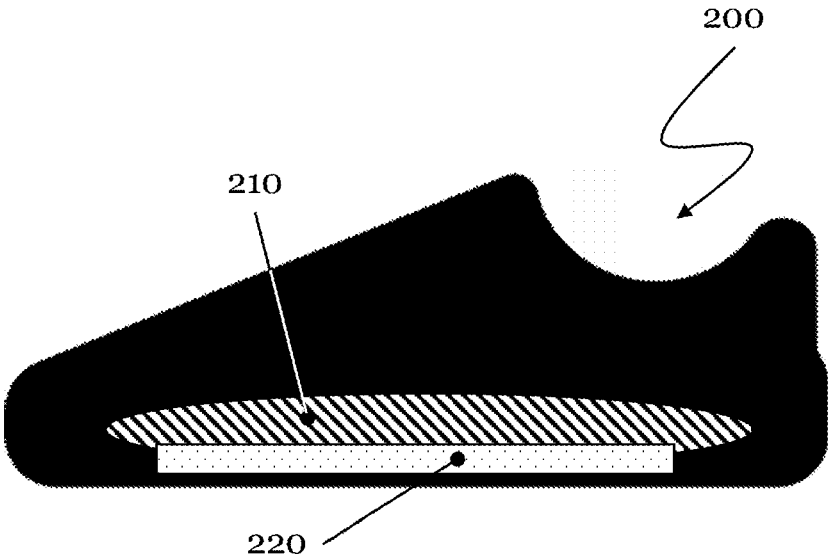
Figure 2B:
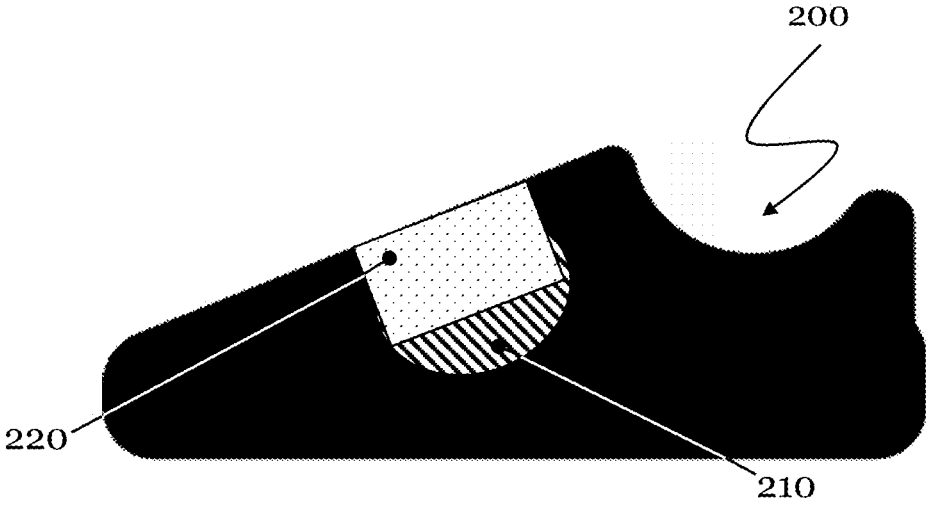
Figure 2C:
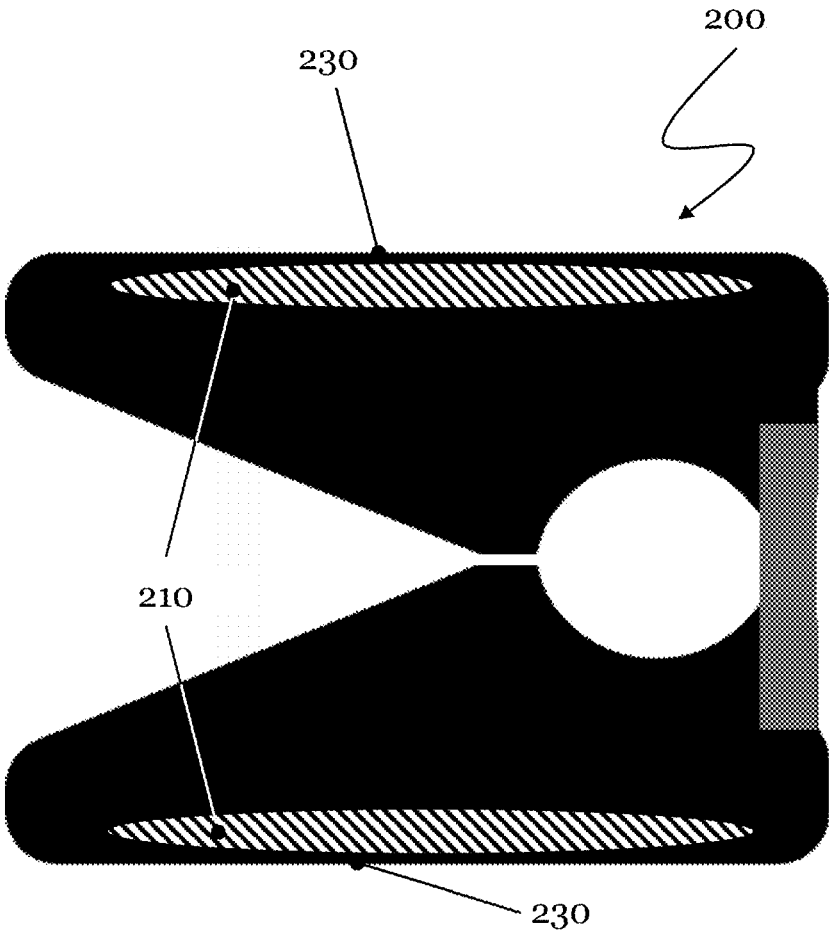

FIGS. 2*a*-2*c* present schematic embodiments of a shoe upper according to the invention.

Figure 3:
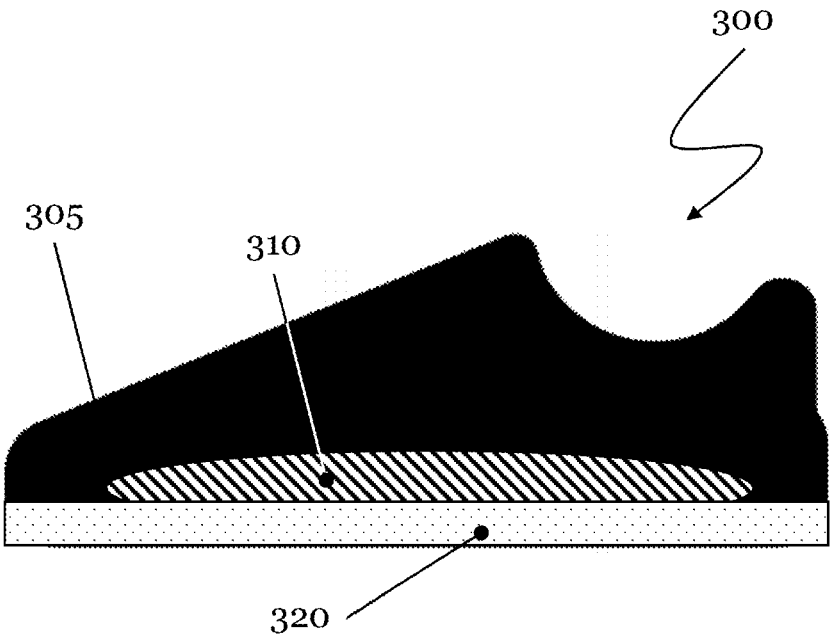

FIG. 3 presents a schematic embodiment of a shoe comprising a shoe upper according to the invention.

Figure 4:
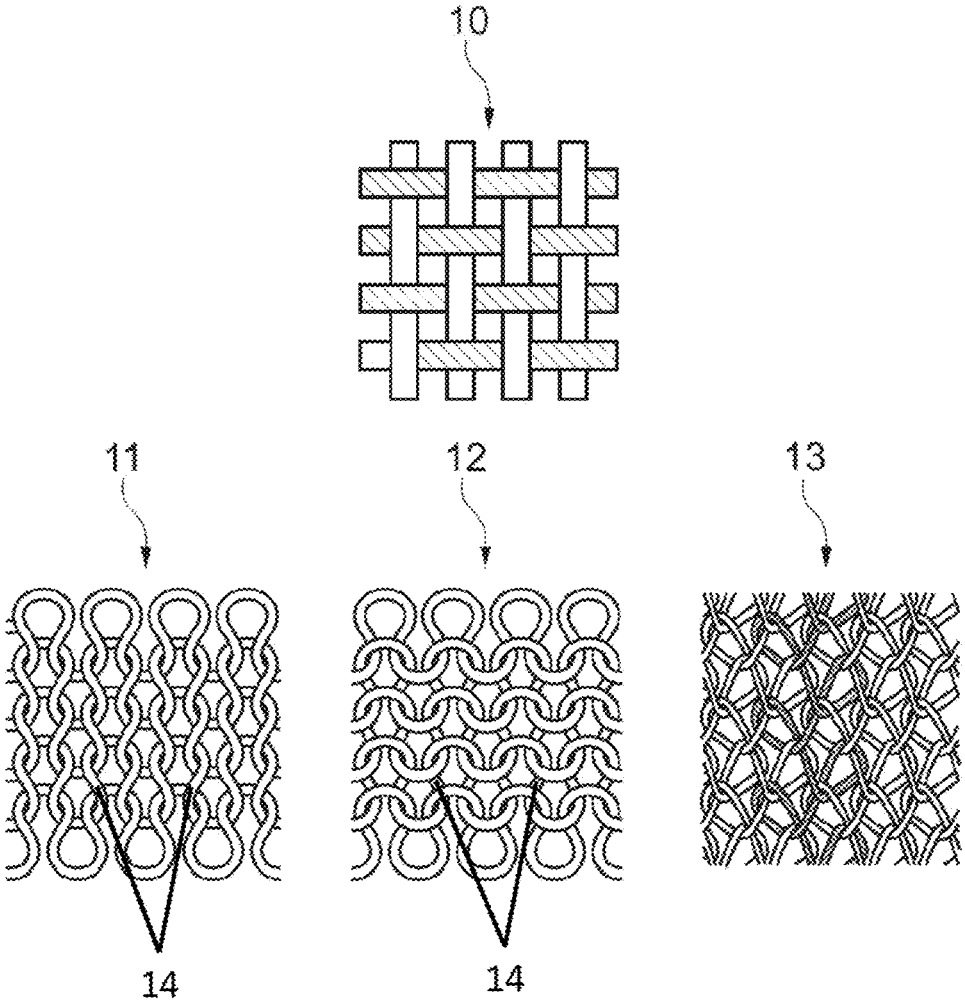

FIG. 4: schematic representation of textile structures which can be used for the present invention.

Figure 5:
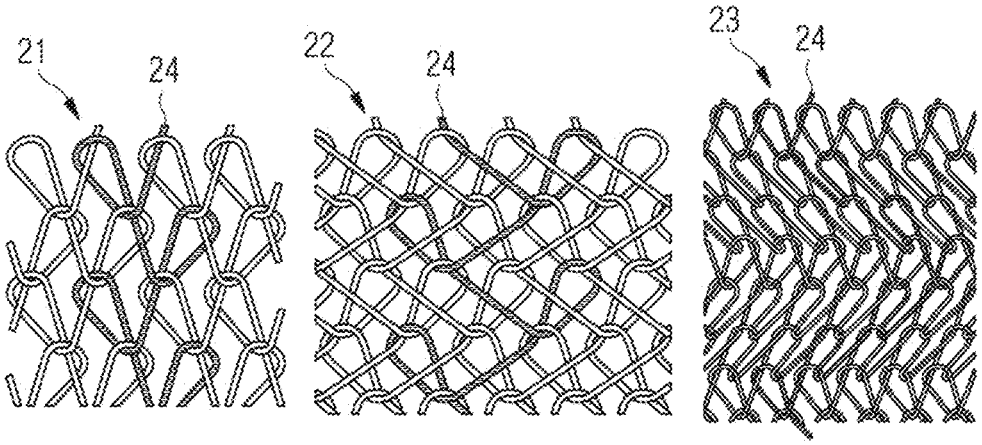

FIG. 5: three different interlaces of a warp-knitted fabric which can be used for the present invention.

Figure 6A:
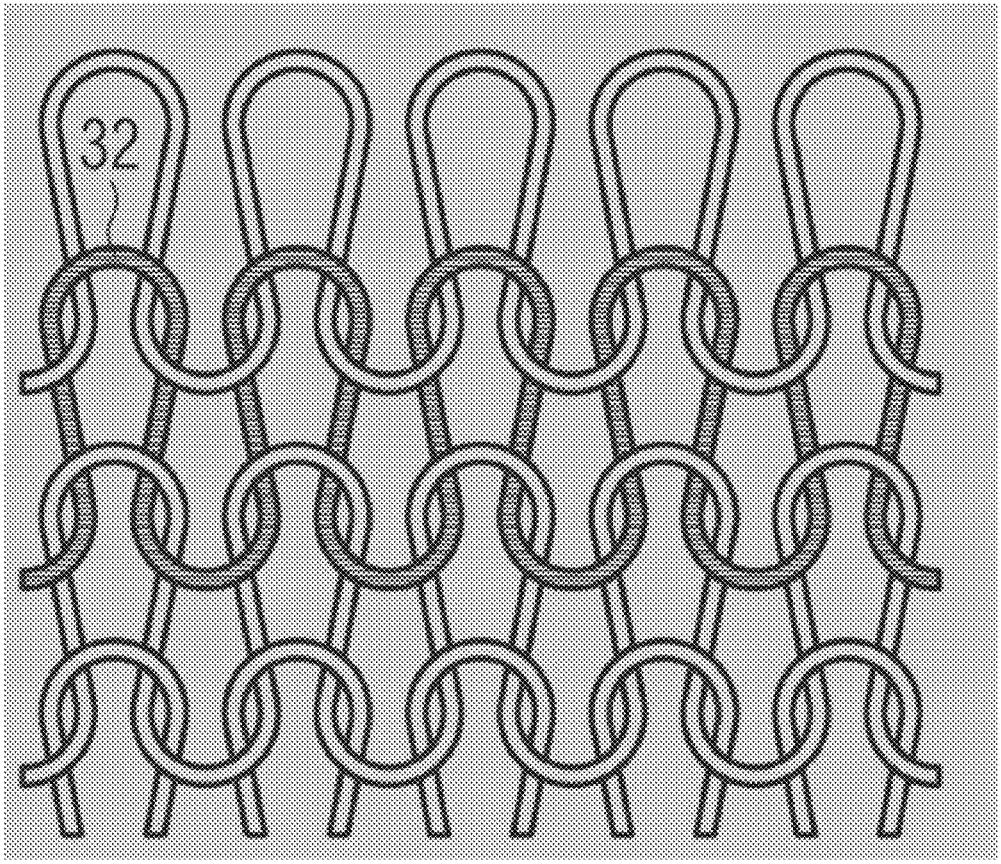
Figure 6B:
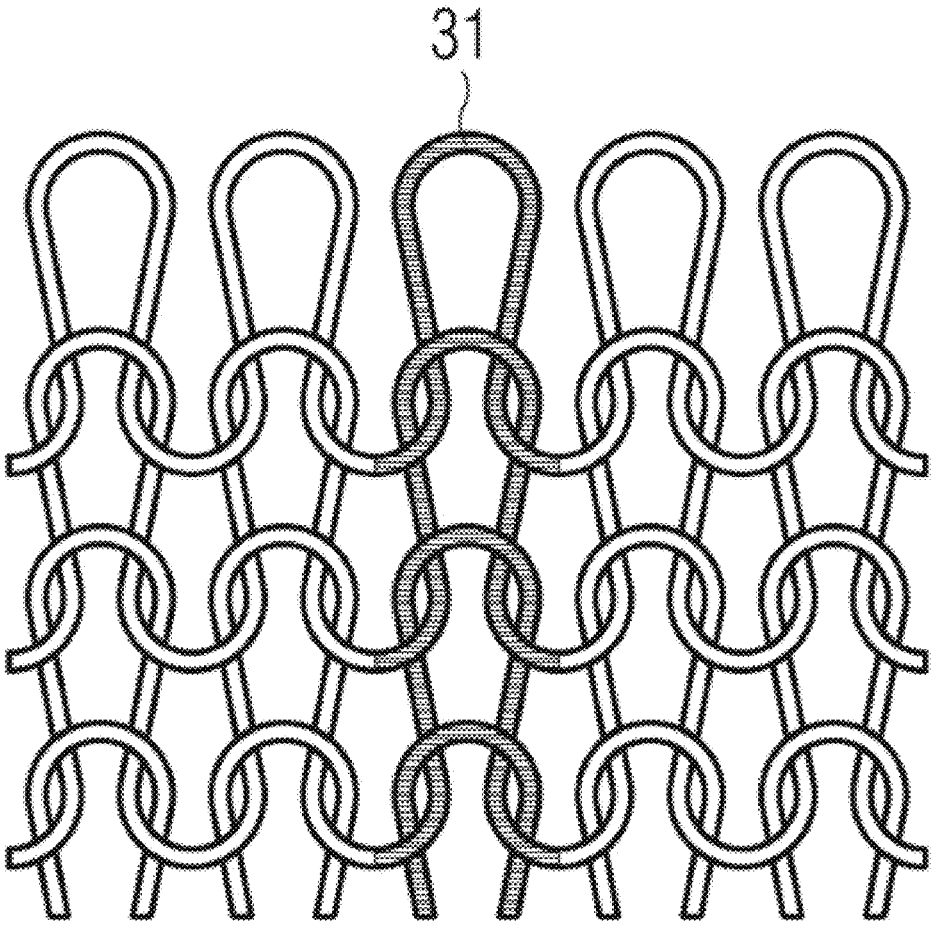
Figure 6C:
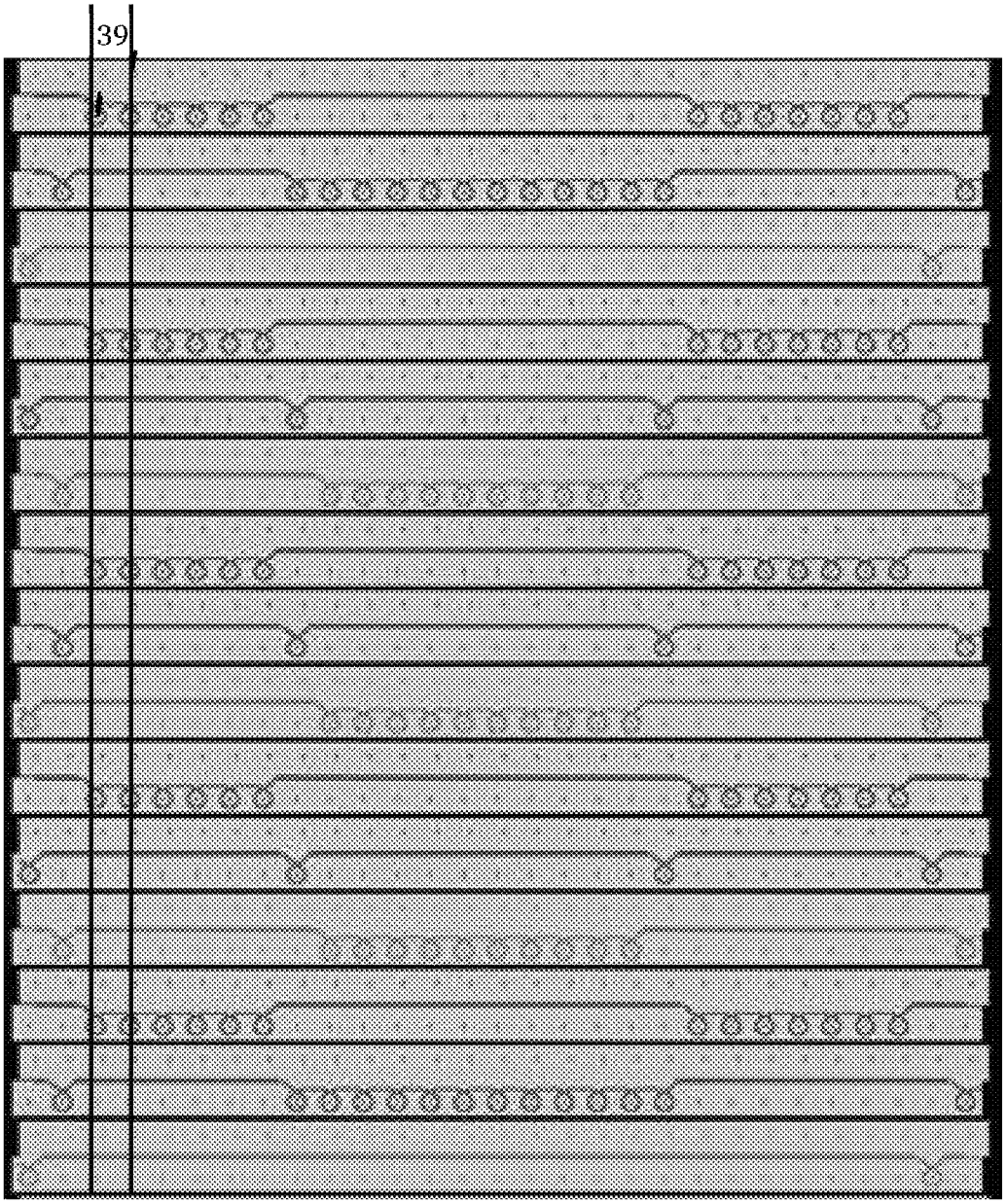

FIGS. 6A-6C: row and wale of a weft-knitted fabric which can be used for the present invention.

Figure 7:
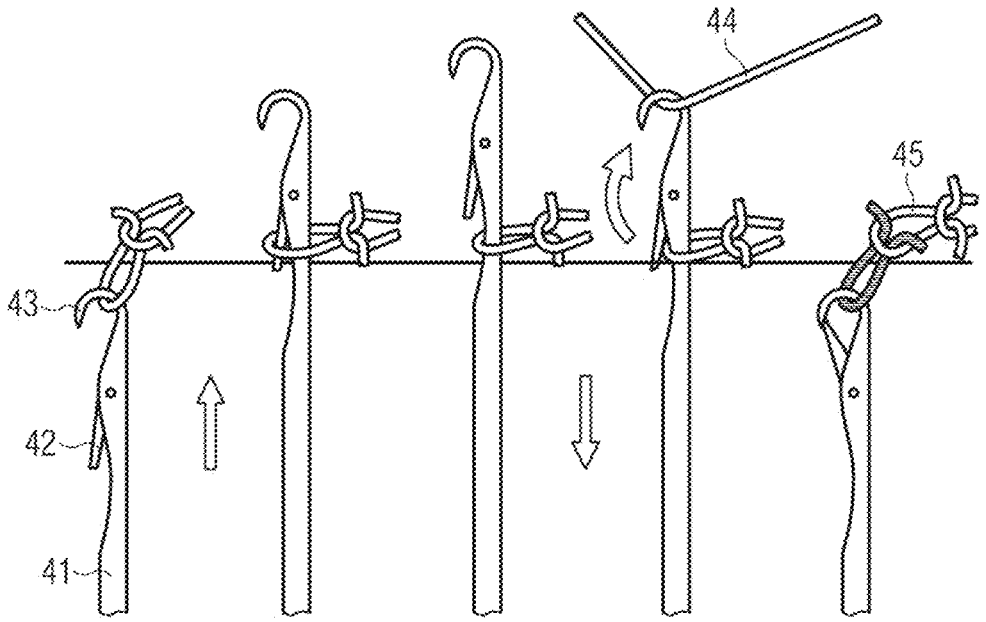

FIG. 7: stitch forming by latch needles during weft knitting.

Figure 8:
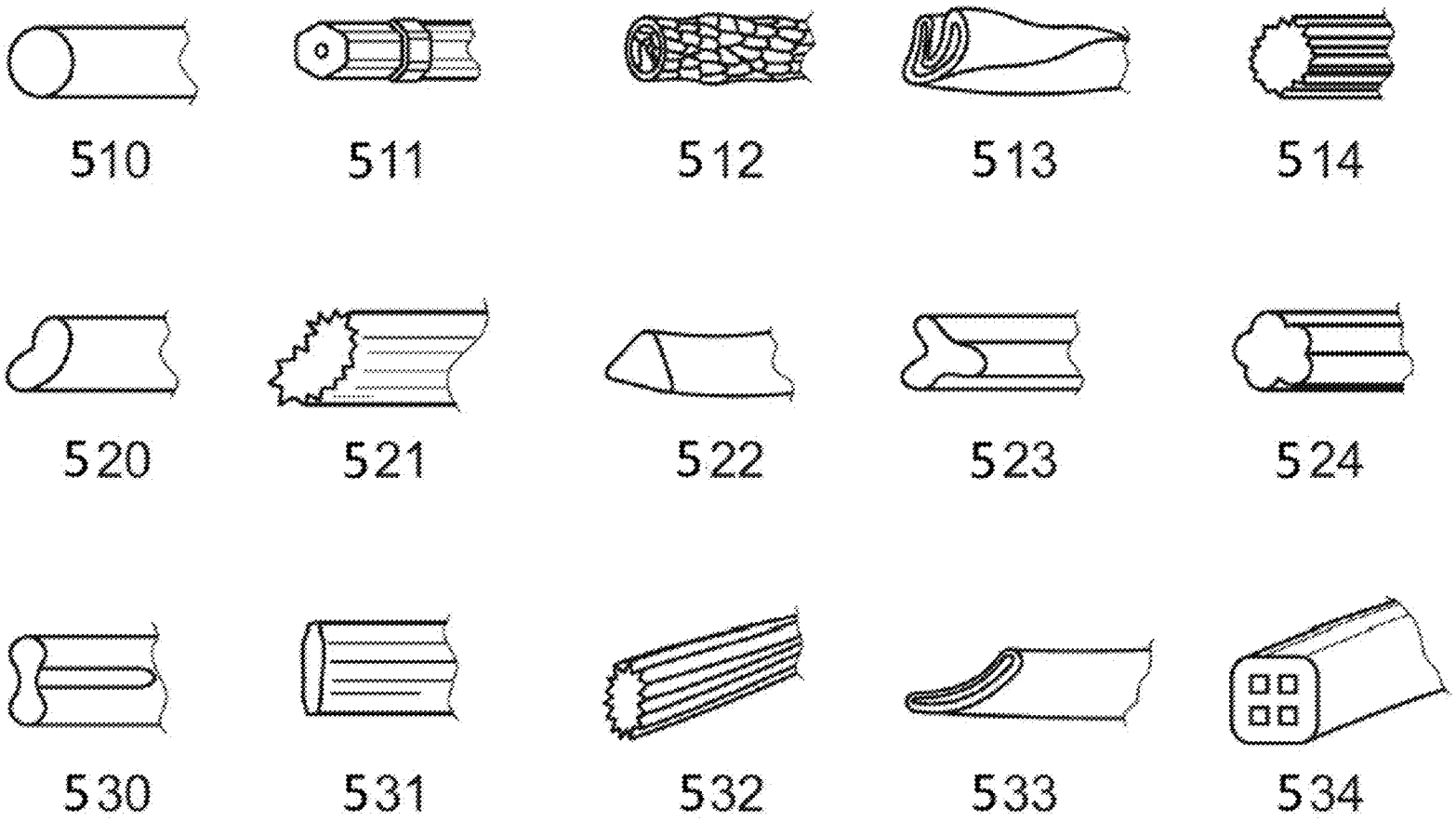

FIG. 8: cross-sectional views of fibers for yarns used in knitwear which can be used for the present invention.

Figure 9:
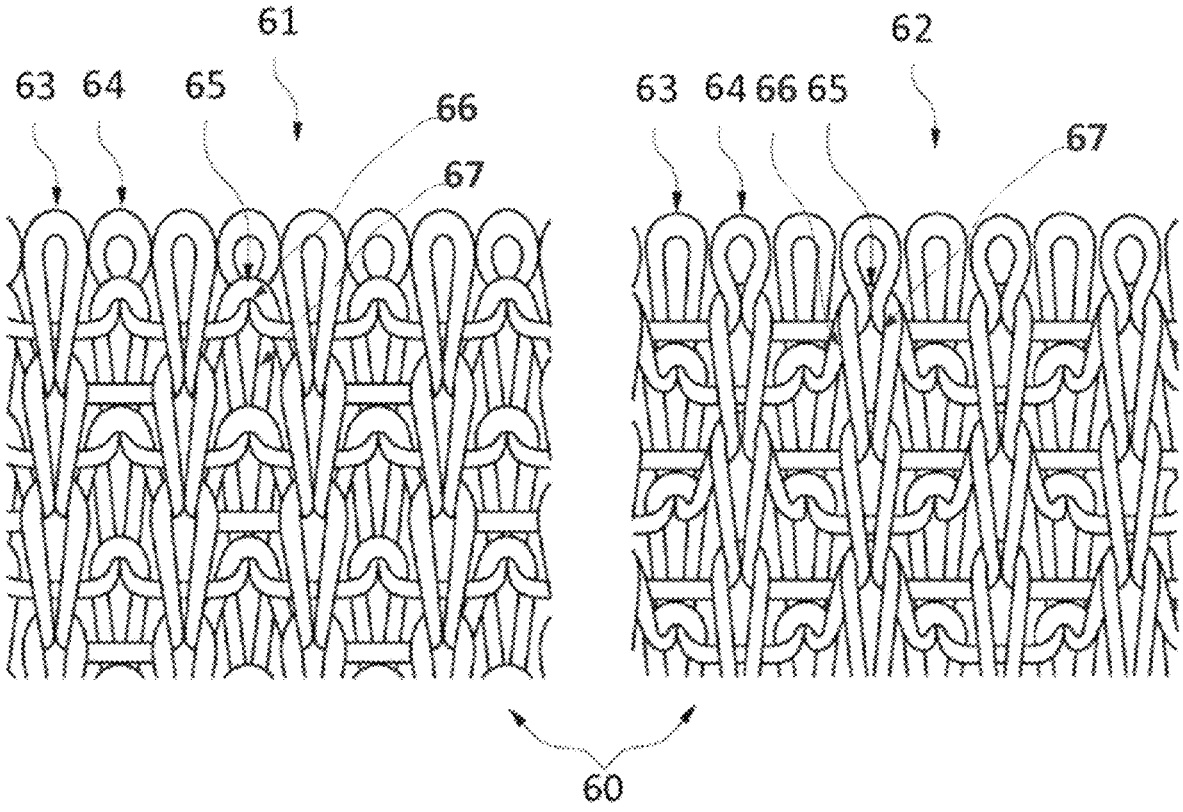

FIG. 9: front view and back view of a knitted knitwear which can be used for the present invention.

Figure 10A:
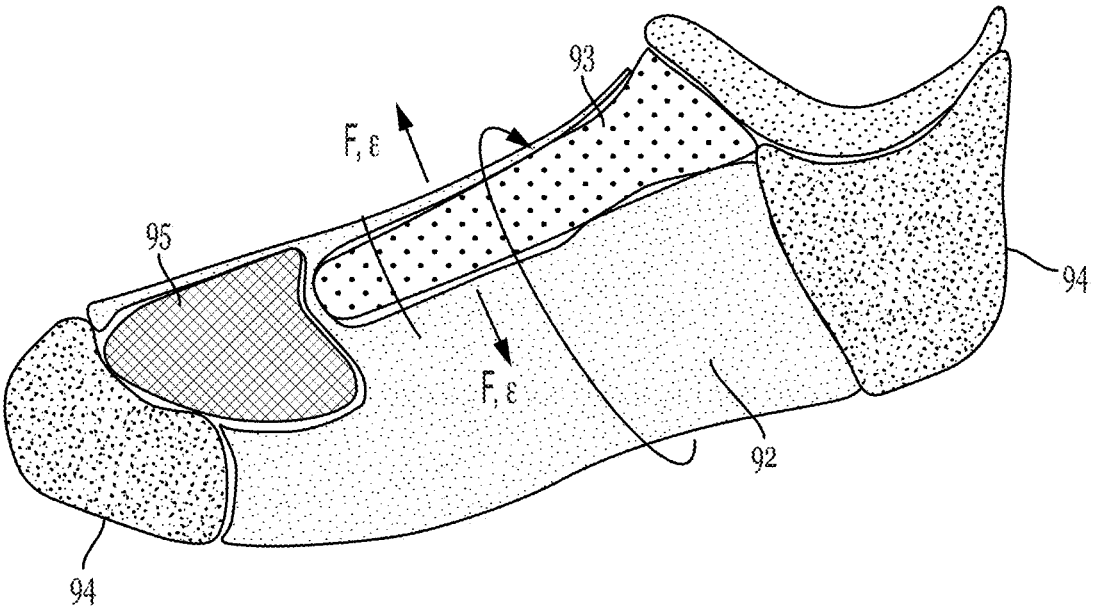

FIG. 10A: an embodiment of a shoe upper according to the invention.

Figure 10B:
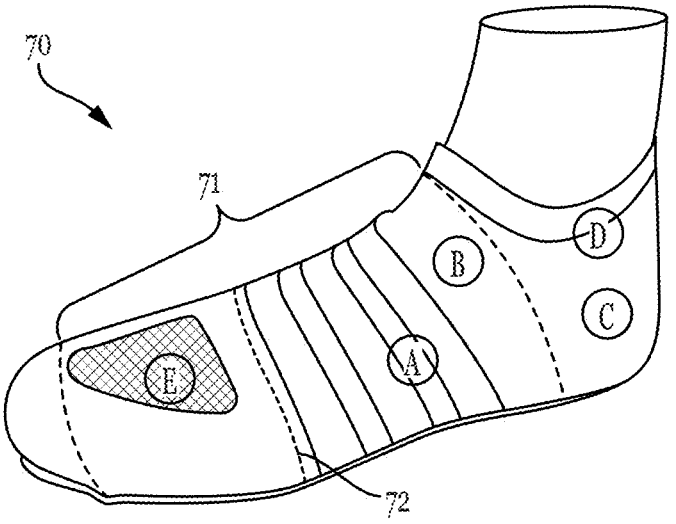

FIG. 10B: an embodiment of a shoe upper according to the invention.

Figure 10C:
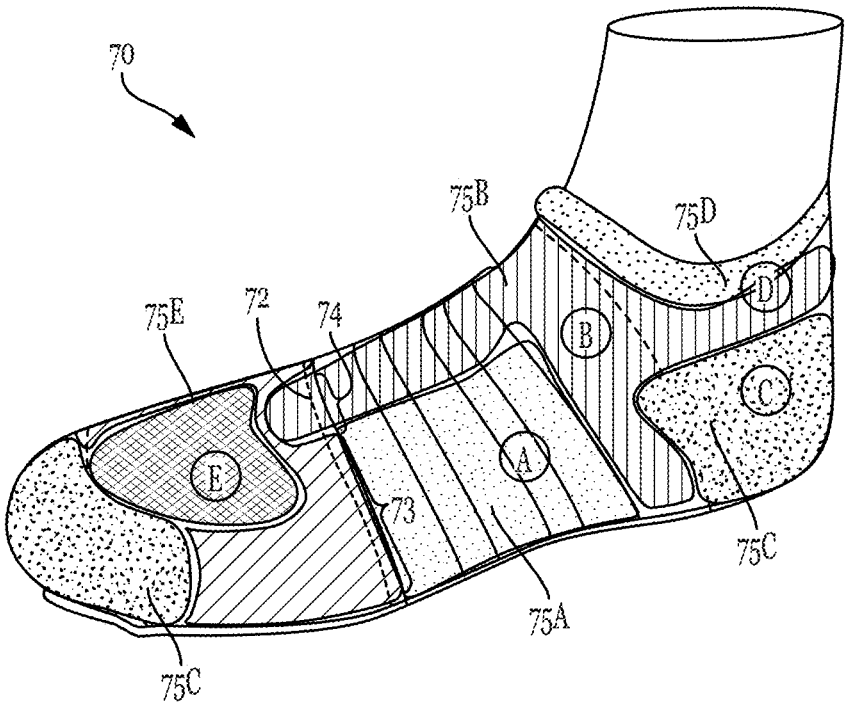

FIG. 10C: an embodiment of a shoe upper according to the invention.

Figure 11:
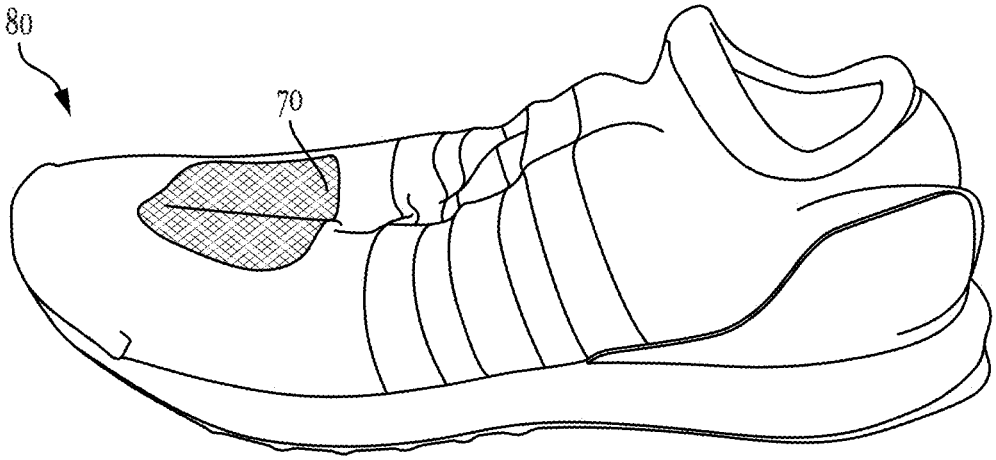

FIG. 11: an embodiment of a shoe according to the invention.

Figure 12:
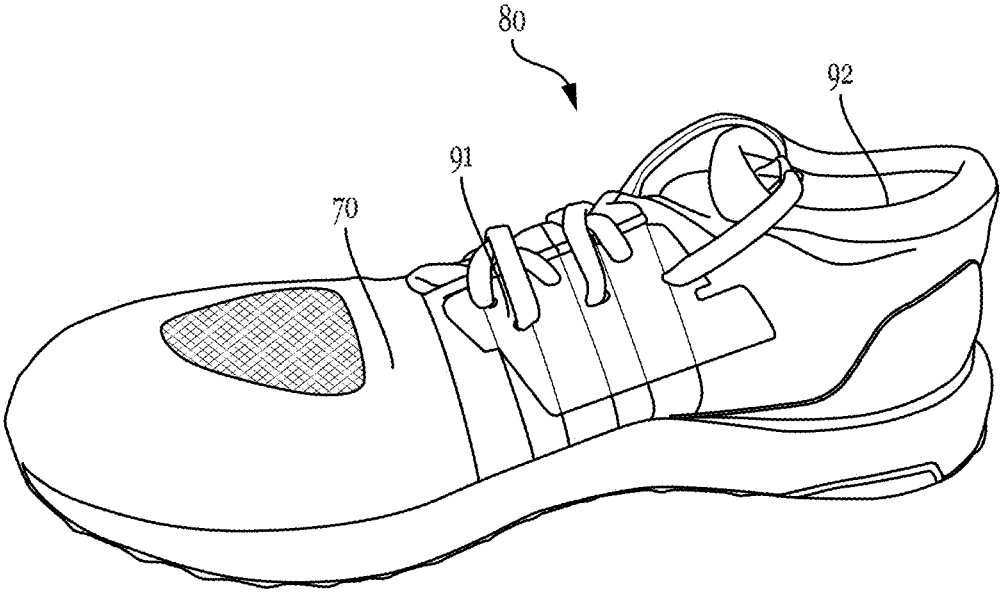

FIG. 12: another embodiment of a shoe according to the invention.

Figure 13:
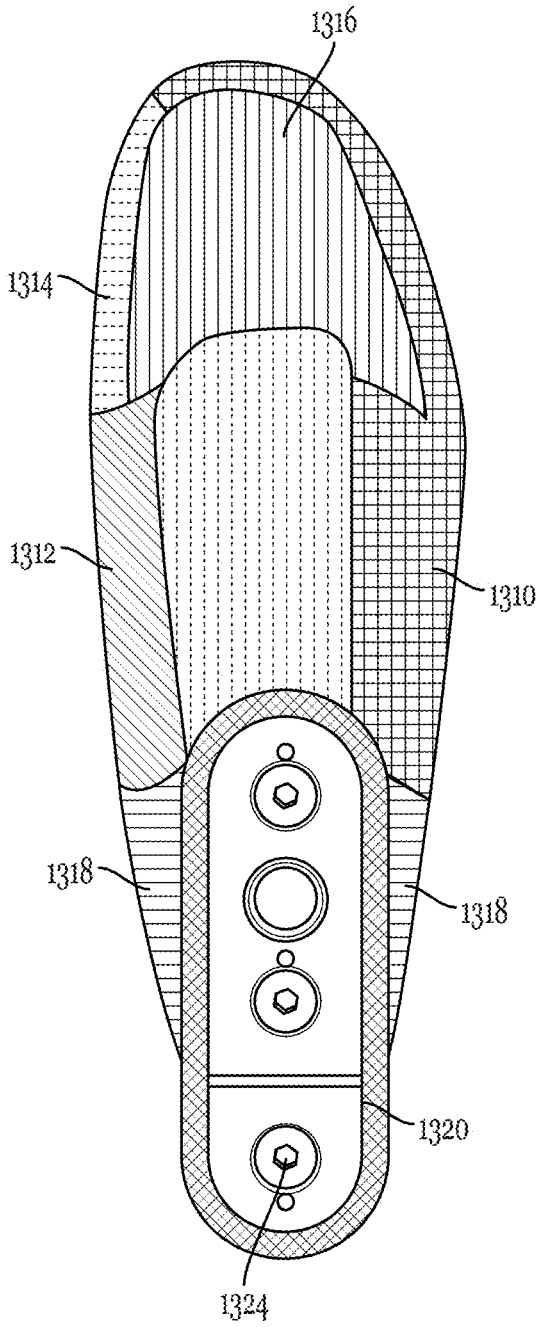

FIG. 13: a material map for an embodiment of a shoe upper according to the invention.

FIG. 14: an embodiment of a shoe upper according to the invention.

Figure 15A:
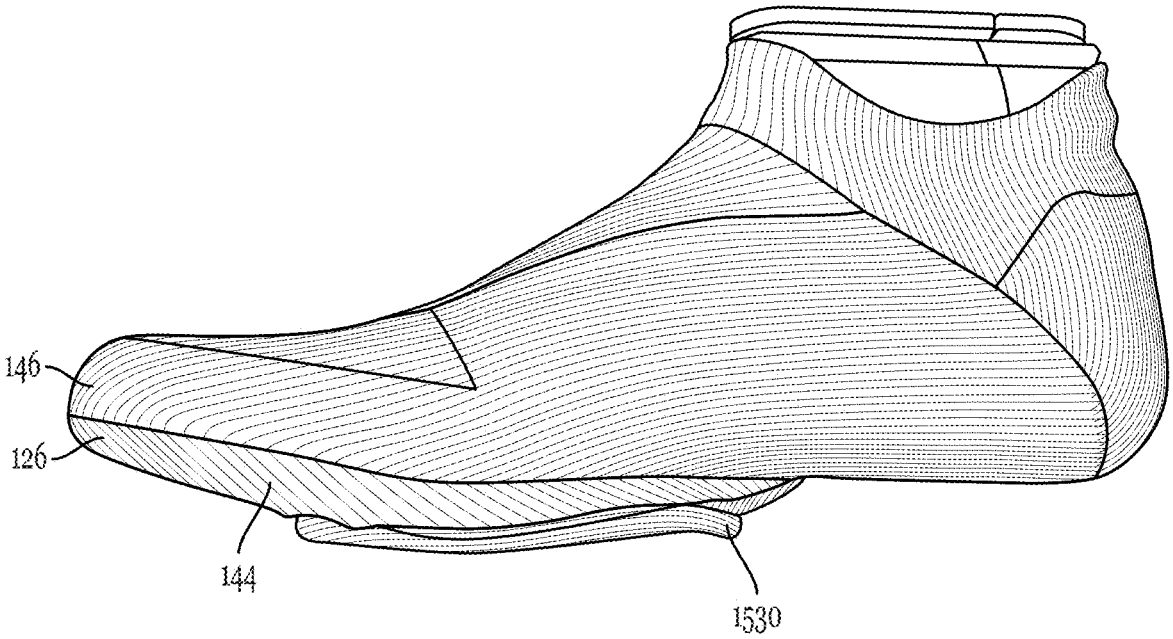

FIG. 15A: an embodiment of a shoe upper according to the invention.

Figure 15B:
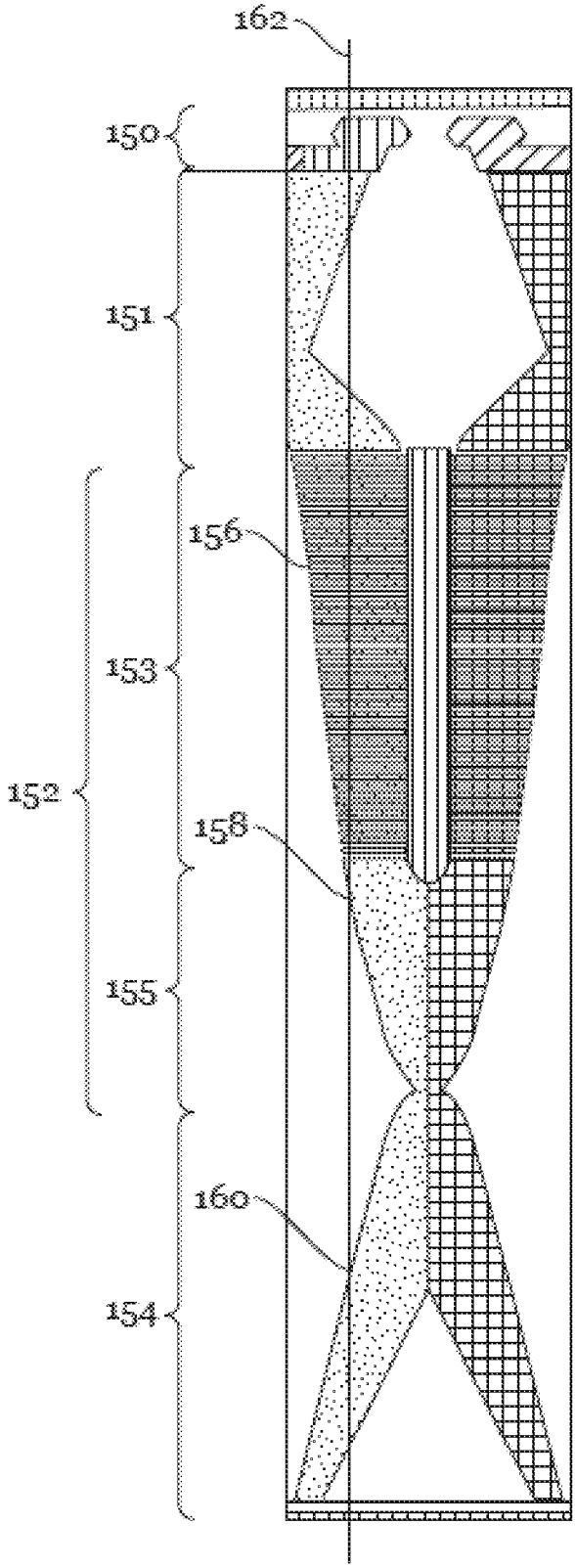

FIG. 15B: a machine knitting sequence for a single layer embodiment of an elongated hollow structure for a shoe upper according to the invention.

Figure 15C:
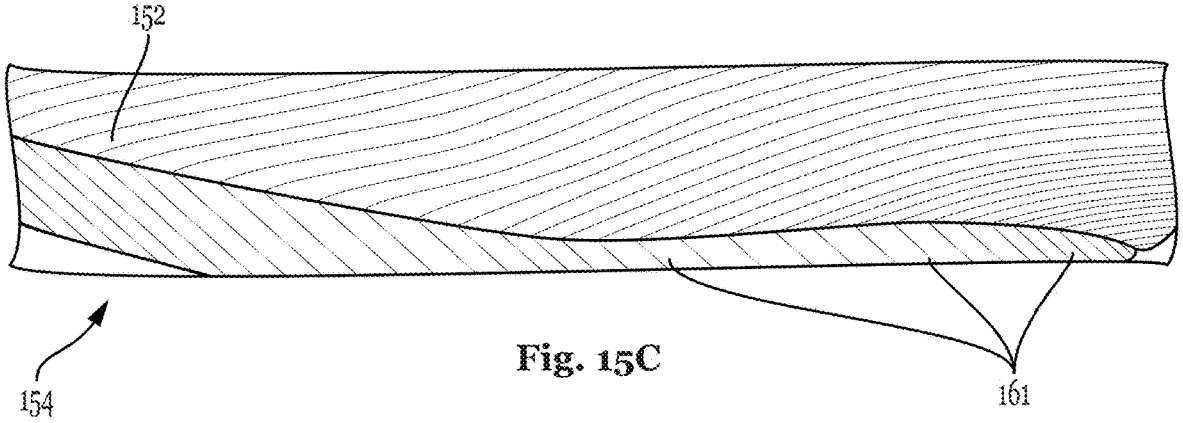

FIG. 15C: an exploded view of a portion of an embodiment of a shoe upper according to the invention.

Figure 16A:
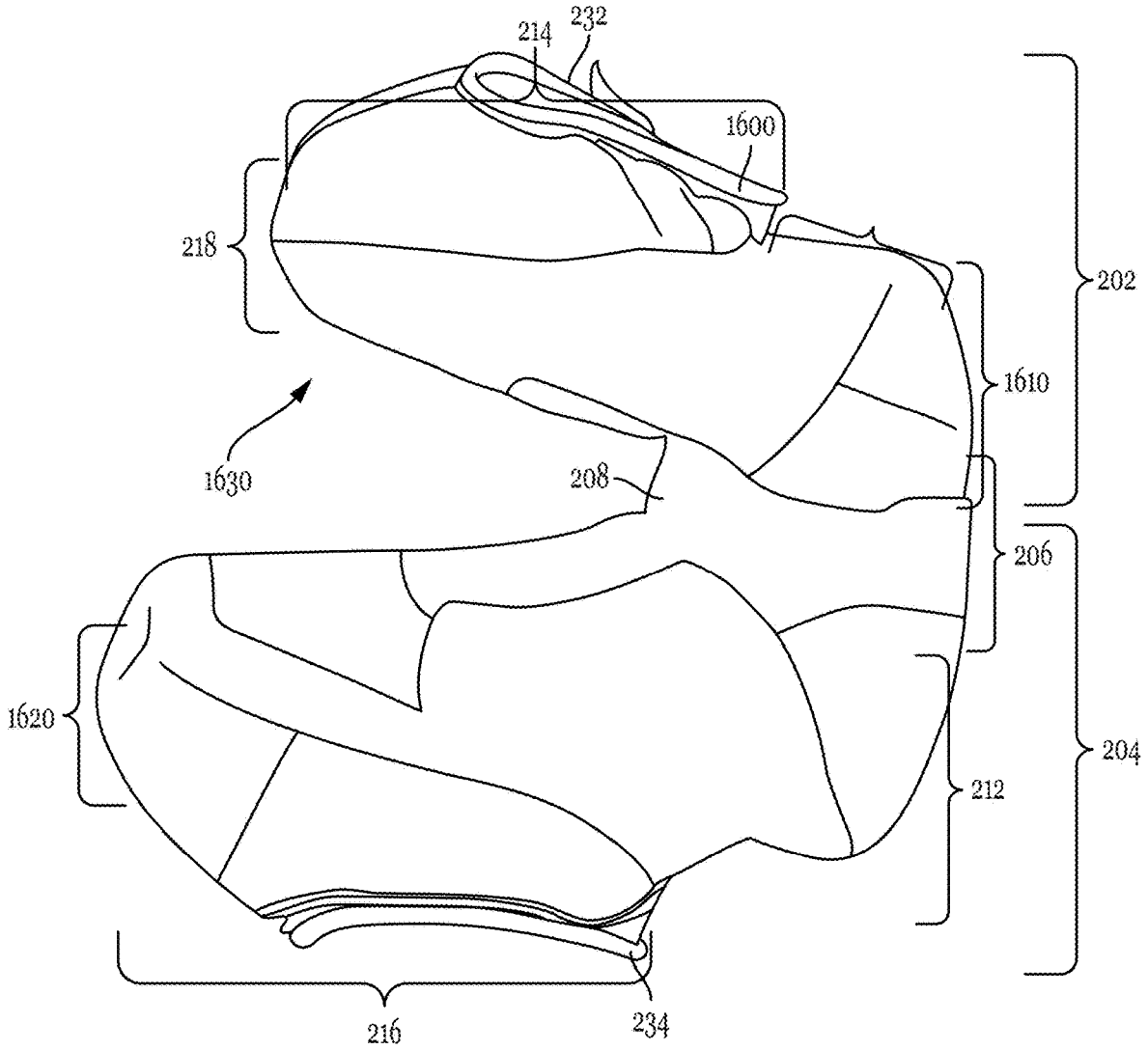

FIG. 16A: an elongated hollow knit structure for use in an embodiment of a shoe upper according to the invention.

Figure 16B:
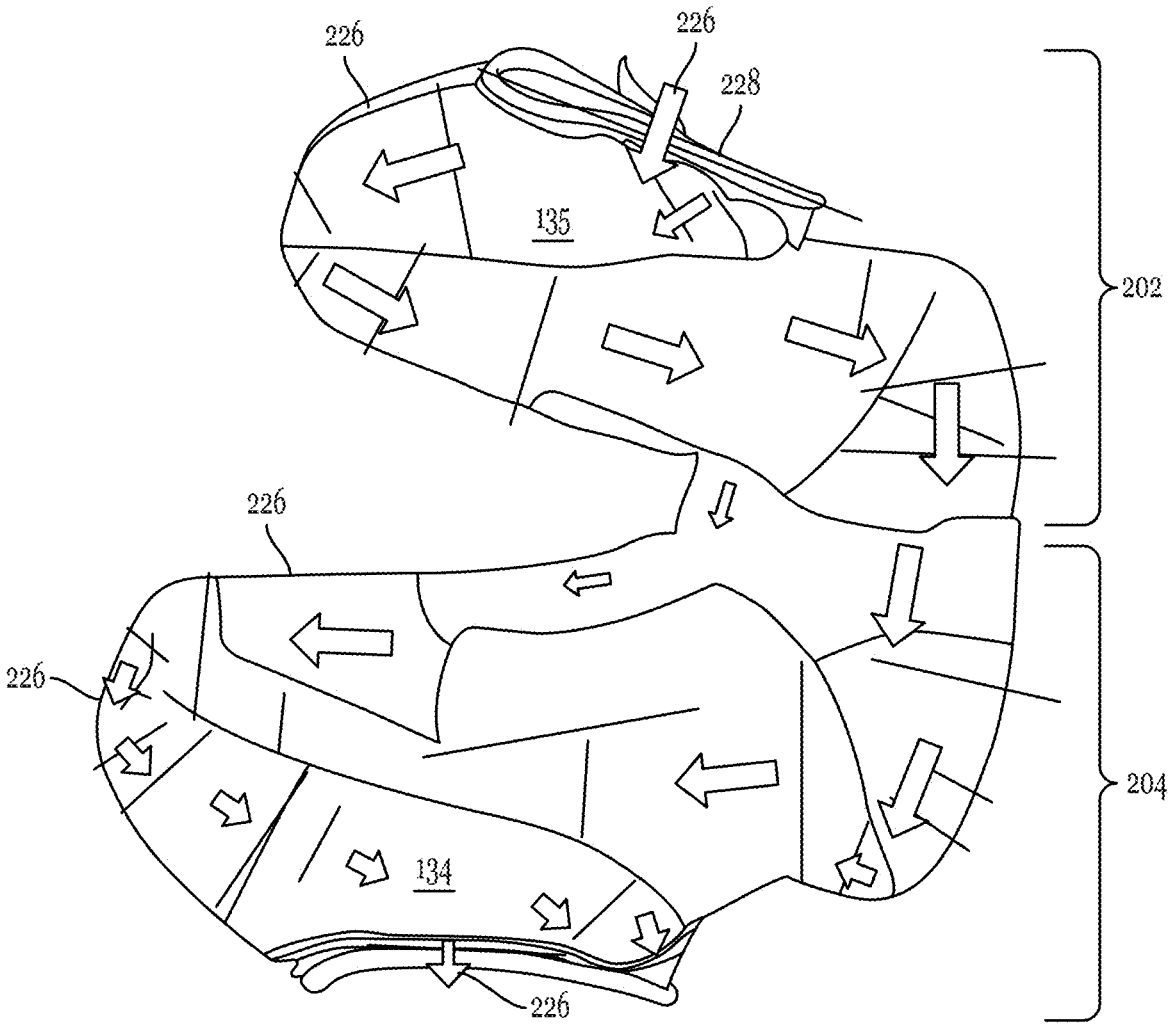

FIG. 16B: an elongated hollow knit structure for use in an embodiment of a shoe upper according to the invention.

Figure 16C:
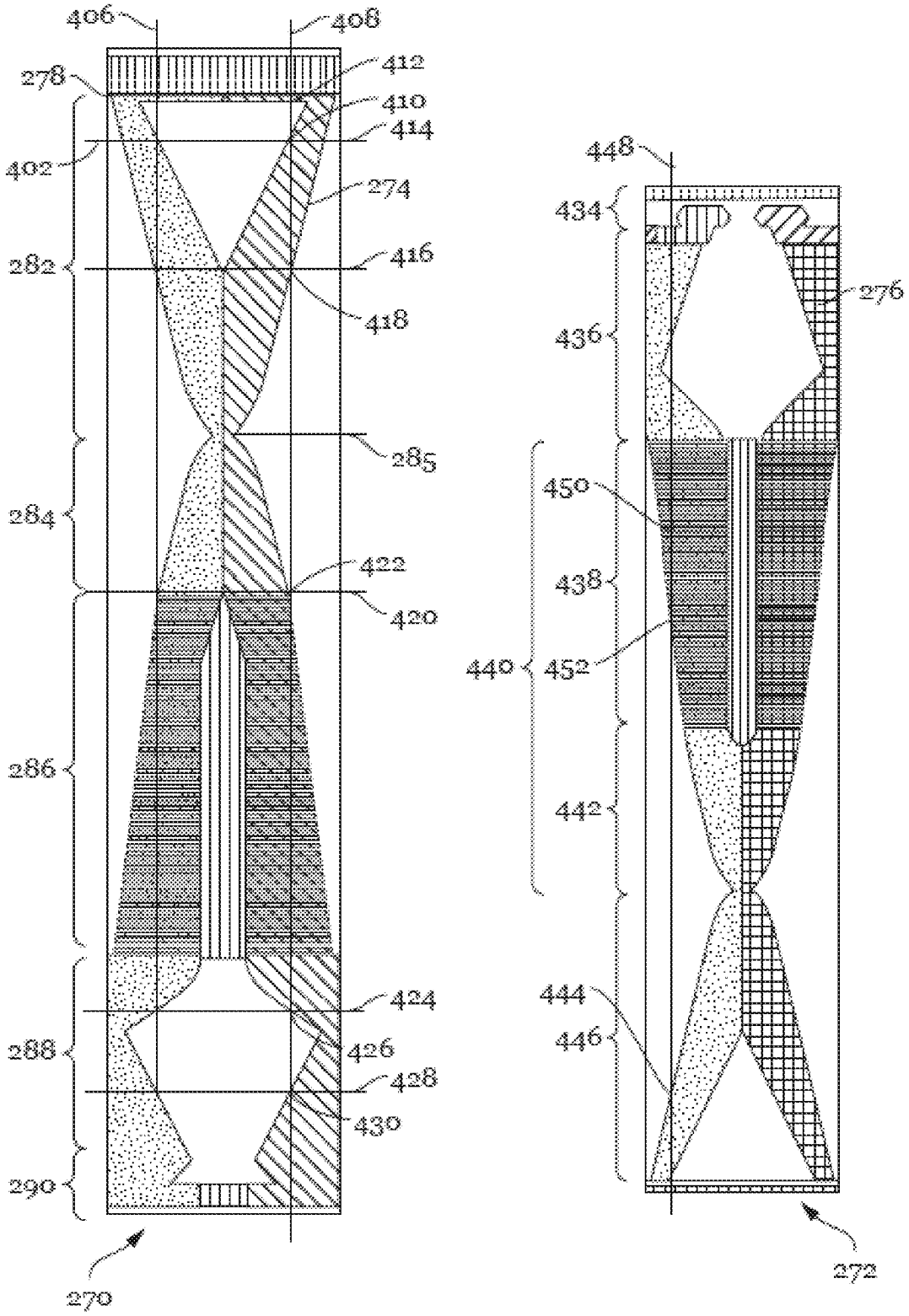

FIG. 16C: a machine knitting sequence for an elongated hollow knit structure knitted on a small circular knit machine.

Figure 16D:
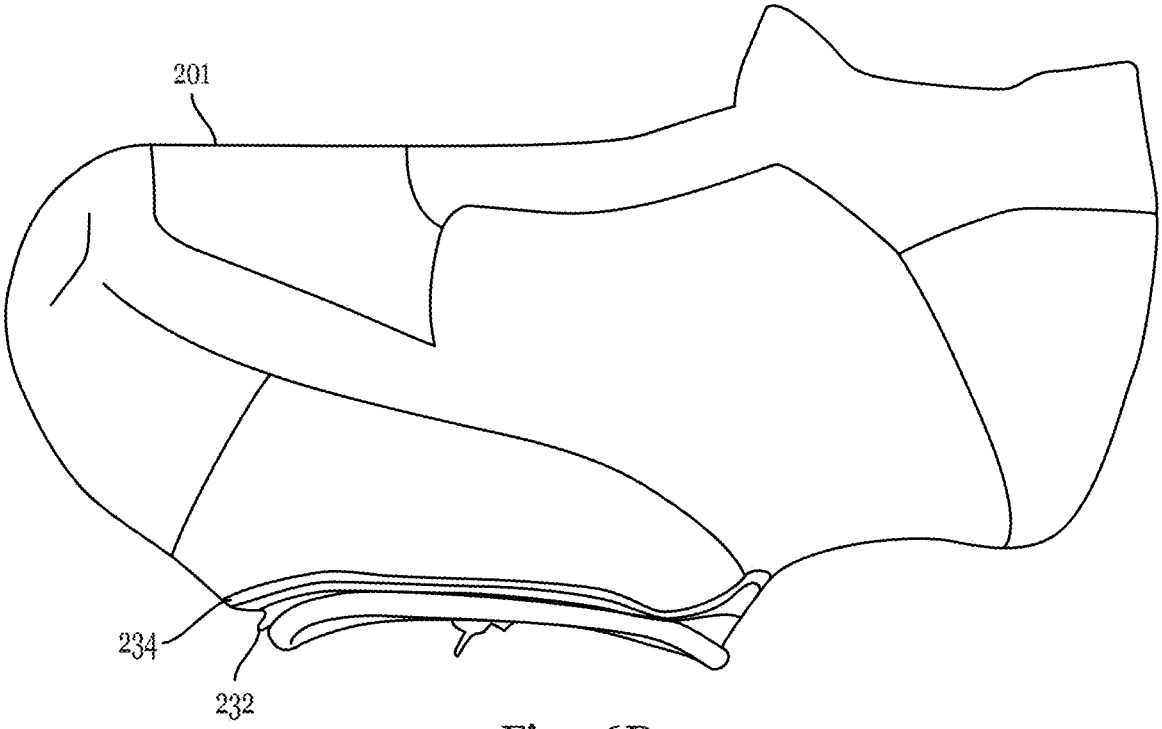

FIG. 16D: an elongated hollow knit structure folded to form an embodiment of a shoe upper according to the invention.

Figure 16E:
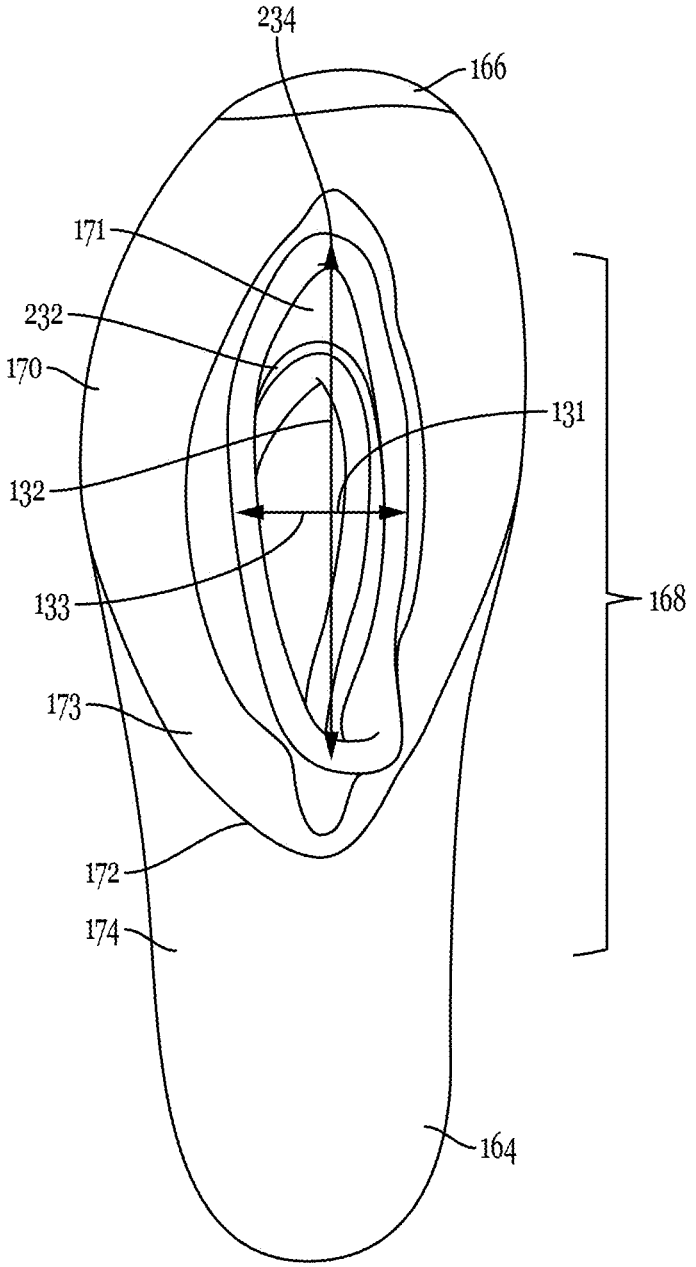

FIG. 16E: an elongated hollow knit structure folded to form an embodiment of a shoe upper according to the invention.

Figure 16F:
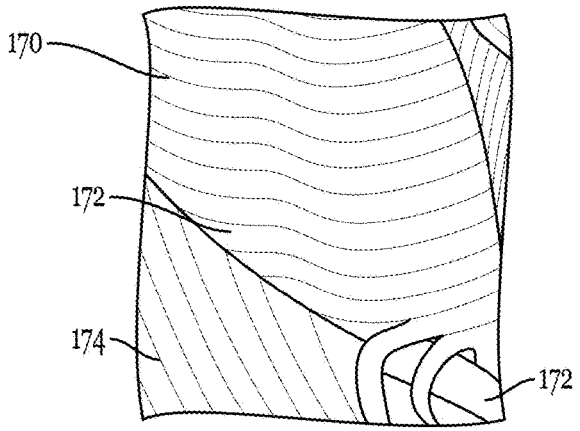

FIG. 16F: an exploded view of a portion of an elongated hollow knit structure folded and shaped to form an embodiment of a shoe upper according to the invention.

Figure 17A:
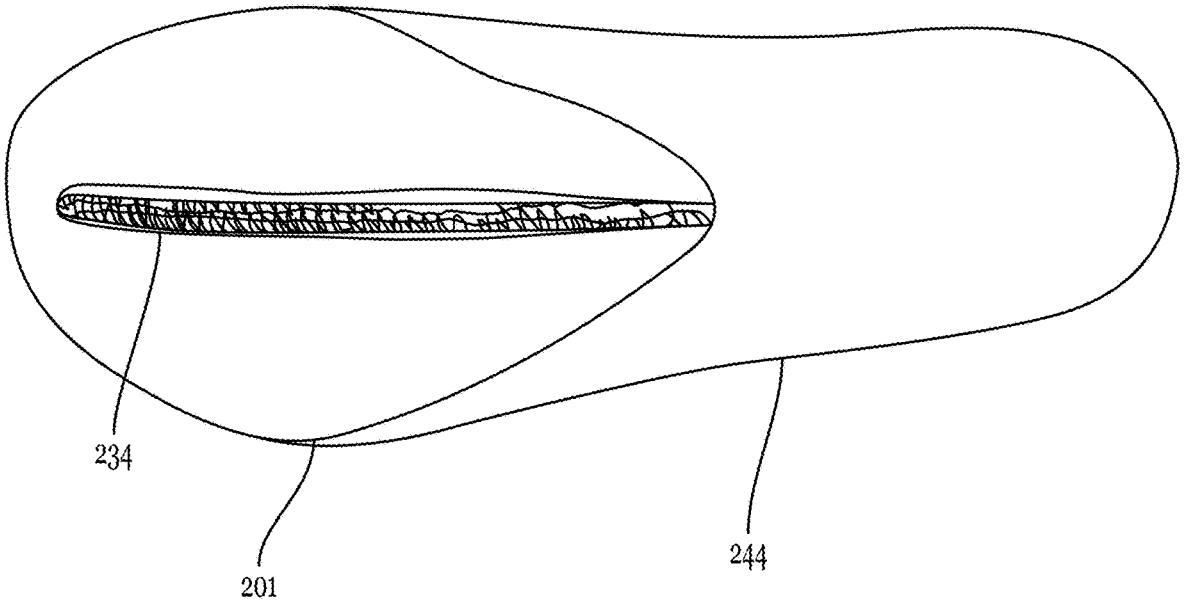

FIG. 17A: a view of the sole of an embodiment of a shoe upper according to the invention.

Figure 17B:
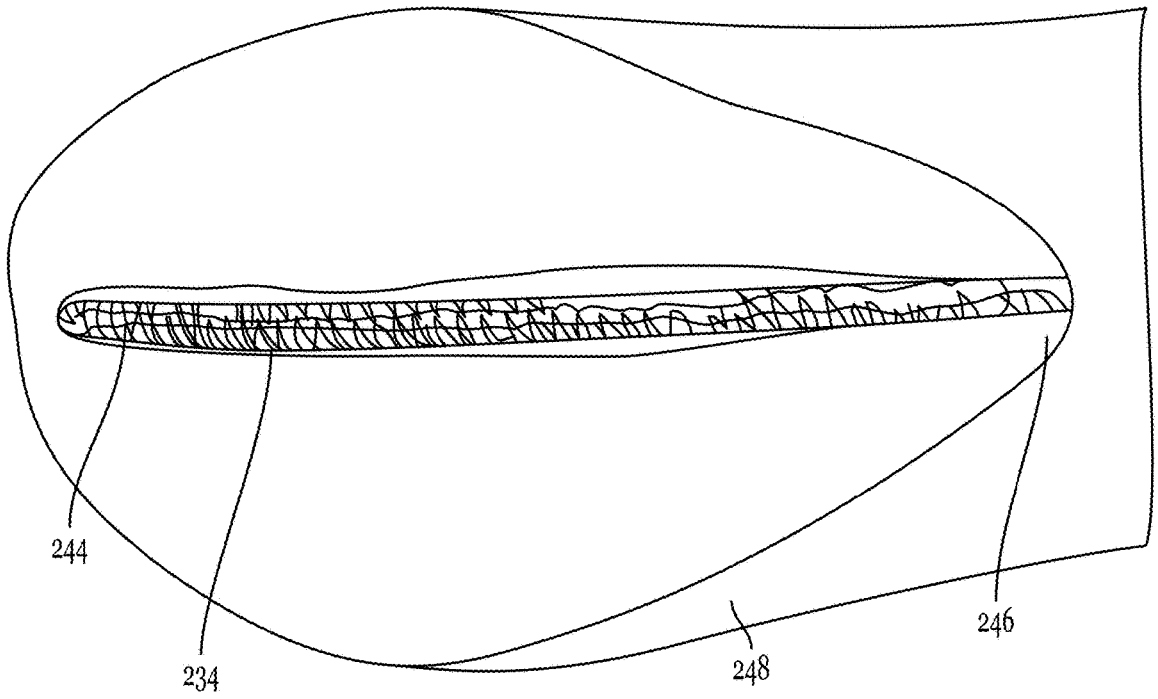

FIG. 17B: an exploded view of the sole of an embodiment of a shoe upper according to the invention.

Figure 18:
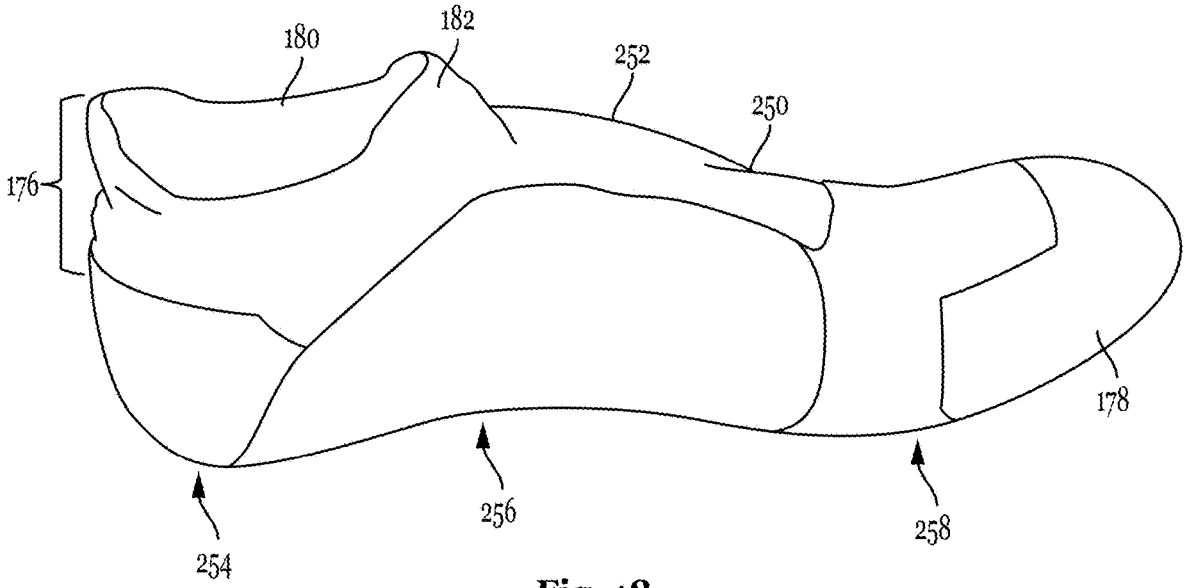

FIG. 18: a medial view of an embodiment of a shoe upper according to the invention.

Figure 19A:
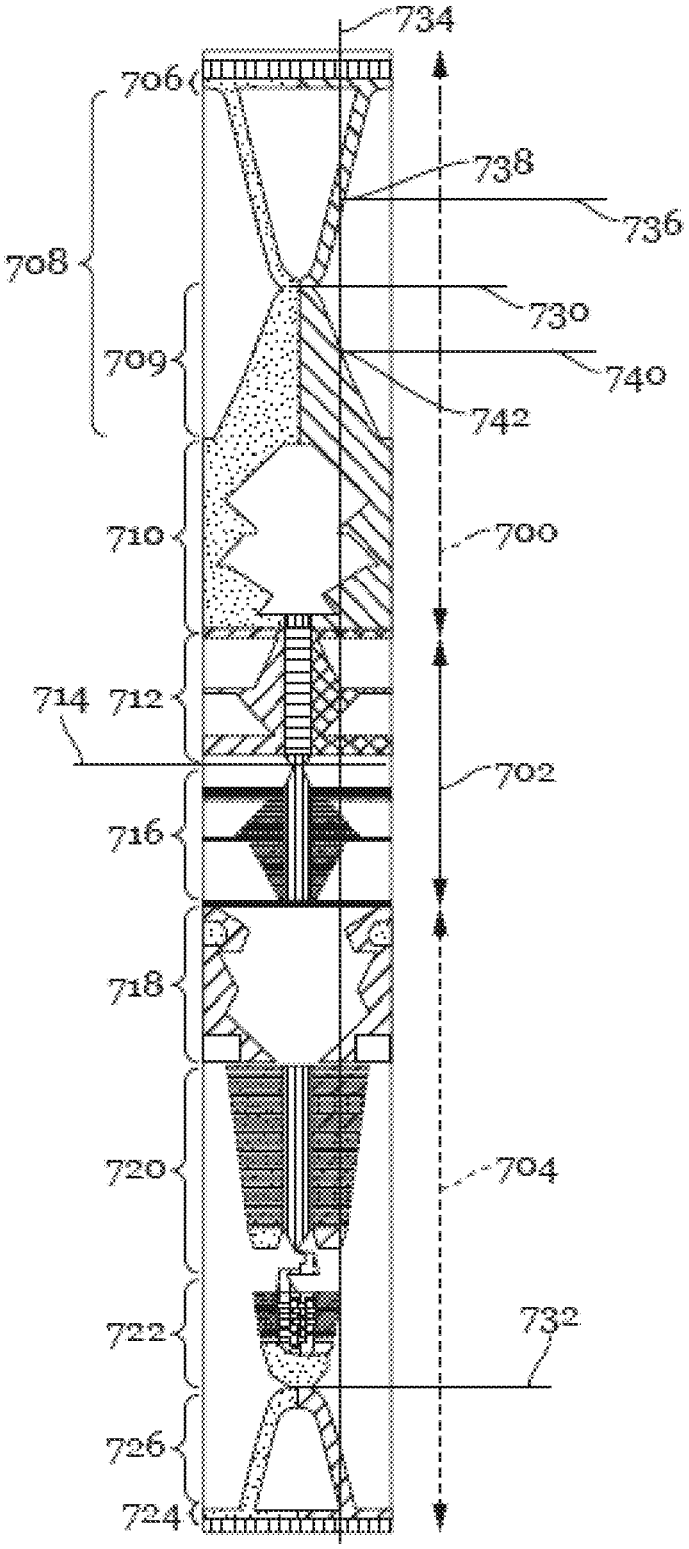

FIG. 19A: a machine knitting sequence for an elongated hollow knit structure knitted on a small circular knit machine.

Figure 19B:
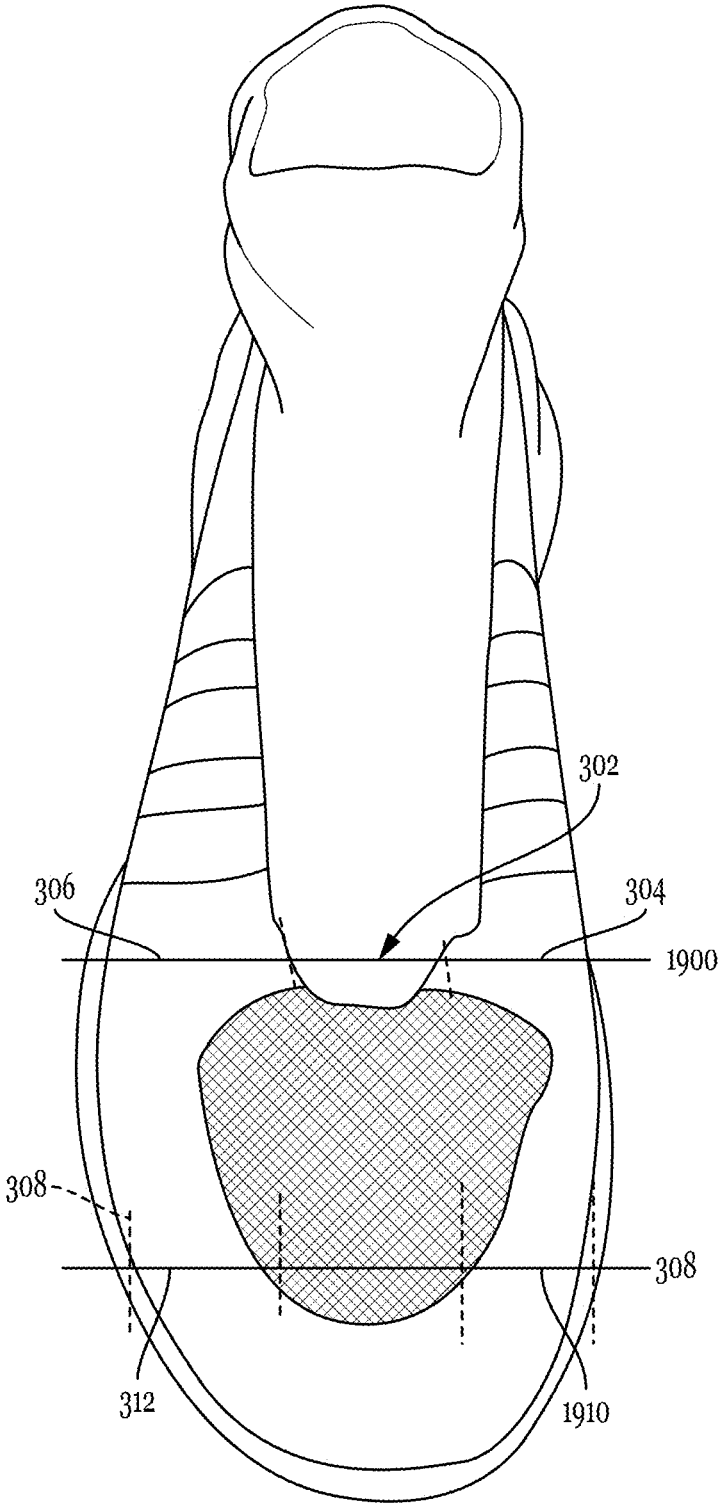

FIG. 19B: a top perspective view of an embodiment of a shoe upper according to the invention.

Figure 20:
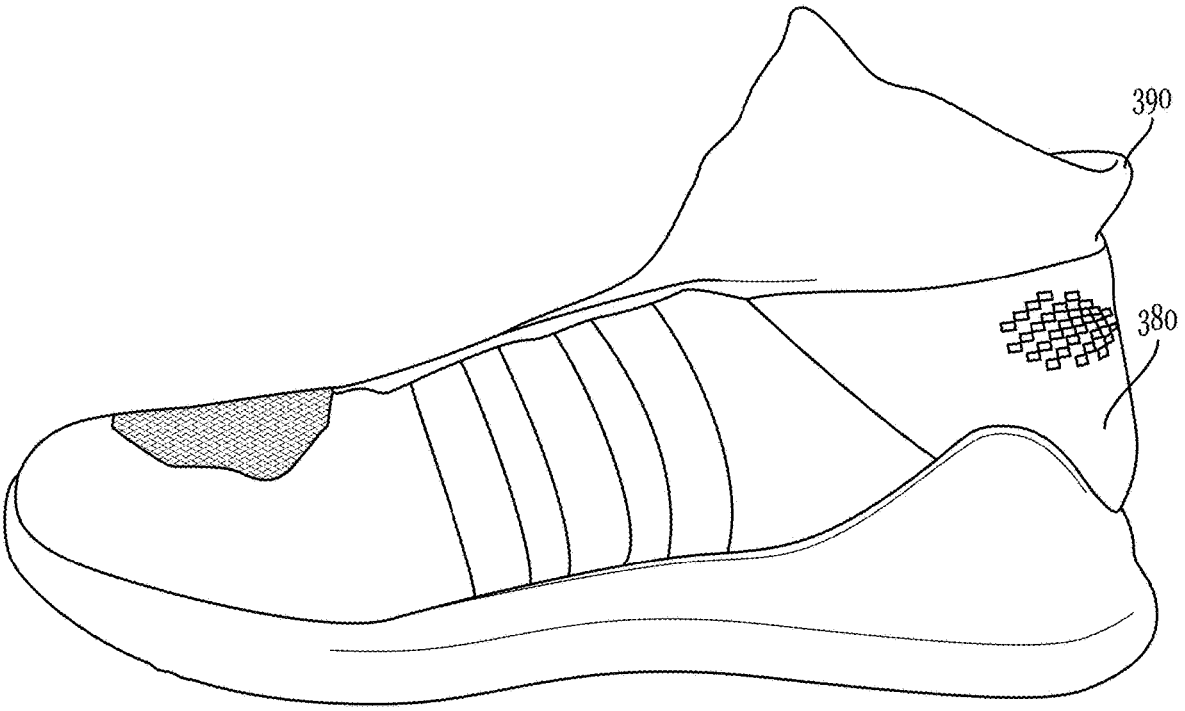

FIG. 20: a medial perspective view of an embodiment of a shoe upper according to the invention.

Figure 21:
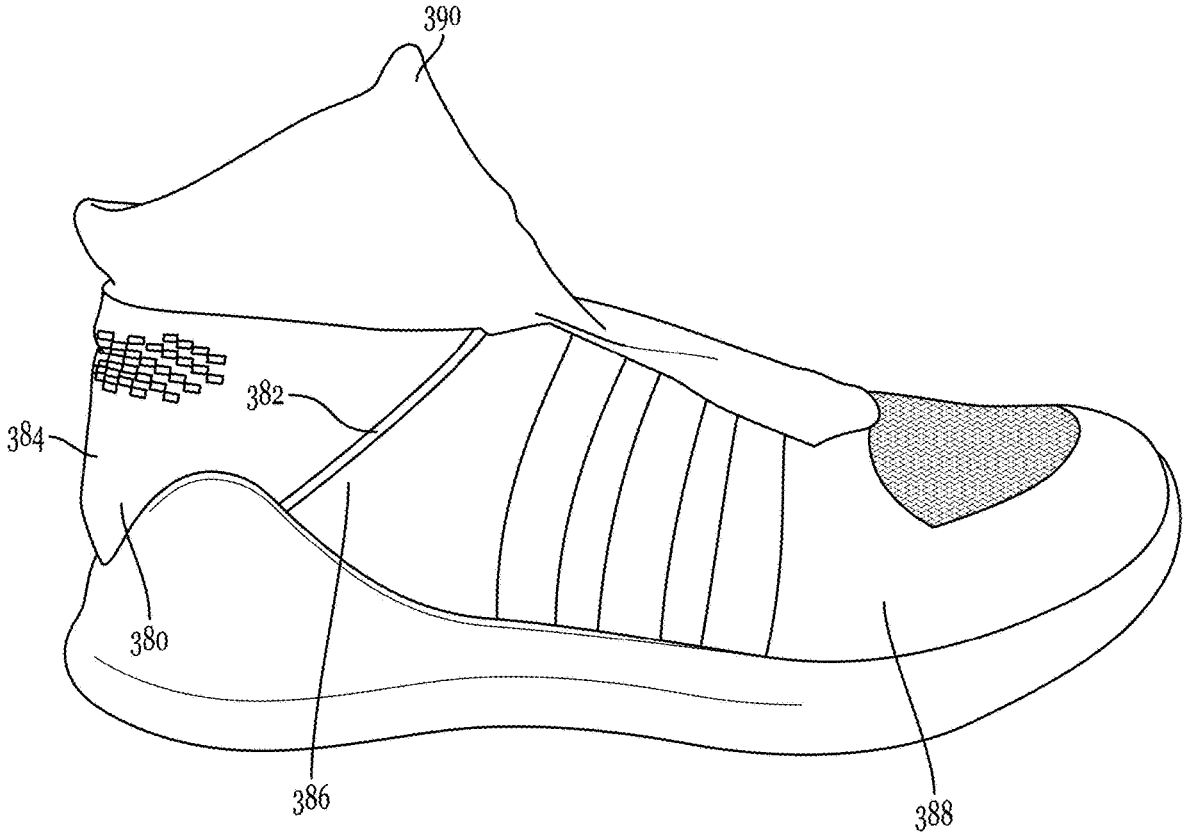

FIG. 21: a top perspective view of an embodiment of a shoe upper according to the invention.

Figure 22:
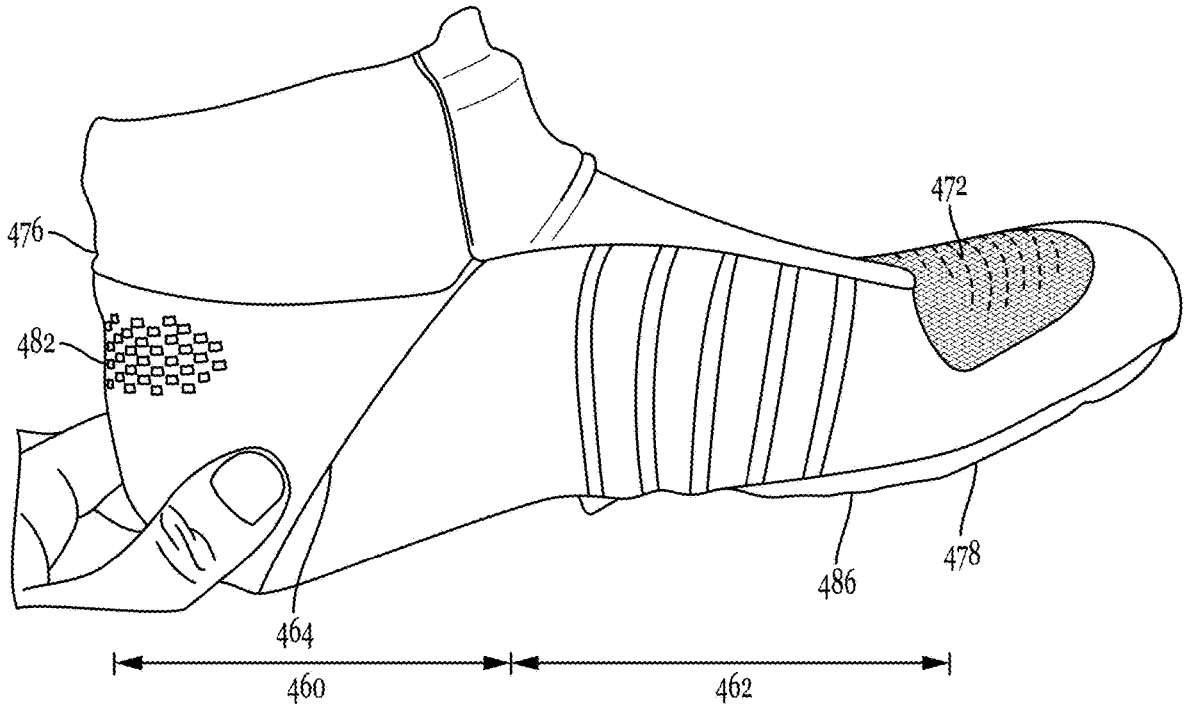

FIG. 22: a side perspective view of an embodiment of a shoe upper according to the invention.

Figure 23:
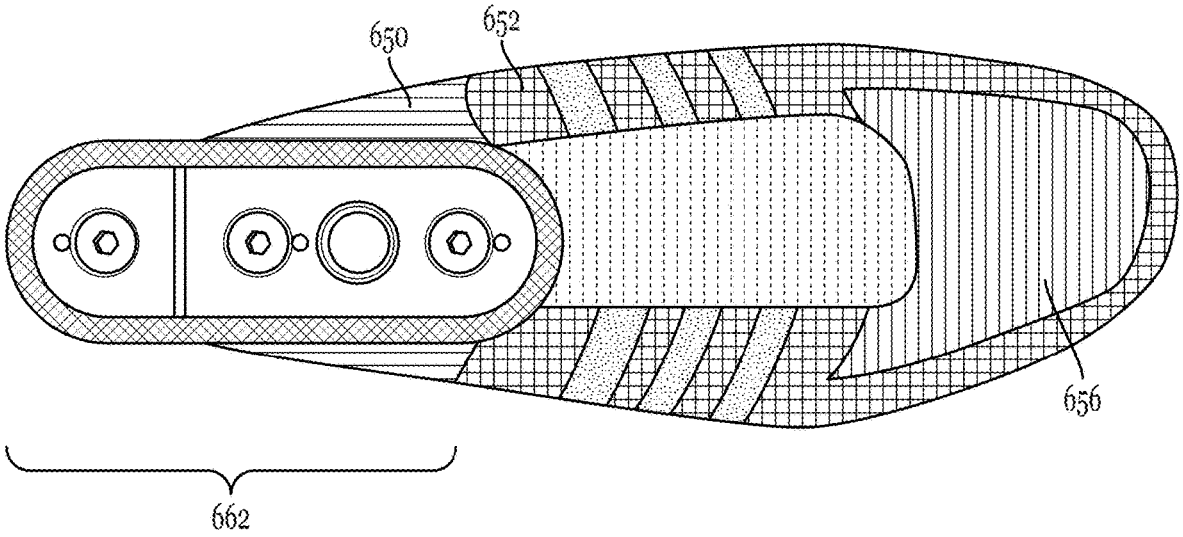

FIG. 23: a top perspective view of an illustrative example of a yarn distribution for a shoe upper according to the invention.

Figure 24:
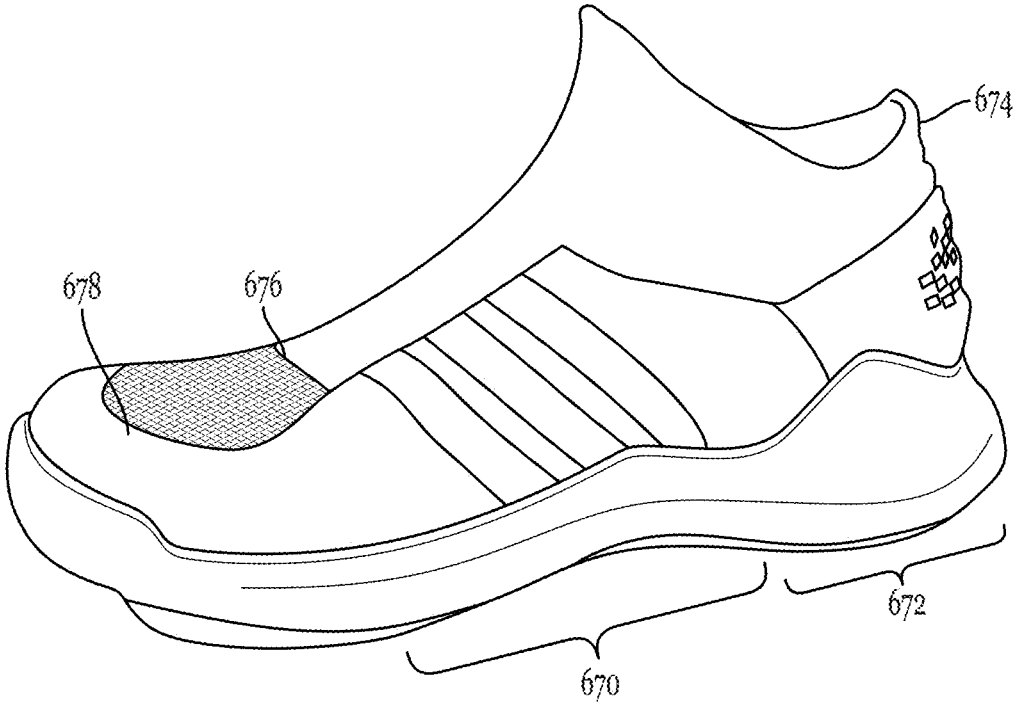

FIG. 24: a side perspective view of an embodiment of a shoe upper according to the invention.

Figure 25:
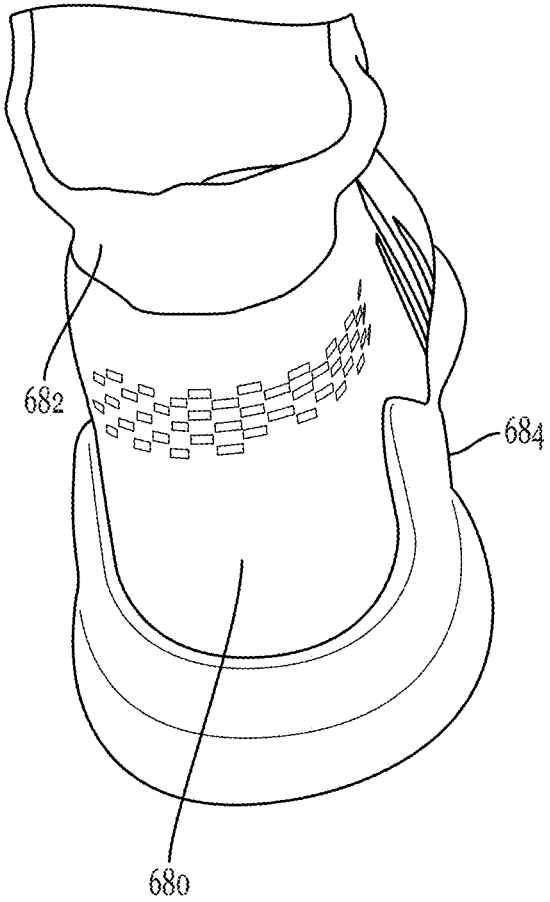

FIG. 25: a rear perspective view of an embodiment of a shoe upper, in particular, the heel and ankle regions, according to the invention.

Figure 26:
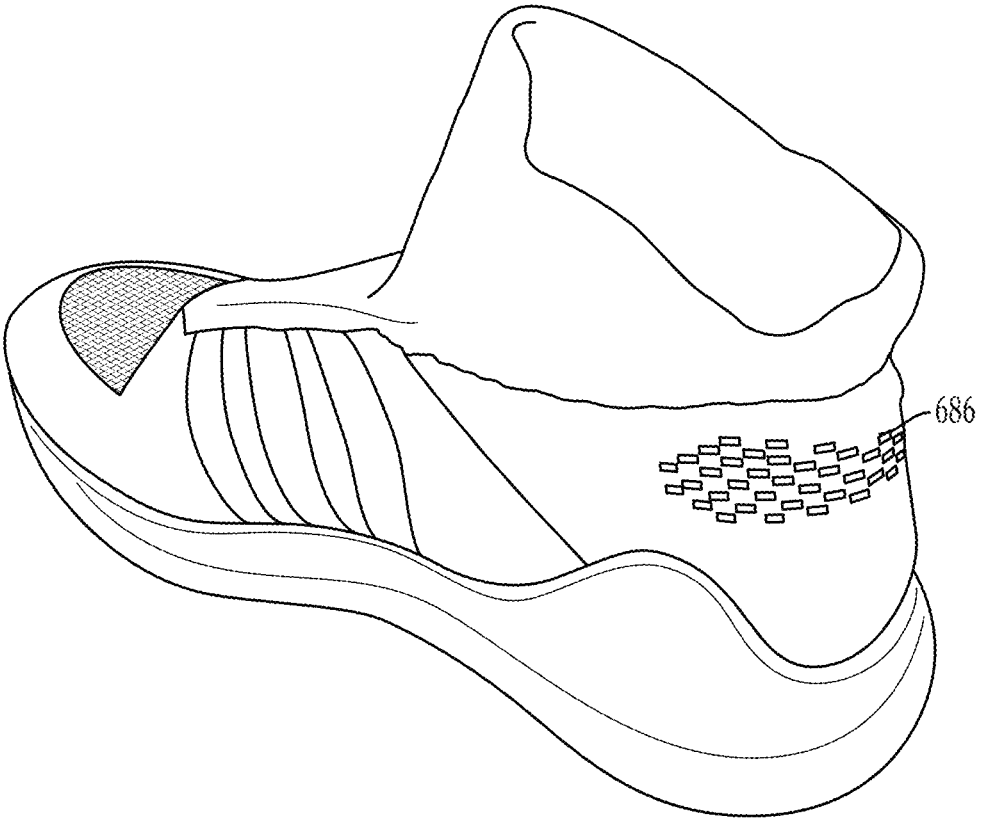

FIG. 26: a medial side perspective view of an embodiment of a shoe upper according to the invention.

Figure 27:
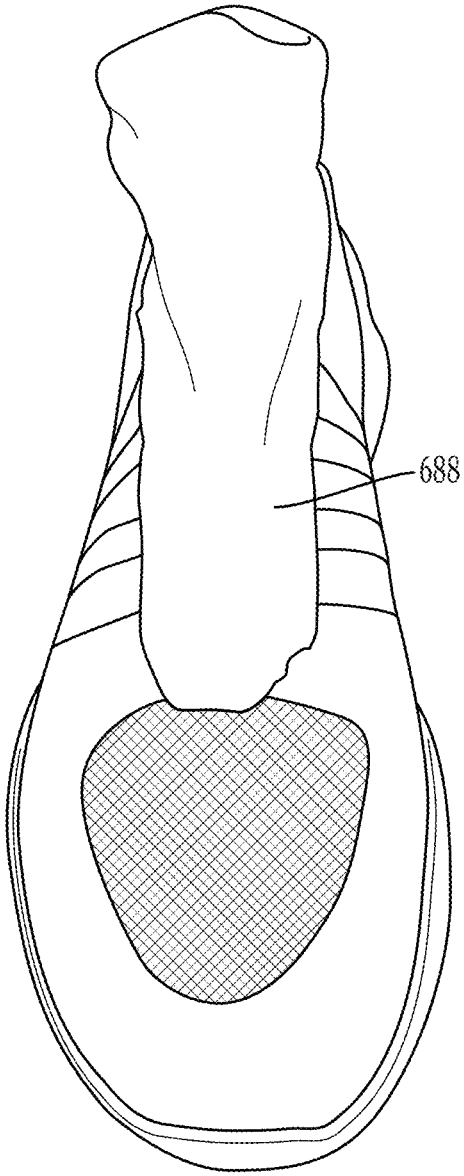

FIG. 27: a top perspective view of an embodiment of a shoe upper according to the invention.

Figure 28:
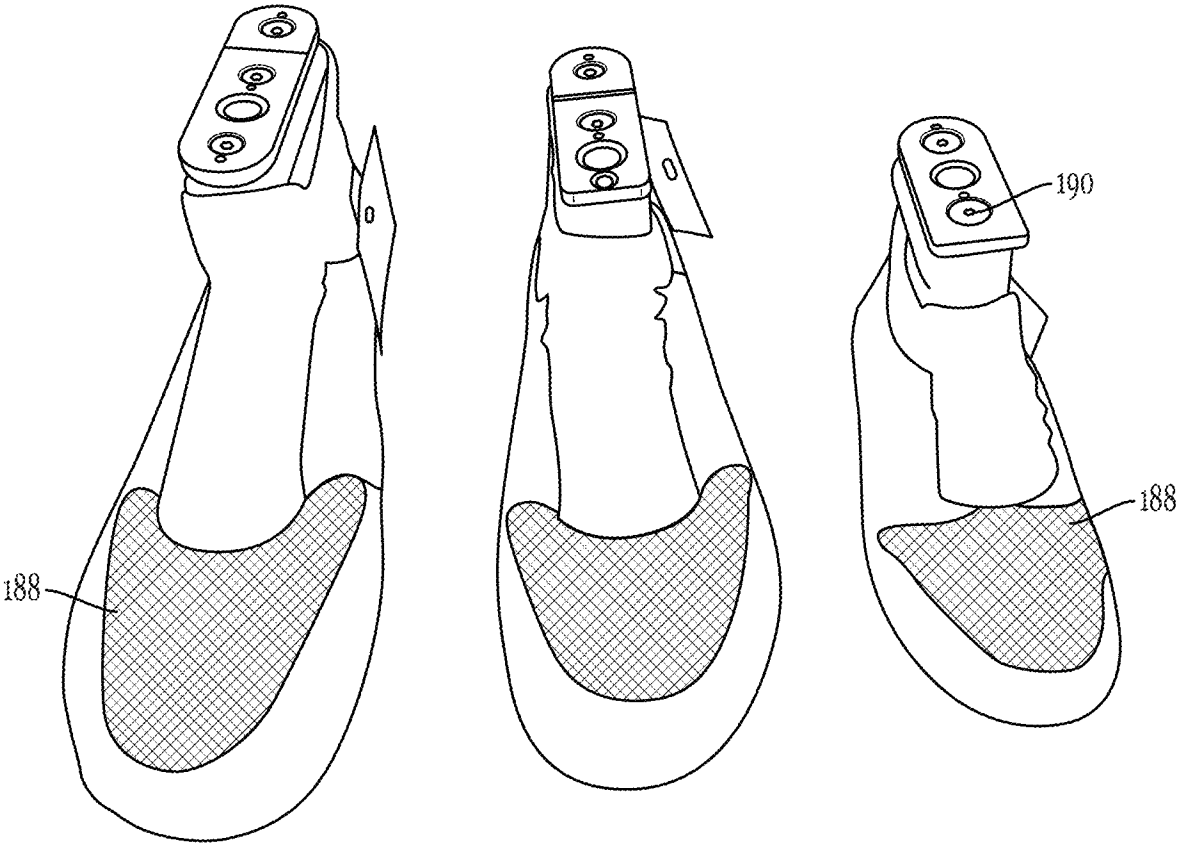

FIG. 28: a perspective view of embodiments of shoe uppers according to the invention.

Figure 29:
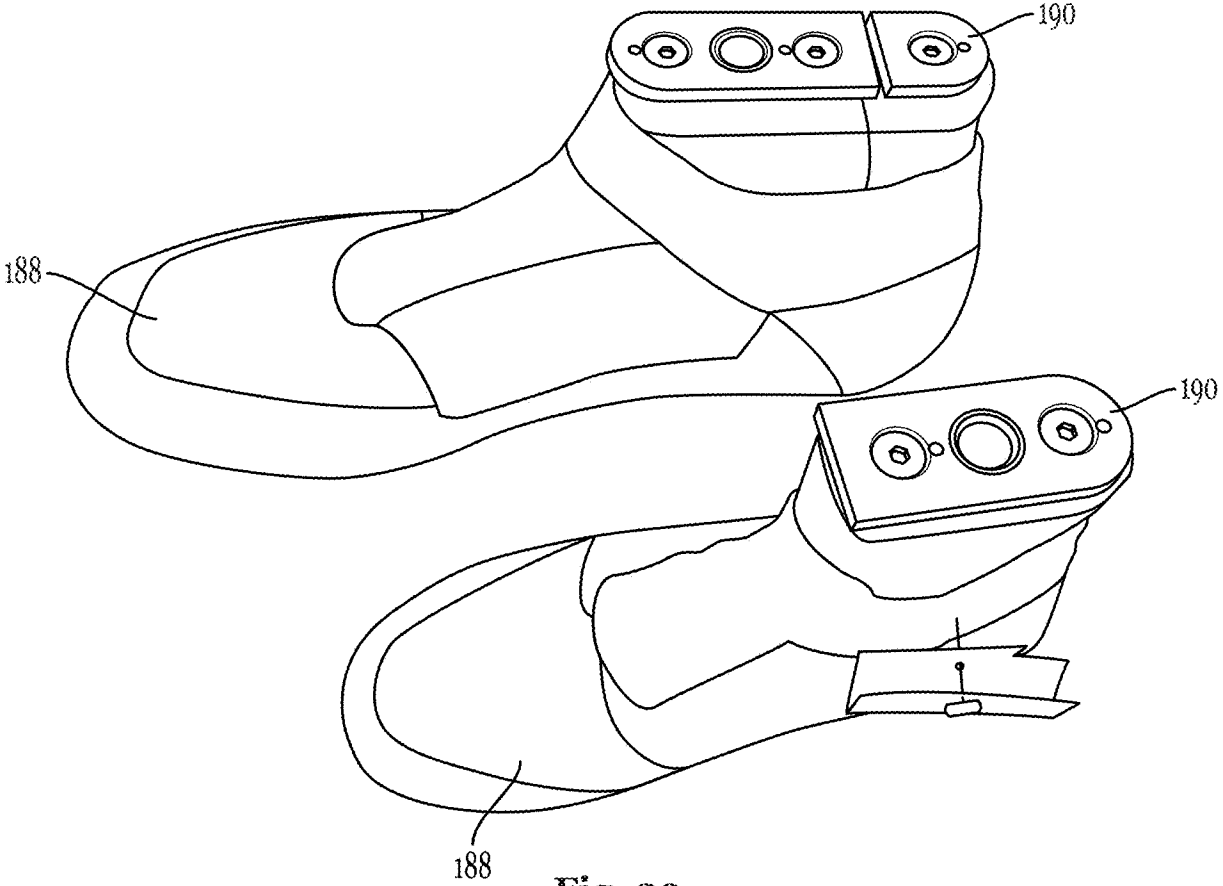

FIG. 29: a side perspective view of embodiments of shoe uppers according to the invention.

Figure 30:
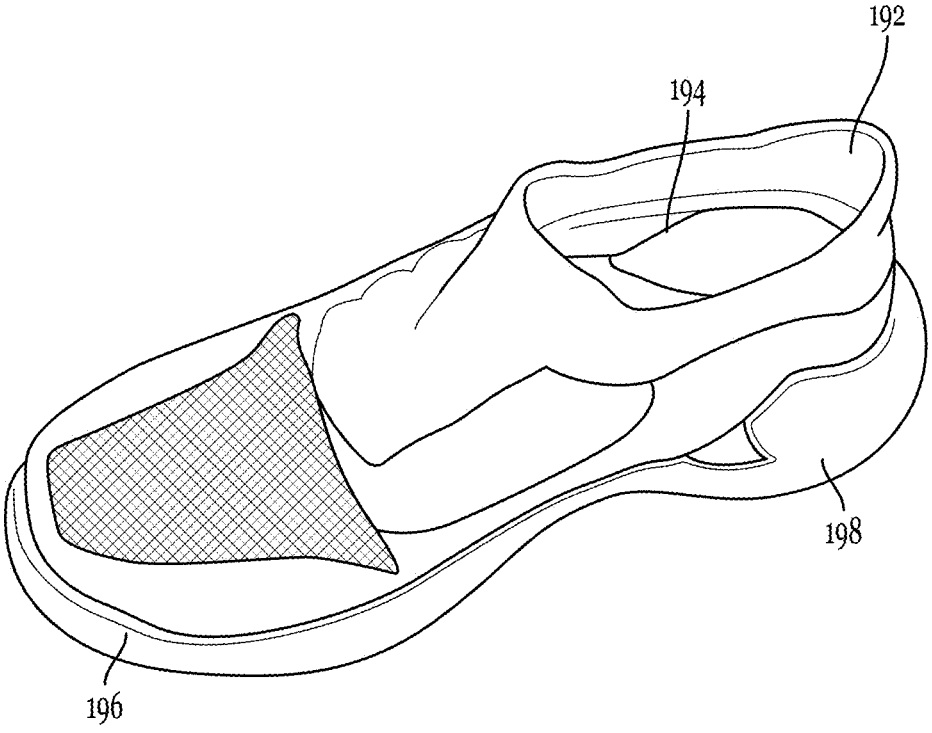

FIG. 30: a side perspective view of an embodiment of a shoe upper according to the invention.

Figure 31:
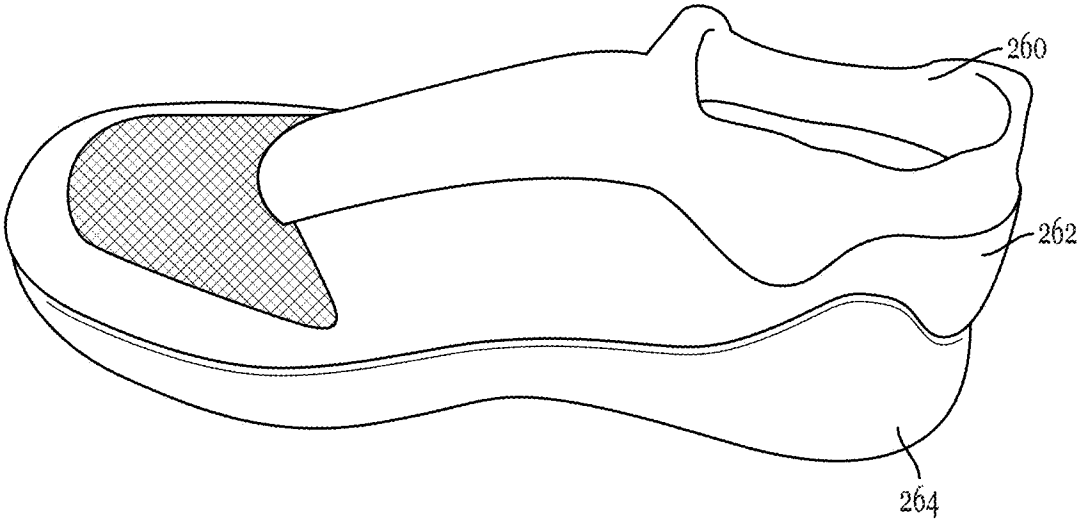

FIG. 31: a side perspective view of an embodiment of a shoe upper according to the invention.

Figure 32:
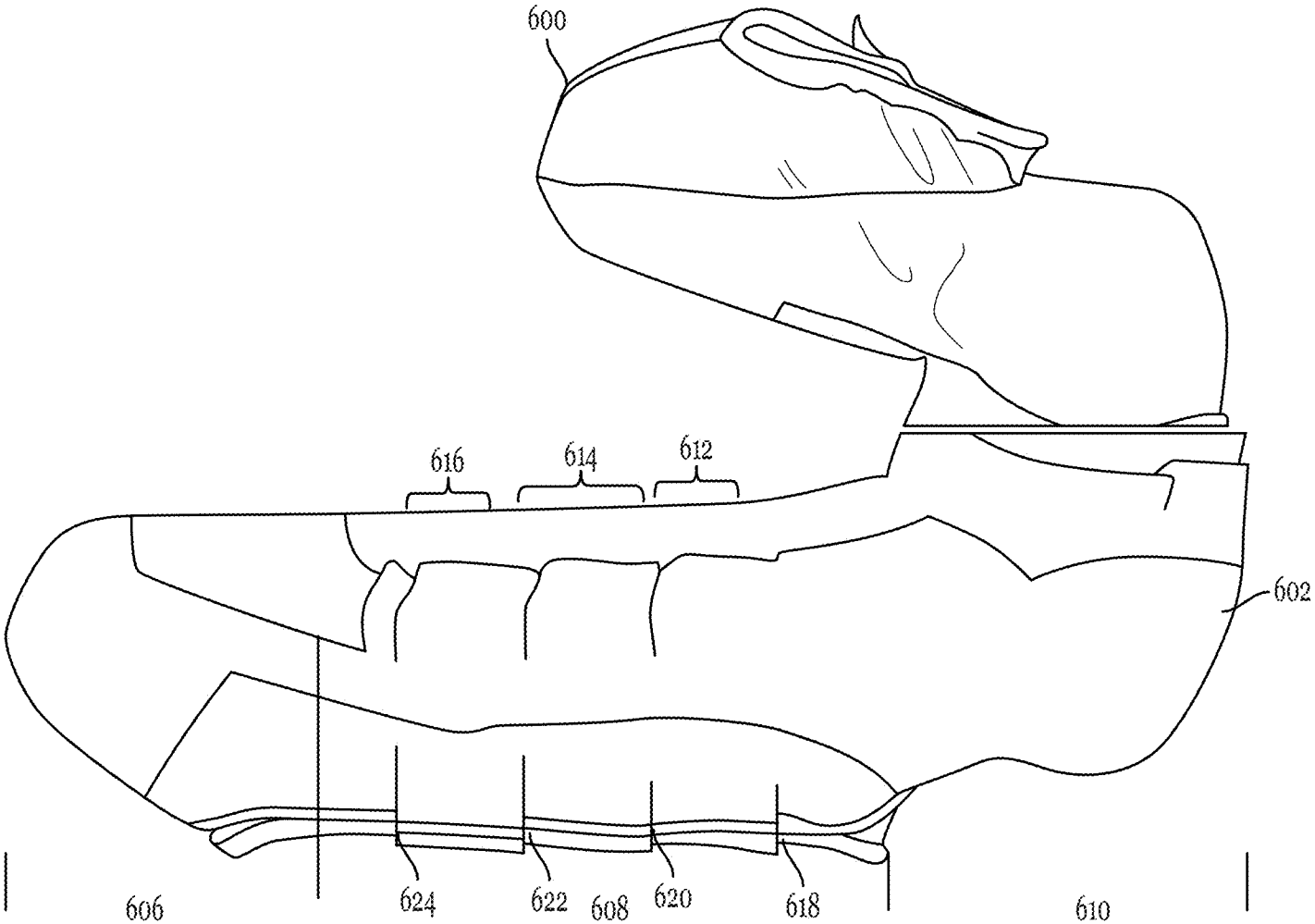

FIG. 32: a view of an embodiment of an elongated hollow knit structure for a shoe upper according to the invention.

Figure 33:
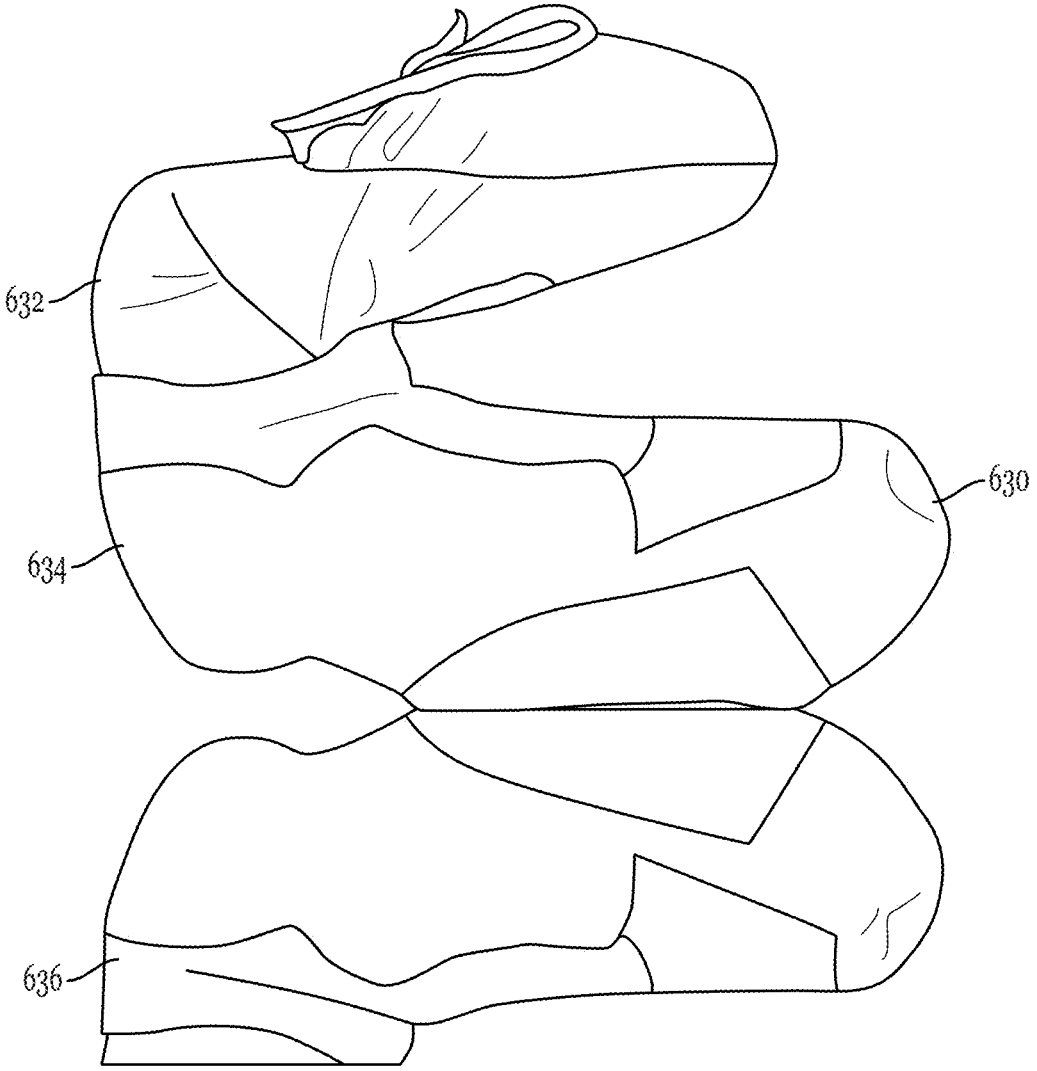

FIG. 33: a view of an embodiment of an elongated hollow knit structure for a shoe upper according to the invention.

Figure 34:
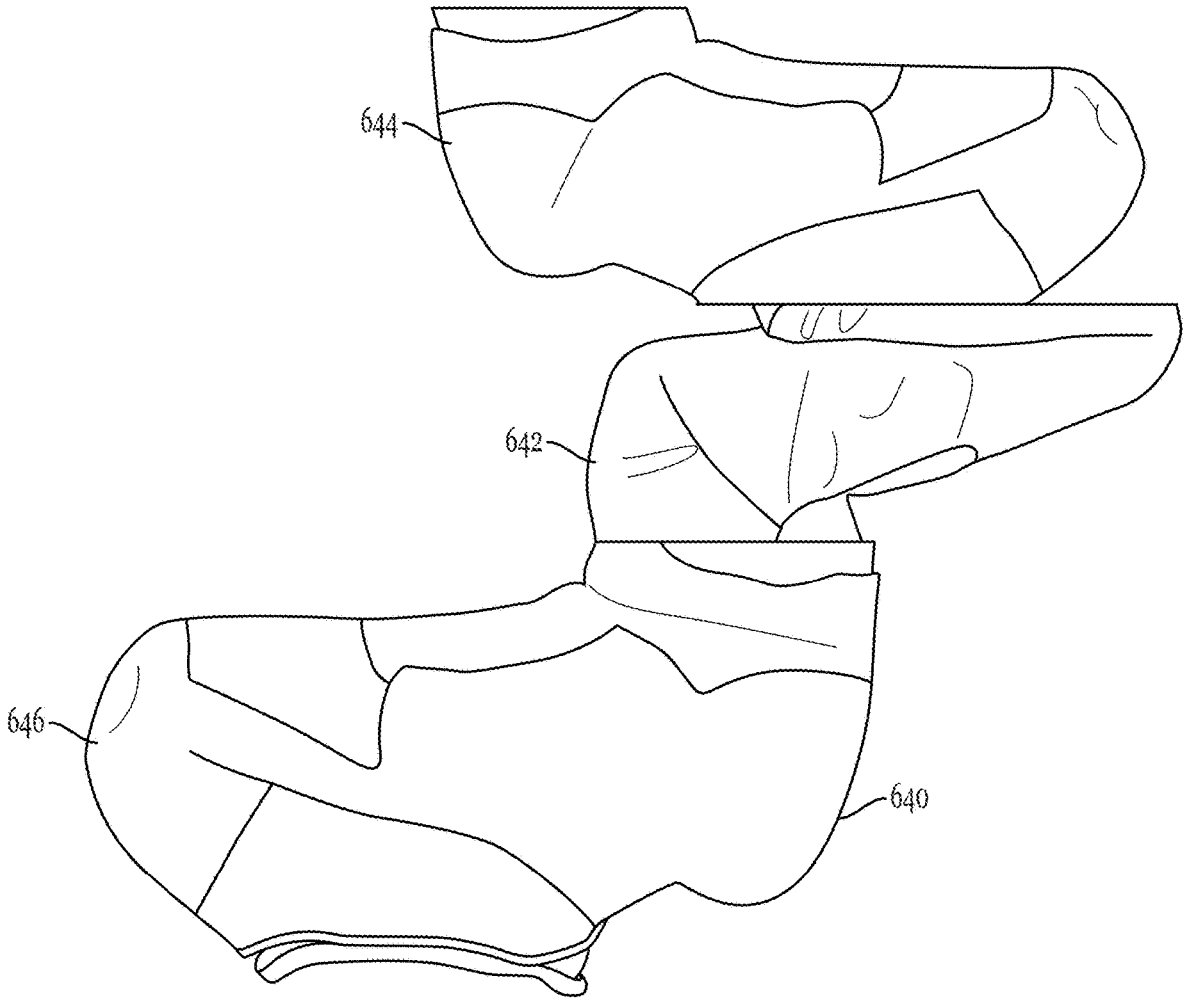

FIG. 34: a view of an embodiment of an elongated hollow knit structure for a shoe upper according to the invention.

Figure 35:
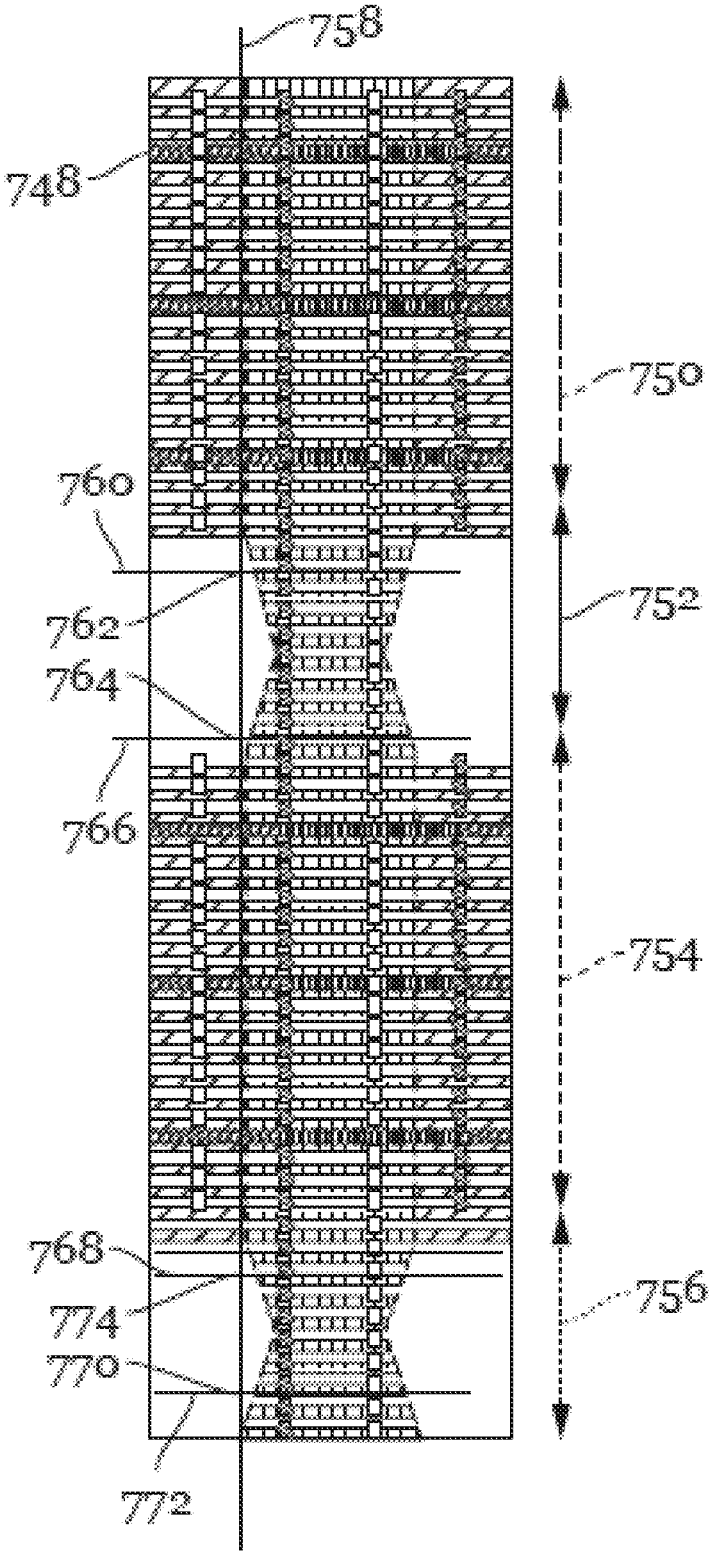

FIG. 35: a machine knitting sequence for an elongated hollow knit structure knitted on a small circular knit machine.

Figure 36:
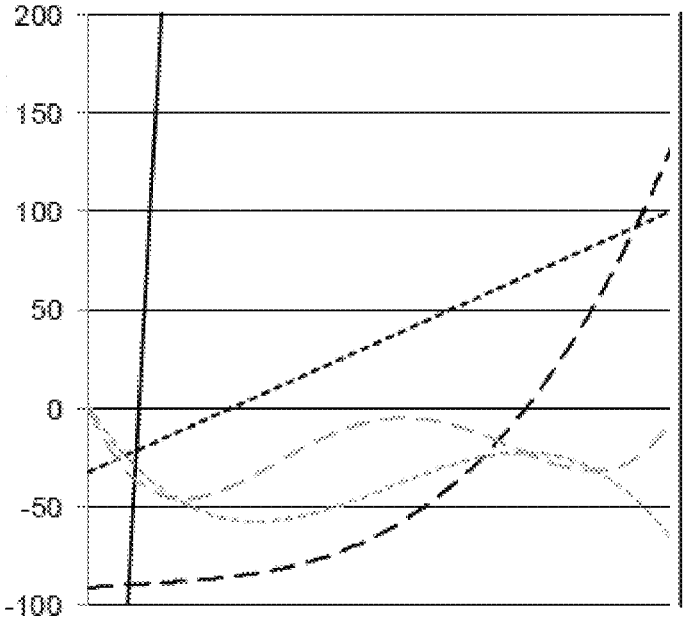

FIG. 36: a graph depicting the influence of the various parameters on the strength at 20% elongation along a knitted row.

Figure 37:
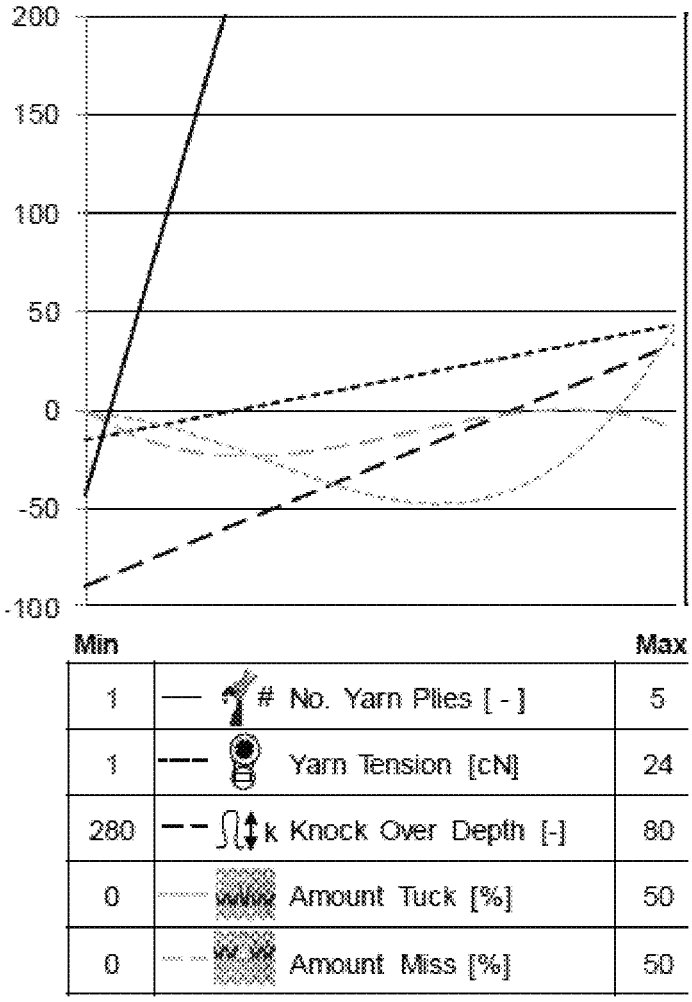

FIG. 37: a graph depicting the influence of the various parameters on the strength at 20% elongation along a knitted wale.

Figure 38:
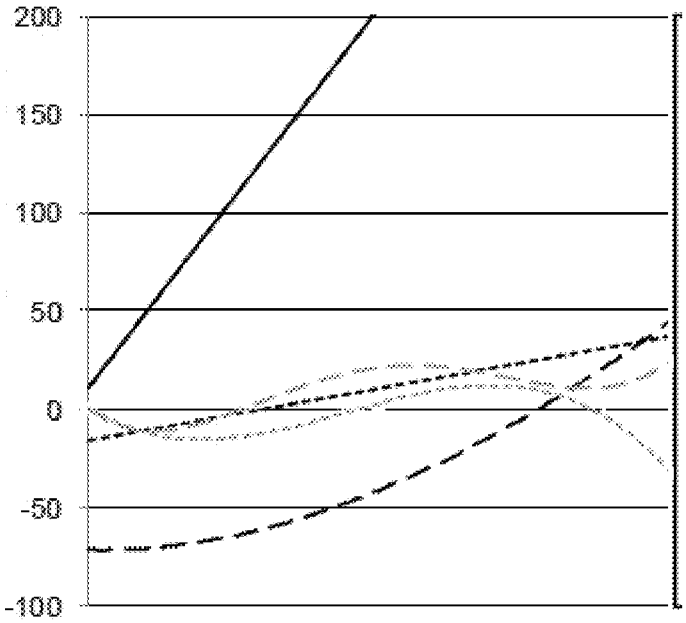

FIG. 38: a graph depicting the influence of the various parameters on the maximum strength along a knitted row.

Figure 39:
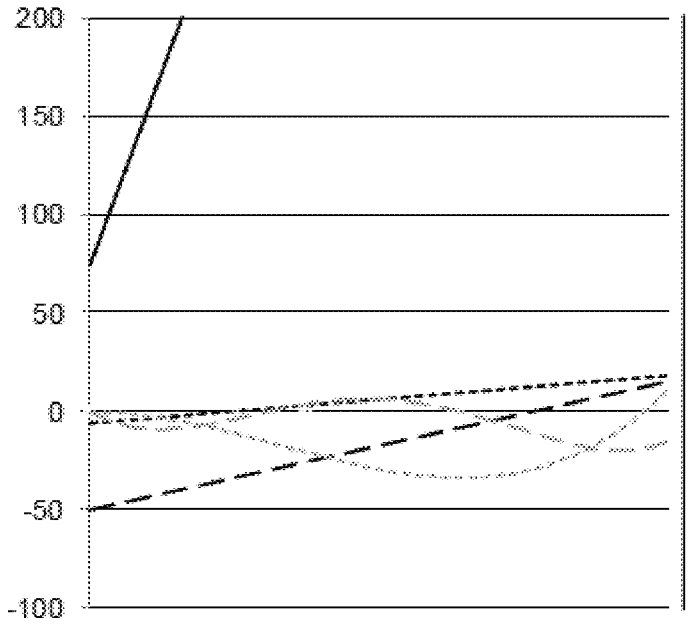

FIG. 39: a graph depicting the influence of the various parameters on the maximum strength along a knitted wale.

Figure 40:
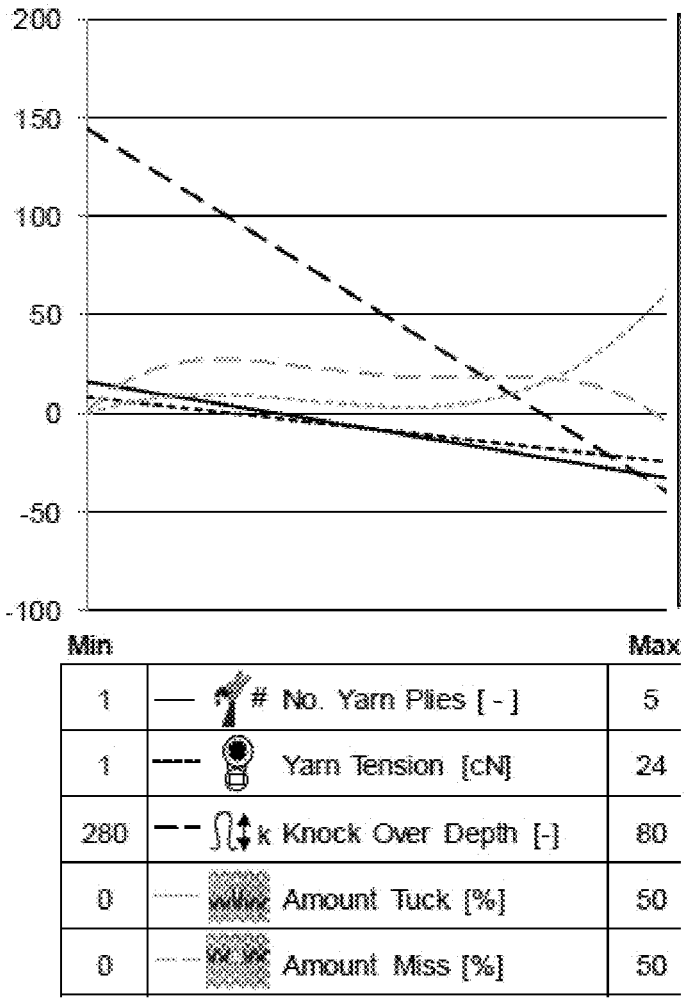

FIG. 40: a graph depicting the influence of the various parameters on the maximum elongation along a knitted row.

Figure 41:
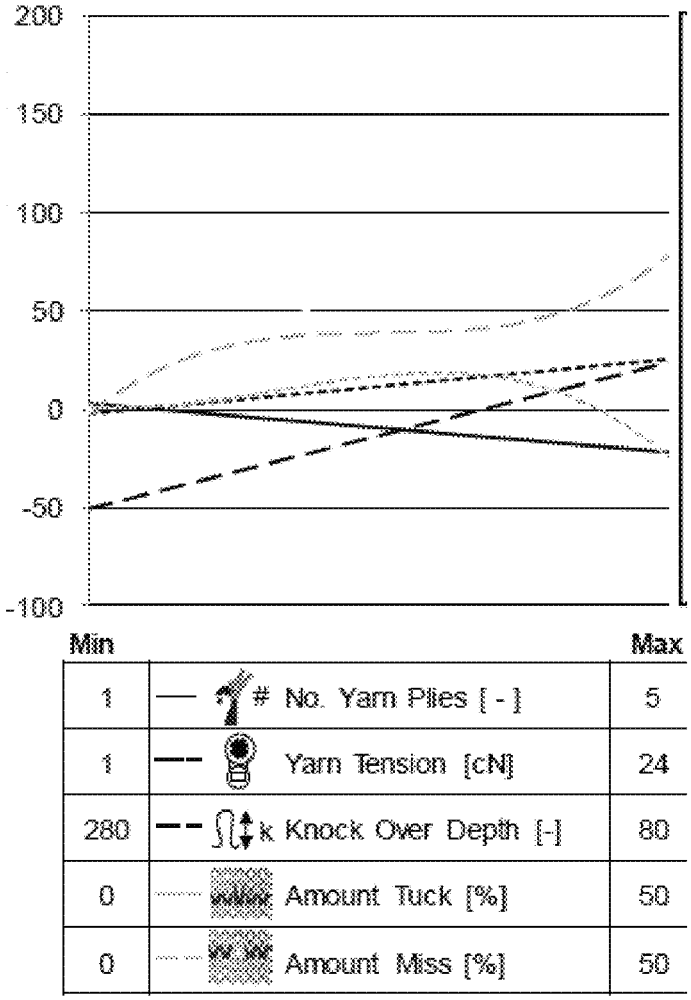

FIG. 41: a graph depicting the influence of the various parameters on the maximum elongation along a knitted wale.

Figure 42:
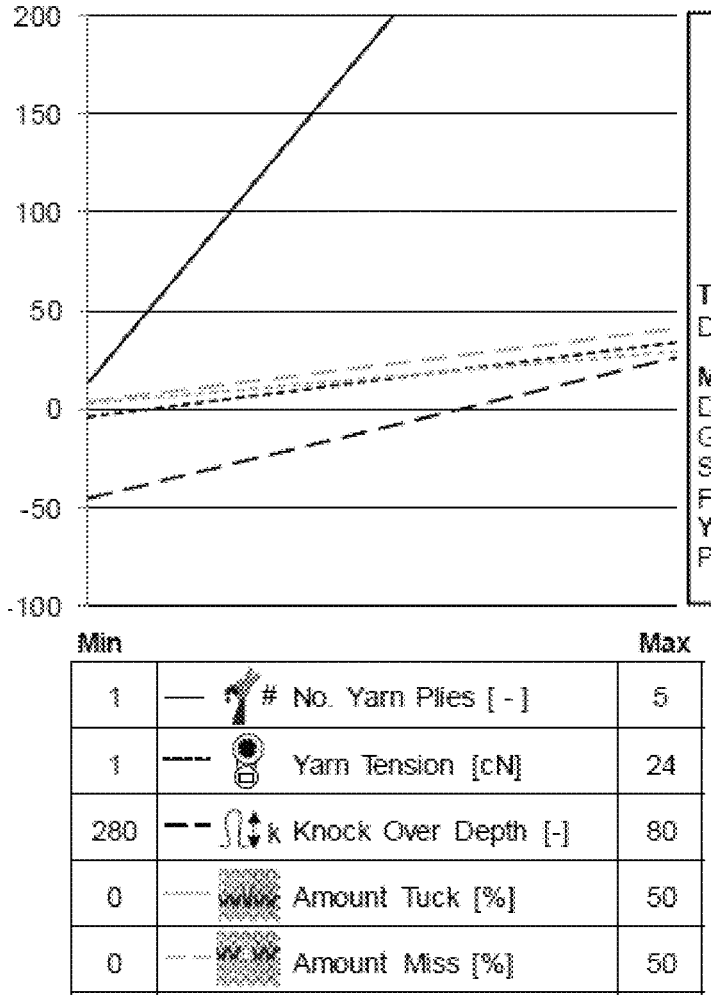

FIG. 42: a graph depicting the influence of the various parameters on the mass per unit area.

Figure 43:
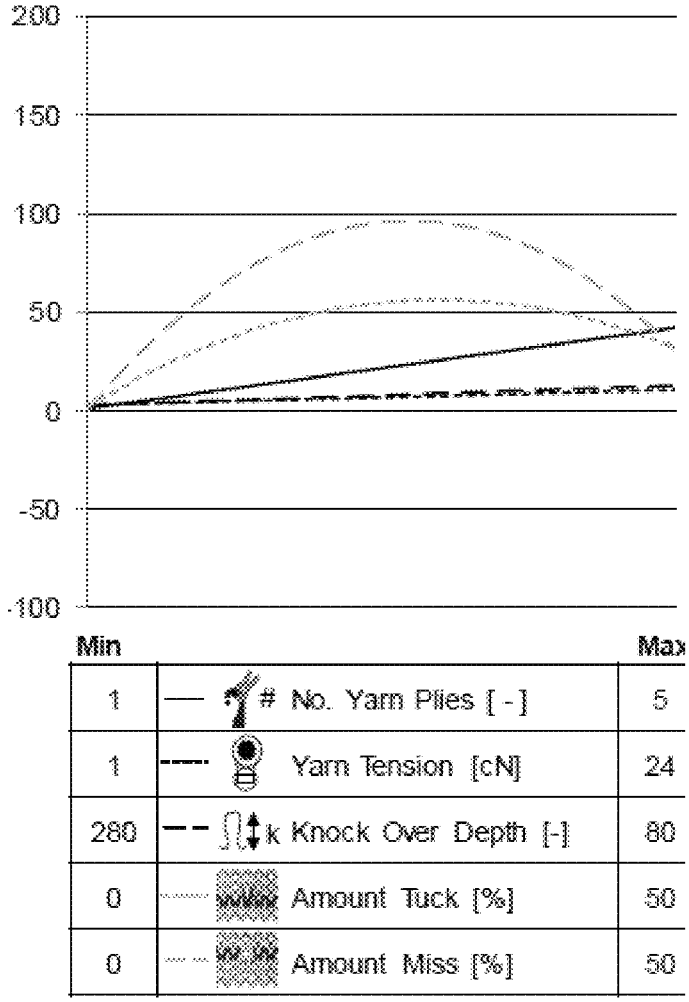

FIG. 43: a graph depicting the influence of the various parameters on thickness of the textile.

Figure 44:
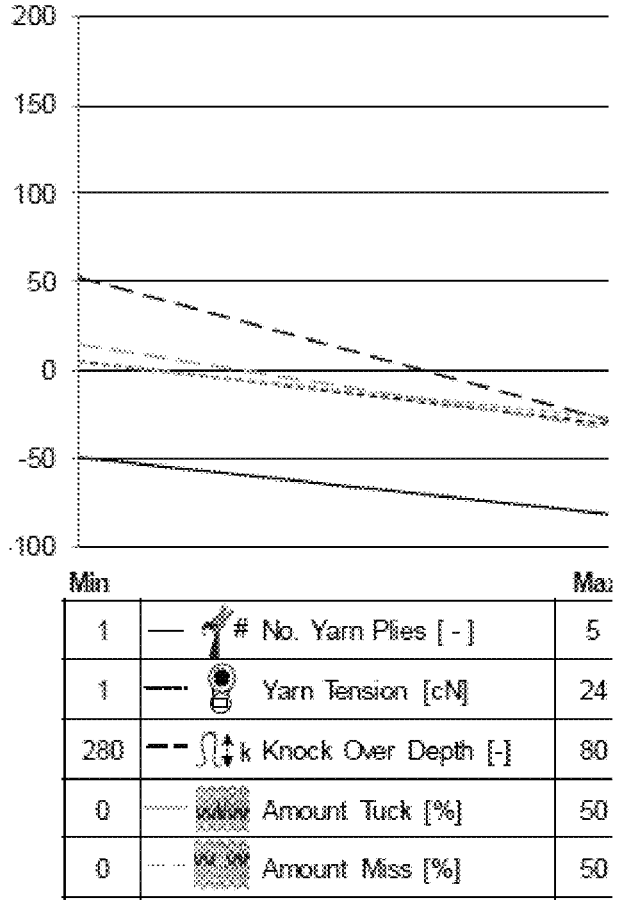

FIG. 44: a graph depicting the influence of the various parameters on air permeability of the textile.

Figure 45:
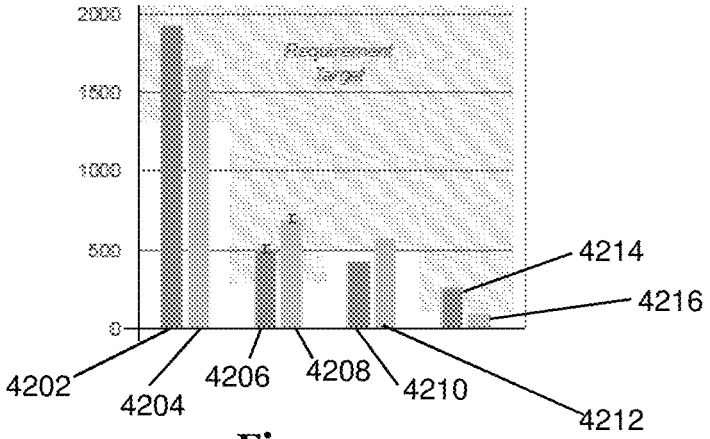

FIG. 45: a graph depicting maximum strength for the various zones.

Figure 46:
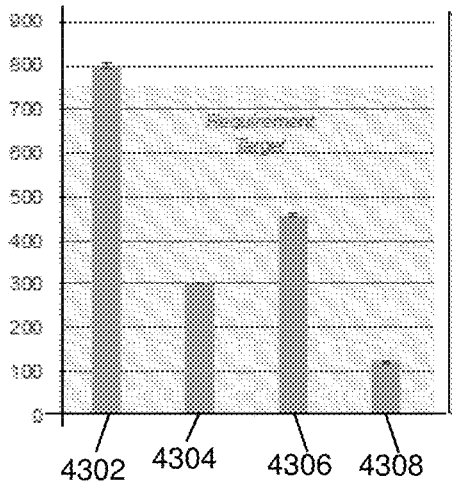

FIG. 46: a graph depicting mass per unit area for the various zones.

Figure 47:
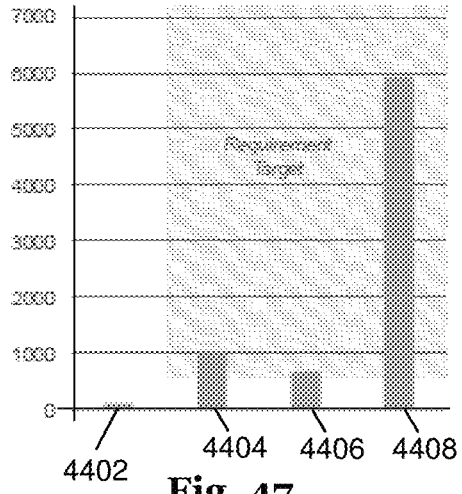

FIG. 47: a graph depicting air permeability for the various zones.

Figure 48A:
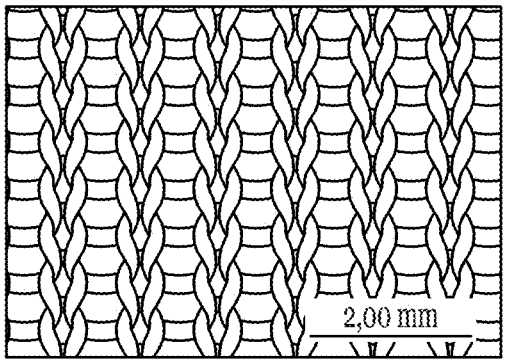

FIG. 48A: a textile sample including a base yarn.

Figure 48B:
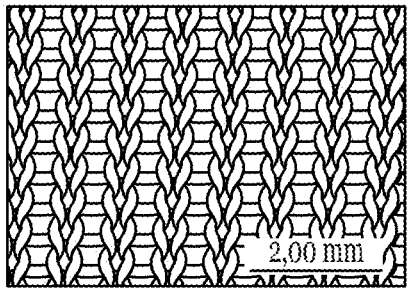

FIG. 48B: a textile sample including a base yarn and an elastic plating yarn that is half plated.

Figure 48C:
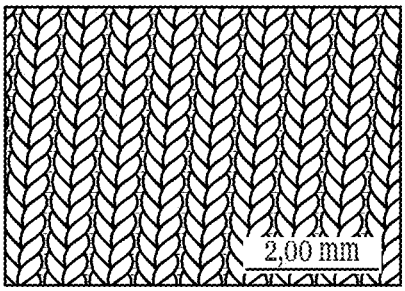

FIG. 48C: a textile sample including a base yarn and an elastic plating yarn that is fully plated.

Figure 49:
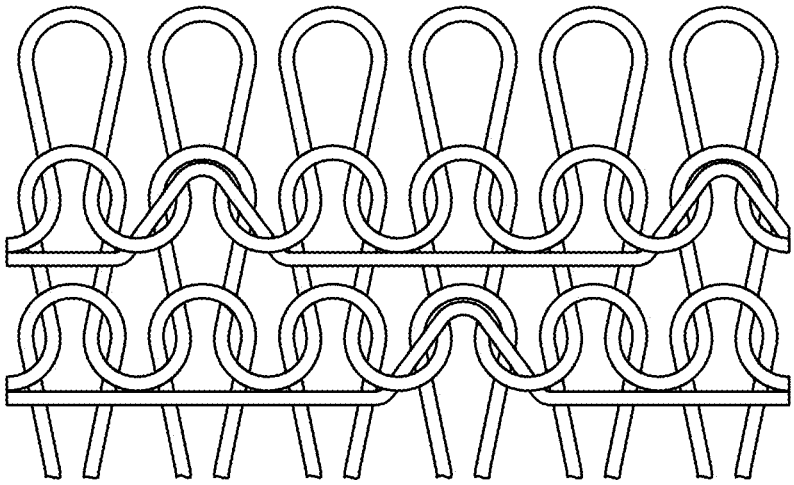

FIG. 49: a depiction of a knitted rows with a lining yarn.

Figure 50:
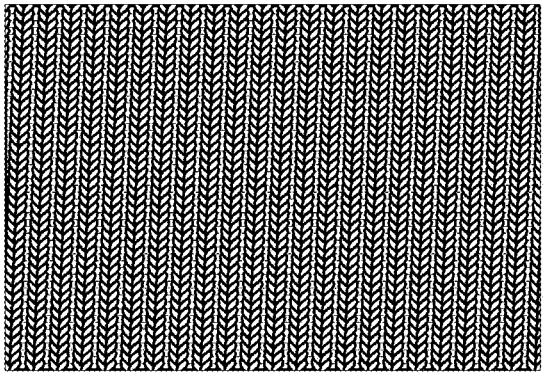

FIG. 50: front side of a textile sample including a lining yarn.

Figure 51:
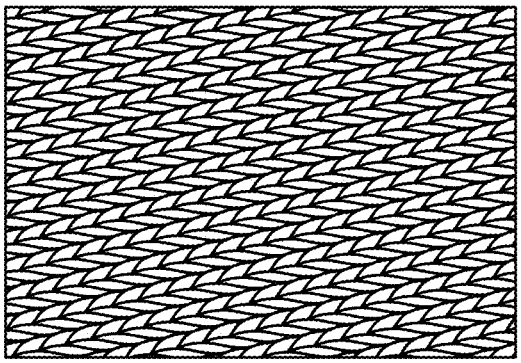

FIG. 51: back side of a textile sample including a lining yarn.

Figure 52:
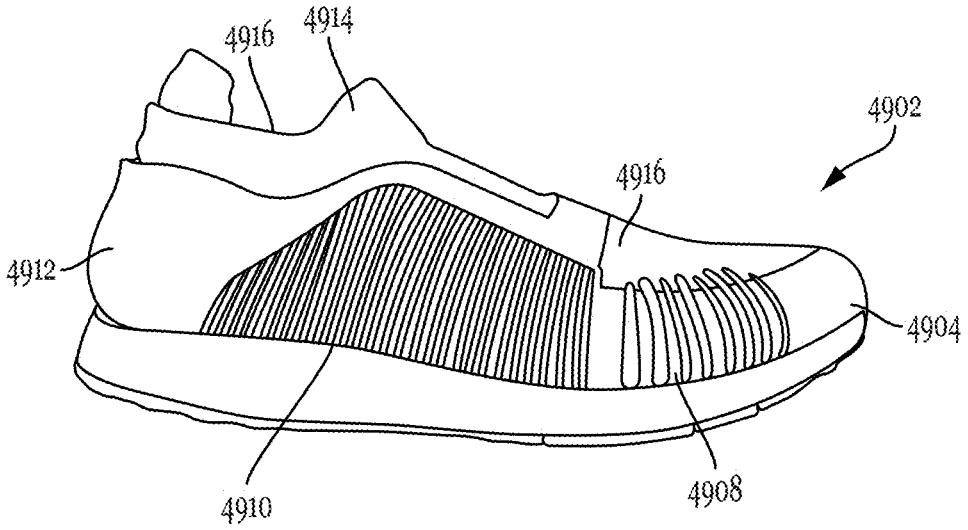

FIG. 52: An illustrative example of a shoe according to the invention.

FIG. 53: Table 4: Predetermined Properties for Zones of a Lightweight Upper.

FIG. 54: Table 5: Default machine parameters.

FIG. 55: Table 6: Range of parameter values.

FIG. 56: Table 7: Influence of Parameters on Strength at 20% Elongation along a Knitted Row.

FIG. 57: Table 8: Influence of parameters on strength at 20% elongation along a wale.

FIG. 58: Table 9: Influence of Parameters on Maximum Strength along Row.

FIG. 59: Table 10: Influence of Parameters on Maximum Strength along Wale.

FIG. 60: Table 11: Influence of Parameters on Elongation along a Row ($\Delta\varepsilon_{max\ row}$).

FIG. 61: Table 12: Change in Elongation along a Wale ($\Delta\varepsilon_{max\ wale}$).

FIG. 62: Table 13: Influence of Parameters on Mass/Area.

FIG. 63: Table 14: Influence of Parameters on Textile Thickness.

FIG. 64: Table 15: Influence of Parameters on Air Permeability.

FIG. 65: Table 16: The effect of the parameters on the textile properties.

FIG. 66: Table 17: Knit Parameter Values for a Lightweight Running Shoe.

FIG. 67: Table 19: Average Benchmark Values for Properties of Textiles.

FIG. 68: Table 20: Parameters for use in Shoe Upper Strength Zone.

FIG. 69: Table 21: Parameters for use in Shoe Upper Elastic Zone.

FIG. 70: Table 22: Parameters for use in Shoe Upper Cushion Zone.

FIG. 71: Table 23: Parameters for use in Shoe Upper Collar Zone.

FIG. 72: Table 24: Parameters for use in Shoe Upper High Permeability Zone.

DETAILED DESCRIPTION OF PREFERRED EMBODIMENTS

Various embodiments of the present invention are described in the following detailed description. However, emphasis is placed on the fact that the present invention is not limited to these embodiments. The method described herein may be used for the manufacture of shoe uppers in general, such as, for example, for sport shoes, casual shoes, laced shoes or boots such as working boots.

It is also to be noted that individual embodiments of the invention are described in greater detail below. However, it is clear to the person skilled in the art that the constructional possibilities and optional features described in relation to these specific embodiments can be further modified and combined with one another in a different manner within the scope of the present invention and that individual steps or features can also be omitted where they appear to be unnecessary to the skilled person. In order to avoid redundancies, reference is made to the explanations in the previous sections, which also apply to the embodiments of the following detailed description.

FIG. 1 presents a flow diagram illustrating exemplary method steps 100 for manufacturing shoe uppers in accordance with certain aspects of the present disclosure. The method steps 100 may be performed, for example, by one or more manufacturing entities. The method steps 100 may begin at step 110 by providing at least one stretchable portion on the shoe upper. For example, the stretchable portion may be provided by using a stretch fabric, e.g. 2-way or 4-way stretch, of a stretchable material such as elastane, e.g. LYCRA®, neoprene or the like. Generally, the method step 110 does not have to be limited to use a certain material and/or technique. It is also possible that the stretchable portion may be provided by using different forming techniques in different portions of the shoe upper during the manufacturing process.

In one embodiment, the at least one stretchable portion may be provided at least partly in a bottom part of the shoe upper. For example, the stretchable portion may be provided over the entire bottom part of the shoe upper so that the number of sizes for shoe uppers to be manufactured may be further reduced as explained above. It is also possible that two or more stretchable portions may be provided which may further improve this aspect. Moreover, a shoe upper with a plurality of stretchable portions may imply an improved stability because each of the stretchable portions may be locked with a rigid element. Moreover, another stretchable portion may be provided in another part of the shoe upper such as the heel part, toe part and/or midfoot part which may be not locked with the at least one rigid element. Advantageously, for a soccer shoe without laces, providing such another stretchable portion allows a wearer to quickly putting on and/or change the shoe during a training situation, match situation or the like.

As shown in FIG. 1, step 110 may comprise the step 112 of providing at least one stretch yarn in the at least one stretchable portion. Advantageously, such a method step enables the possibility that the stretchable portion may be directly incorporated into the shoe upper so that the manufacturing process may be further improved. The stretch yarn may be selected individually depending on the manufacturing of the material for the shoe upper, e.g. knitting. The stretch yarn may include a mixture of different natural fibers and/or synthetic fibers and/or a combination thereof. It is also possible that the stretch yarn may be provided in the entire shoe upper. For example, the shoe upper may be a sock-like shoe upper including the stretch yarn, wherein the sock-like shoe upper may be manufactured by a circular knitting technique as explained before.

Moreover, step 112 may comprise the step 114 of providing on the shoe upper at least one less stretchable portion. The less stretchable portion may be non-stretchable or stretchable only at a degree which is lower than the degree of stretchability of the stretchable portion.

In particular the at least one less stretchable portion may be provided on step 114 without the stretch yarn. Alternatively or in addition the at least one less stretchable portion may comprise one or more elements for limiting the stretchability. For instance, in case the at least one less stretchable portion is a knitted portion, such elements may be one or more inlaid yarns or strands that limit the stretchability of the portion. The elements may also be bands attached at their ends to the less stretchable portion in order to limit the maximum extension of the latter.

The at least one less stretchable portion may also comprise a melting yarn and be at least partially melted or it can be provided with a dimensionally stable polymer skin bonded to it.

As mentioned above, the inventors have realized that some areas of the foot have to be fixed inside the shoe upper, i.e. such areas might need lower stretchability in order to provide sufficient stability of the foot in each direction during movements. For example for sport applications such as soccer, the midfoot may have to be more stabilized in order to avoid any undesired sliding of the foot inside the shoe upper which generally results in skin irritations, e.g. blisters.

As shown in FIG. 1, step 110 may further comprise the step 116 of providing a first knit structure on the shoe upper and providing a second knit structure in the at least one stretchable portion. Using different knit structures may be a promising alternative instead of using different materials for providing the stretchable portion on the shoe upper. For example, a first knit structure may be a coarse meshed fabric, wherein a second knit structure may be more stretchable such as a weft knitted fabric, e.g. stockinette stitch. Moreover, the shoe upper may be a sock-like shoe upper including such knit structures, wherein the sock-like shoe upper may be manufactured by a circular knitting technique. Alternatively or additionally, any other composition of two appropriate knit structures, e.g. knitting stitches and stitch patterns, providing different stretching properties may be suitable for the manufacturing process.

As shown in FIG. 1, step 110 may further comprise the step 118 of forming the shoe upper, wherein the shoe upper is integral and continuous from a medial side to a lateral side, preferably in an instep part of the shoe upper. As explained above, the manufacturing may be more efficient as there is no need to provide a tongue part for such a shoe upper so that a tongue opening of the shoe upper is stretched for adjusting the shoe upper to a last. Especially shoe uppers without laces for sport applications such as soccer, basketball, running or the like may be manufactured with such a method step. For example, a stitching station may stitch an upper piece comprising at least one stretchable portion from a two-dimensional surface to the three-dimensional shoe upper. It is also possible that this step may be carried out by a worker or may be carried out in a fully automated process, wherein this step may be controlled by a central computer unit and/or may be set up and supervised by one or more humans.

The method 100 continues with a step 120 of stretching the at least one stretchable portion of the shoe upper for adapting a size of the shoe upper. For example, a last may be inserted into the shoe upper for stretching it. As explained above, using a last for stretching can ensure that the stretched shoe upper better conforms to the anatomy of a human foot. Alternatively or additionally, the last may be individually manufactured according to data of a customer's foot, e.g. by 3D-printing, so that the stretching step may provide a shoe upper fitting more tightly to the customer's foot.

In one embodiment, the last may be inflatable. For example, the last may be a balloon made from a very flexible membrane and be inflated for stretching the shoe upper. Advantageously, such a method step may avoid material defects in the manufacturing process, such as a tearing of the shoe upper, compared to a non-inflatable last.

In one embodiment, the step 120 of stretching the at least one stretchable portion of the shoe upper for adapting a size of the shoe upper may be carried out by one or more robot arms. For example, the robot arms may grab different portions of the shoe upper and may move in different directions so that the stretchable portion of the shoe upper may be stretched.

Once again, all of these embodiments follow of the same idea that the number of different sizes of shoe uppers during the manufacturing process may be reduced and thus the storage and manufacturing costs may be reduced.

At step 130, at least one rigid element is permanently attached on the stretched stretchable portion so that the stretched stretchable portion is locked. For example, the at least one rigid element, such as a fabric patch, and the stretched stretchable portion may be permanently attached to each other by a seam so that the size and/or the width of the shoe upper may be fixed. Alternatively, the rigid element may be glued and/or welded to the stretchable portion.

In one embodiment, the attached rigid element may cover entirely the stretchable portion. Thus, the permanently attaching may be more stable such as for sport applications, wherein high forces during movements such as sprinting, slowing down etc. may occur. It is also possible to use a shoe sole as rigid element to permanently fix the stretchable portion. The shoe sole may be attached to the stretchable portion by gluing, sewing, welding etc.

As a result, the method 100 reduces the overall process time, the labor costs as well as the manufacturing costs for manufacturing a shoe upper as the reduced number of different sizes of shoe uppers reduces the storage and manufacturing costs. In addition, if rigid lasts are used in the manufacturing process, costs are even more reduced as only a reduced number of lasts is needed.

FIGS. 2*a*-2*c* present schematic embodiments of a shoe upper 200 according to the invention.

FIG. 2*a* presents a side view of the shoe upper 200 which comprises a stretched stretchable portion 210 in its bottom part. Moreover, the stretched stretchable portion 210 is locked by permanently attaching of a rigid element 220. The rigid element 220 such as a fabric patch may be stitched, glued, welded or the like on the stretched stretchable portion 210. In one embodiment, the rigid element 220 may comprise polyurethane (PU) and/or thermoplastic polyurethane (TPU) in order to provide better bonding properties to a shoe sole comprising PU and/or TPU.

FIG. 2*b* presents a side view of a further embodiment. Here, the shoe upper 200 is integral and continuous from a medial side to lateral side of the shoe upper 200 and comprises a stretched stretchable portion 210 in the instep part of the shoe upper 200. Moreover, a rigid element 220 which may be a fabric patch may be stitched, glued, welded or the like on the stretched stretchable portion 210. It is also conceivable that for sport applications such as soccer, rugby or American football, the rigid element 220 in the instep part of the shoe upper 200 may include a cushioning element for protecting the foot of a wearer when kicking a ball and/or a traction element for providing improved slip resistance when kicking a ball.

FIG. 2*c* presents a top view of a still further embodiment. Here, the shoe upper 200 may be provided as an upper piece having a two-dimensional surface before the shoe upper 200 may be formed to be three-dimensional and comprises two stretchable portions 210 in the bottom part of the upper piece. After being formed into a three-dimensional shape, the two edges 230 extending on the bottom part of the shoe upper 200 from a toe part to a heel part of the shoe upper may be bonded together with a suitable technique such as stitching, gluing, welding or the like.

FIG. 3 presents a schematic embodiment of a shoe 300 comprising a shoe upper 305 according to the invention. The shoe upper 305 may be one of the shoe uppers 200 in accordance with FIGS. 2*a*-2*c*. The shoe upper 305 comprises a stretched stretchable portion 310 in its bottom part. Moreover, the stretched stretchable portion 310 is locked by permanently attaching of a rigid element 320. The attached rigid element 320 may cover entirely the stretchable portion 310. Moreover, in the embodiment of FIG. 3, the rigid element 320 may be the shoe sole of the shoe 300. In one embodiment, the shoe sole may comprise a plurality of randomly arranged particles comprising TPU.

In the following, exemplary, not limiting embodiments of the present invention as well as background information are disclosed:

As the present invention relates to knitting a shoe upper or a component thereof, industrial knitting is described first, before embodiments of the present invention are described. This includes suitable techniques in manufacturing knit fabrics such as knitting techniques, the selection of fibers and yarns, coating the fibers, yarns or knit fabric with polymer or other materials, the use of monofilaments, the combination of monofilaments and polymer coating, the application of fused/melted yarns, and multi-layer textile material. The described techniques can be used individually or can be combined in any manner.

Knit Fabric

Knit fabric used in the present invention is divided into weft-knitted fabrics and single-thread warp-knitted fabrics on the one hand and warp-knitted fabrics on the other hand. The distinctive characteristic of knit fabric is that it is formed of interlocking yarn or thread loops. These thread loops are also referred to as stitches and can be formed of one or several yarns or threads.

Yarn or thread are the terms for a structure of one or several fibers which is long in relation to its diameter. Yarn is used to describe a three-dimensional construct of fibers and/or filaments having a small cross-section when compared to the length of the yarn. There are many different types of yarns including single yarns, spun yarns, core spun, wrapped yarns, filament yarns, such as monofilaments or multifilaments, assembled yarns, and folded yarns, such as plied yarns, cabled yarns, core spun and wrapped, and combinations thereof.

A fiber is a flexible structure which is rather thin in relation to its length. In some instances, fibers may have varying lengths. Fibers may be combined with each other to create plies. For example, a ply may include single and/or multiple monofilaments and/or multiple fibers spun together to form a ply. In some instances, one or more plies may be identified as a yarn.

Multiple plies may be supplied to a feeder as individual strands and knit together. In some instances, two or more plies may be twisted together to form a yarn. Two or more yarns made of multiple plies may be twisted together to form a thicker yarn. As a general rule, the individual yarns supplied to the machine will be referred to as "threads". For example, if two plies of a yarn are provided individually to the same feeder they would be referred to as two threads. If however, the plies were twisted together to form a single yarn, then there would be one thread supplied to the knitting machine.

Individual strands within a yarn are often referred to as plies. A number and/or type of plies in a yarn may be varied. Threads provided to a knitting machine may include four threads of a two ply yarn. Thus, if all plies are made of the same material eight plies of the material are provided to the machine.

Very long fibers, of virtually unlimited length with regard to their use, are referred to as filaments. Monofilaments are yarns including one single filament, that is, one single fiber. Monofilament yarns are typically spun and/or extruded. In some cases, monofilaments may be formed from polyamide (e.g., nylon), polyester, polypropylene, polyurethane, elastomeric materials (e.g., a thermoplastic polyurethane, polyether block amide) and/or copolymers and multipolymers. Use of blends of materials may allow for varying degrees of stretch, strength, abrasion resistance, and other predetermined characteristics along the length of the monofilament.

A multifilament yarn may be constructed form multiple monofilaments. In some instances, multifilament yarn may be assembled by twisting monofilaments. Bicomponent fibers may be extruded using two different polymers. For example, the two different polymers may be combined in an unmixed stream and then extruded.

Single yarns may also include multiple materials, for example, one material may be present in the core of the yarn and another acting a shell along a length of the yarn to provide predetermined characteristics to the upper.

Spun yarns include yarns formed from fibers, for example, chopped fibers, which are combined and then spun or twisted together to form a yarn.

Blended yarns may also be a single yarn that is spun out of two or more fiber types to create a yarn having predetermined characteristics. Properties of the blended yarn may vary.

In some instances, two or more yarns may be wound together. Multiple yarns may also be twisted together. The amount of twist in a yarn may be controlled to control properties of the resulting knit portion. For example, low-twist yarns may have a larger volume and be softer than high-twist yarns.

Multiple yarns or plies of yarn may be assembled together for use in an upper. In some instances, the yarns or plies may be twisted together to form a folded yarn. Multiple yarns and/or plies may be fed via the same feeder into the knitting machine and be knit together.

Yarns may be textured. Texturing may impart specific characteristics or traits to the yarns. In particular, texturing yarns may include crimping filaments and/or fibers. Methods of texturing include false-twist texturing, draw texturing, air jet texturing, stuffer box texturing, knit-deknit texturing, combinations thereof and/or other methods known in the art. In some instances, textured yarns may be more elastic (e.g., having higher levels of stretch and/or recovery) than non-textured yarns.

In weft-knitted fabrics and single-thread warp-knitted fabrics, the stitch formation requires at least one thread or yarn, with the thread running in longitudinal direction of the product, that is, essentially at a right angle to the direction in which the product is made during the manufacturing process. In warp-knitted fabrics, the stitch formation requires at least one warp sheet, that is, a plurality of so-called warps. These stitch-forming threads run in longitudinal direction, that is, essentially in the direction in which the product is made during the manufacturing process.

FIG. 4 shows the basic differences between woven fabrics 10, weft-knitted fabrics 11 and 12 and warp-knitted fabric 13. A woven fabric 10 has at least two thread sheets which are usually arranged at a right angle to one another. In this regard, the threads are placed above or underneath each other and do not form stitches. Weft-knitted fabrics 11 and 12 are created by knitting with one thread from the left to the right by interlocking stitches. View 11 shows a front view (also referred to as the front loop fabric or "right" side) and view 12 a back view (also referred to as the back loop fabric or "wrong" side) of a weft-knitted fabric. The front loop and back loop product sides differ in the run of the legs 14. On the back loop fabric side 12 the legs 14 are covered in contrast to the front loop fabric side 11.

Warp-knitted fabric 13 is created by warp knitting with many threads from top down, as shown in FIG. 1*a*. In doing so, the stitches of a thread are interlocked with the stitches of the neighboring threads. Depending on the pattern according to which the stitches of the neighboring threads are interlocked, one of the seven basic connections (also referred to as "interlaces" in warp knitting) pillar, tricot, 2×1 plain, satin, velvet, atlas and twill are created, for example.

By way of example, the interlaces tricot 21, 2×1 plain 22 and atlas 23 are shown in FIG. 5. A different interlocking results depending on how the stitches of thread 24, which is highlighted by way of example, are interlocked in the stitches of neighboring threads. In the tricot interlace 21, the stitch-forming thread zigzags through the knit fabric in the longitudinal direction and binds between two neighboring wales. The 2×1 plain interlace 22 binds in a manner similar to that of the tricot interlace 21, but each stitch-forming warp skips a wale. In the atlas interlace 23 each stitch-forming warp runs to a turning point in a stairs-shape and then changes direction.

Stitches arranged above each other with joint binding sites are referred to as wales. FIG. 6B shows a wale as an example of a weft-knitted fabric with reference number 31. The term "wale" is also used analogously in warp-knitted fabrics. Accordingly, wales run vertically through the mesh fabric. Rows of stitches arranged next to one another, as shown by way of example for a weft-knitted fabric with reference number 32 in FIG. 6A are referred to as rows. Accordingly, rows run through the mesh fabric in the lateral direction.

Three basic weft-knitted structures are known in weft-knitted fabrics, which can be recognized by the run of the stitches along a wale. With plain, single Jersey only back loops can be recognized along a wale on one side of the fabric and only back loops can be recognized along the other side of the product. This structure is created on one row of needles of a knitting machine, that is, an arrangement of neighboring knitting needles, and also referred to as single Jersey. With rib fabric front and back loops alternate within a row, that is, either only front or back loops can be found along a wale, depending on the side of the product from which the wale is considered. This structure is created on two rows of needles with needles offset opposite each other. With purl fabric front and back loops alternate in one wale. Both sides of the product look the same. This structure is manufactured by means of latch needles as illustrated in FIG. 7 by means of stitch transfer. The transfer of stitches can be avoided if double latch needles are used, which comprise both a hook and a latch at each end, respectively.

An essential advantage of knit fabric over weaved textiles is the variety of structures and surfaces which can be created with it. It is possible to manufacture both very heavy and/or stiff knit fabric and very soft, transparent and/or stretchable knit fabric with essentially the same manufacturing technique. The parameters by means of which the properties of the material can be influenced essentially are the pattern of weft knitting or warp knitting, respectively, the used yarn, the needle size or the needle distance, and the tensile strain or tension with which the yarn is fed to the needles.

The advantage of weft knitting is that certain yarns can be weft knitted in at freely selectable places. In this manner, selected zones, such as the first zone and the second zone according to the invention, can be provided with certain properties. For example, the shoe upper according to the invention can be provided with zones made from rubberized yarn in order to achieve higher static friction and thus to enable e.g. a soccer player to better control a ball.

Knitted fabrics are manufactured on machines in the industrial context. These usually comprise a plurality of needles. In weft knitting, latch needles 41 are usually used, each having a moveable latch 42, as illustrated in FIG. 7. This latch 42 closes the hook 43 of the needle 41 such that a thread 44 can be pulled through a stitch 45 without the needle 41 being caught on the stitch 45. In weft knitting, the latch needles are usually moveable individually, so that every single needle can be controlled such that it catches a thread for stitch formation.

A differentiation is made between flat-knitting and circular-knitting machines. In flat-knitting machines, a thread feeder feeds the thread back and forth along a row of needles. In a circular-knitting machine, the needles are arranged in a circular manner and the thread feeding correspondingly takes place in a circular movement along one or more round rows of needles which may be positioned on a cylinder.

Instead of a single row of needles, it is also possible for a knitting machine to comprise multiple rows of needles. This is true for flat-knitting as well as for circular knitting machines. When looked at from the side, the needles of the two rows of needles may, for example, be opposite each other at a right angle. This enables the manufacture of more elaborate structures or fabrics. The use of two rows of needles allows the manufacture of a one-layered or two-layered weft knitted fabric.

A one-layered weft-knitted fabric is created when the stitches generated on the first row of needles are enmeshed with the stitches generated on the second row of needles. Further, knitting machines may be used to generate a single layer fabric where a first section of stitches may be generated on one needle bed and a second section of stitches are generated on a second needle bed. The two sections may be connected by transfers between the beds.

Accordingly, a two-layered weft-knitted fabric is created when the stitches generated on the first row of needles are not or only selectively enmeshed with the stitches generated on the second row of needles and/or if they are merely enmeshed at the end of the weft-knitted fabric. If the stitches generated on the first row of needles are loosely enmeshed only selectively with the stitches generated on the second row of needles by an additional yarn, this is may be an example of a spacer weft-knitted fabric. The additional yarn, for example a monofilament, may be guided back and forth between two layers, so that a distance between the two layers is created. In some instances, the two layers may e.g. be connected to each other via a so-called tuck stitches.

Generally, the following weft-knitted fabrics can thus be manufactured on a weft knitting machine: If only one row of needles is used, a one-layered weft-knitted fabric is created. When two rows of needles on separate beds are used, the stitches of both rows of needles can consistently be connected to each other so that the resulting knit fabric comprises a single layer. If the stitches of both rows of needles are not connected or only connected at the edge when two rows of needles are used, two layers are created. If the stitches of both rows of needles are connected selectively in turns by an additional thread, a spacer weft-knitted fabric may be created. The additional thread is also referred to as spacer thread and it may be fed via a separate yarn feeder.

Single-thread warp-knitted fabrics are manufactured by jointly moved needles. Alternatively, the needles are fixed and the fabric is moved. In contrast to weft knitting, it is not possible for the needles to be moved individually. Similarly to weft knitting, there are flat single-thread warp knitting and circular single-thread warp knitting machines.

In warp knitting, one or several coiled threads which are next to one another, are used. In stitch formation, the individual warps are placed around the needles and the needles are moved jointly.

The techniques described herein as well as further aspects of the manufacture of knit fabric can be found in "*Fachwissen Bekleidung*", $6^{th}$ ed. by H. Eberle et al. (published with the title "*Clothing Technology*" in English), in "*Textil- und Modelexikon*", $6^{th}$ ed. by Alfons Hofer and in "*Maschenlexikon*", $11^{th}$ ed. by Walter Holthaus, for example.

Three-Dimensional Knit Fabric

Three-dimensional (3D) knit fabric can be manufactured on weft knitting machines and warp knitting machines. This is knit fabric which comprises a spatial structure although it is weft knitted or warp knitted in a single process.

A three-dimensional weft knitting or warp knitting technique allows for spatial knit fabric to be manufactured with limited seams, or in some cases without seams. In some instances, a circular knit portion may create a unitary upper without having to cut the knit portion. Using a small circular knit to create an elongated hollow structure to form an upper, the upper may be created using a single unitary knit and/or a knitting process that generates an elongated hollow knit.

Three-dimensional knit fabric may, for example, be manufactured by varying the number of stitches in the direction of the wales by partial rows being formed. Forming partial rows refers to changing a number of stitches in the direction of the row over multiple rows in a knit. Generally, this process is referred to as partial knitting.

When partial rows are formed, stitch formation temporarily occurs only along a partial width of the weft-knitted fabric or warp-knitted fabric. The needles which are not involved in the stitch formation keep the stitches are "parked" until weft knitting occurs again at this position. In this way, it is possible to create shaping, for example, bulges.

The corresponding mechanical process is referred to as "needle parking". During needle parking stitches are held on the parked needles while the stitches of the surrounding active needles continue to knit. After the predetermined shape is created in the fabric, parked needles may be activated and the held stitches may be knit again.

By three-dimensional weft knitting or warp knitting a shoe upper can be adjusted to a last or the foot and a sole can be profiled, for example. The tongue of a shoe, for example, can be weft knitted into the right shape. Contours, structures, knobs, curvatures, notches, openings, fasteners, loops and pockets can be integrated into the knit fabric in a single process.

Three-dimensional knit fabric can be used for the present invention in an advantageous manner.

Combining the concept of three-dimensional knit fabric with small circular knit is complex. However, by selectively knitting and holding stitches, using parked needles, shaping of the small circular knit portion may allow for the creation of elongated hollow structures suitable for upper formation.

Functional Knit Fabric

Knit fabric and particularly weft-knitted fabric may be provided with a range of functional properties which can be used in the present invention in an advantageous manner.

It is possible by means of a weft knitting technique to manufacture knit fabric which has different functional areas or zones and simultaneously maintains its contours. The structures of knit fabric may be adjusted to functional requirements in certain areas, by the stitch pattern, the yarn, the needle size, the needle distance or the tensile strain or tension with which the yarn is fed to the needles.

It is possible, for example, to include structures with large stitches or openings within the knit fabric in areas or zones in which air ventilation is desired. In contrast, in areas or zones in which support and stability are desired, fine-meshed stitch patterns, stiffer yarns or even multi-layered weft knitting structures can be used, which will be described in the following. In the same manner, the thickness of the knit fabric is variable.

Knit fabric with more than one layer, for example, a two-layer fabric, may be weft knitted or warp knitted on a weft knitting machine or a warp knitting machine with several rows of needles, for example, two rows of needles, in a single stage, as described in the section "knit fabric" above. Alternatively, several layers, for example, a two-layer fabric, may be weft knitted or warp knitted in separate stages and then placed above each other and connected to each other if applicable, for example, by sewing, gluing, welding or linking.

Several layers increase solidness and stability of the knit fabric. In this regard, the resulting solidness depends on the extent to which and the techniques by which the layers are connected to each other. The same yarn or different yarns may be used for the individual layers. For example, it is possible for one layer to be weft knitted from multi-fiber yarn and one layer to be weft knitted from monofilament, whose stitches are enmeshed, in a weft-knitted fabric. In particular, stretchability of the weft-knitted layer is reduced due to this combination of different yarns. It is an advantageous alternative of this construction to arrange a layer made from monofilament between two layers made from multi-fiber yarn in order to reduce stretchability and increase solidness of the knit fabric. This results in a pleasant surface made from multi-fiber yarn on both sides of the knit fabric.

An alternative of two-layered knit fabric may be referred to as spacer weft-knitted fabric or spacer warp-knitted fabric, as explained in the section "knit fabric". In this regard, a spacer yarn is weft knitted or warp knitted more or less loosely between two weft-knitted or warp-knitted layers, interconnecting the two layers and simultaneously serving as a filler. The spacer yarn may comprise the same material as the layers themselves, for example, polyester, an elastic material (e.g., spandex, Lycra®) or another material. The spacer yarn may also be a monofilament which provides the spacer weft-knitted fabric or spacer warp-knitted fabric with stability.

Such spacer weft-knitted fabrics or spacer warp-knitted fabrics, respectively, which are also referred to as three-dimensional weft-knitted fabrics, but have to be differentiated from the formative 3D weft-knitted fabrics or 3D warp-knitted fabrics mentioned in the section "three-dimensional knit fabric" above, may be used wherever additional cushioning or protection is desired, for example, at the shoe upper or the tongue of a shoe upper or in certain areas of a sole. Three-dimensional structures may also serve to create spaces between neighboring textile layers or also between a textile layer and the foot, thus ensuring air ventilation. Moreover, the layers of a spacer weft-knitted fabric or a spacer warp-knitted fabric may comprise different yarns depending on the position of the spacer weft-knitted fabric on the foot.

The thickness of a spacer weft-knitted fabric or a spacer warp-knitted fabric may be set in different areas depending on the function or the wearer. Various degrees of cushioning may be achieved with areas of various thicknesses, for example. Thin areas may increase bendability, for example, thus fulfilling the function of joints or flex lines.

Multi-layered constructions also provide opportunities for color design, by different colors being used for different layers. In this way, knit fabric can be provided with two different colors for the front and the back, for example. A shoe upper made from such knit fabric may then comprise a different color on the outside than on the inside.

An alternative of multi-layered constructions are pockets or tunnels, in which two textile layers or knit fabric weft knitted or warp knitted on two rows of needles are connected to each other only in certain areas so that a hollow space is created. Alternatively, items of knit fabric weft knitted or warp knitted in two separate processes are connected to each other such that a void is created, for example, by sewing, gluing, welding (e.g., using hot melt material, such as films, fibers, or yarns) or linking. It is then possible to introduce a cushioning material such as a foam material, eTPU (expanded thermoplastic urethane), ePP (expanded polypropylene), expanded EVA (ethylene vinyl acetate) or particle foam, an air or gel cushion for example, through an opening, for example, at the tongue, the shoe upper, the heel, the sole or in other areas.

Alternatively or additionally, the pocket may also be filled with a filler thread or a spacer knit fabric. It is furthermore possible for threads to be pulled through tunnels, for example as reinforcement in case of tension loads in certain areas of a shoe upper. Moreover, it is also possible for the laces to be guided through such tunnels. Moreover, loose threads can be placed into tunnels or pockets for padding, for example in the area of the ankle. However, it is also possible for stiffer reinforcing elements, such as caps, flaps or bones to be inserted into tunnels or pockets. These may be manufactured from plastic such as polyethylene, TPU, polyethylene or polypropylene, for example.

A further possibility for a functional design of knit fabric is the use of certain variations of the basic weaves. In weft knitting, it is possible for bulges, ribs or waves to be weft knitted in certain areas, for example, in order to achieve reinforcement in these places. A wave may, for example, be created by stitch accumulation on a layer of knit fabric. This means that more stitches are weft knitted or warp knitted on one layer than on another layer. Alternatively, stitches on a first layer may differ from stitches knitted on a second layer. For example, stitches may be knit tighter, looser, and/or using a different yarn. Adjusting the knit by changing the tightness of the stitches and/or using a thicker yarn, the thickness of the resulting knit fabric may be controlled.

Waves may be weft knitted or warp knitted such that a connection is created between two layers of a two-layered knit fabric or such that no connection is created between the two layers. A wave may also be weft knitted as a right-left wave on both sides with or without a connection of the two layers. A structure in the knit fabric may be achieved by an uneven ratio of stitches on the front or the back of the knit fabric.

Ribs, waves or similar patterns, for example, may be included in the knit fabric or knit structure of the shoe upper according to the invention in order to increase friction with a soccer ball, for example, and/or in order to generally allow for a soccer player to have better control of a ball.

A further possibility of functionally designing knit fabric within the framework of the present invention is providing openings in the knit fabric already during weft knitting or warp knitting. In this manner, air ventilation of the soccer shoe according to the invention may be provided in specific places in a simple manner.

Yet another possibility of functionally designing knit fabric within the framework of the present invention is forming laces integrally with the knit fabric of the shoe upper according to the invention. In this embodiment the laces are warp knitted or weft knitted integrally with the knit fabric already when the knit fabric of the shoe upper according to the invention is weft knitted or warp knitted. In this regard, a first end of a lace is connected to the knit fabric, while a second end is free.

Preferably, the first end is connected to the knit fabric of the shoe upper in the area of the transition from the tongue to the area of the forefoot of the shoe upper. Further preferably, a first end of a first lace is connected to the knit fabric of the shoe upper at the medial side of the tongue and a first end of a second lace is connected to the knit fabric of the shoe upper at the lateral side of the tongue. The respective second ends of the two laces may then be pulled through lace eyelets for tying the shoe.

A possibility of speeding up the integral weft knitting or warp knitting of laces is having all yarns used for weft knitting or warp knitting knit fabric end in the area of the transition from the tongue to the area of the forefoot of the shoe upper. The yarns preferably end in the medial side of the shoe upper on the medial side of the tongue and form the lace connected on the medial side of the tongue. The yarns preferably end in the lateral side of the shoe upper on the lateral side of the tongue and form the lace connected to the lateral side of the tongue. The yarns are then preferably cut off at a length which is sufficiently long for forming laces. The yarns may be twisted or intertwined, for example. The respective second end of the laces is preferably provided with a lace clip. Alternatively, the second ends are fused or provided with a coating.

A knit fabric is particularly stretchable in the direction of the stitches (longitudinal direction) due to its construction. This stretching may be reduced, for example, by subsequent polymer coating of the knit fabric. The stretching may also be reduced during manufacture of the knit fabric itself, however. One possibility is reducing the mesh openings, that is, using a smaller needle size. Smaller stitches generally result in less stretching of the knit fabric. Moreover, the stretching of the knit fabric can be reduced by knitted reinforcement, for example, three-dimensional structures. Such structures may be arranged on the inside or the outside of the knit fabric of the shoe upper according to the invention. Furthermore, non-stretchable yarn, for example, made from nylon, may be laid in a tunnel along the knit fabric in order to limit stretching to the length of the non-stretchable yarn.

Colored areas with several colors may be created by using a different thread and/or by additional layers. In transitional areas, smaller mesh openings (smaller needle sizes) are used in order to achieve a fluent passage of colors.

Further effects may be achieved by weft inserts or jacquard knitting. Weft inserts are positioned in the knit but are not necessarily knit. They may extend between layers of knit in a double jersey fabric. In single jersey fabric, weft inserts may be held in place by using stitches on both sides of the weft insert along the length of the weft insert. For example, in some instances the weft insert may be selectively knit or tucked.

In some areas jacquard knitting may be used to provide a certain yarn, for example, in a certain color to a particular side of the fabric. Neighboring areas which may comprise a different yarn, for example in a different color, may be connected to each other by means of a so-called tuck stitch. A small circular knitting machine capable of jacquard knitting may allow for greater control of individual needles and/or placement of yarns.

Table 1 shows jacquard knitting capabilities on large and small circular knitting machines, respectively:

| | Large circular | | Small circular | |
|---|---|---|---|---|
| Function | RLj | RRj | RLj | RRj |
| Single Jersey | x | x | x | x |
| Rib | — | x | — | x |
| Interlock | — | x | — | x |
| RL-Tube | x | x | x | x |
| RR-Tube | — | x | — | x |
| DentriticTub | x* | x* | — | — |
| Warp thread | $x^1$ | $x^1$ | $x^2$ | $x^2$ |

-continued

| Function | Large circular RLj | Large circular RRj | Small circular RLj | Small circular RRj |
|---|---|---|---|---|
| Weft thread | x | x | x | x |
| Filler thread | — | x | — | x |
| Plush | x[3] | x[4] | x[4] | x[4] |
| Online pattern change | x | x | x | x |
| Relocate stitches | — | (x) | — | — |
| Pressing of stitches | x[5] | x[5] | x[5] | x[5] |
| Online Gauge change | (x) | (x) | (x) | (x) |
| Intarsia | — | — | x[6] | x[6] |
| Yarn change (stripe) | x | x | x | x |
| Yarn change (local) | (x) | (x) | x | (x) |
| Holes | (x) | (x) | x[5] | (x) |
| Pores | x | x | x | x |
| Net structure | x | x | x | x |
| RR-RL change | — | x | — | x |
| Lining | x | — | x | — |
| 3D spacer | — | x | — | x |
| 3D local stitch change | x* | (x) | x | x |

*only seamless machines
[1]bobbins rotate with machines
[2]cams rotate with machine
[3]special sinkers required
[4]special pins required
[5]needle opener required
[6]yarn change/cutter required
(x) not on the market, theoretically possible Using a jacquard system on a circular knitting machine increases a number of structures and/or stitches that can be formed. For example, machine gauge may be changed during the knitting process by deactivating every second needle.

In addition, it may be possible to create intarsia patterns using the needle control that a jacquard system provides. For example, pictures or designs, such as logos, may be integrated into a knitted upper or element. The production of holes, pores and net structures as well as local changes of yarn materials can be realized with electronic jacquard needle control on circular knitting machines.

During jacquard knitting, two rows of needles are used and two different yarns run through all areas, for example. However, in certain areas only one yarn appears on the visible side of the knit fabric and the respective other yarn runs invisibly on the other side of the knit fabric.

A product manufactured from knit fabric may be manufactured in one piece on a weft knitting machine or a warp knitting machine. Functional areas may then already be manufactured during weft knitting or warp knitting by corresponding techniques as described herein.

Alternatively, the product may be combined from several parts of knit fabric and it may also comprise parts which are not manufactured from knit fabric. In this regard, the parts of knit fabric may each be designed separately with different functions, for example regarding thickness, isolation, transport of moisture, stability, protection, abrasion resistance, durability, cooling, stretching, rigidity, compression, etc.

The shoe upper according to the invention may, for example, be generally manufactured from knit fabric as a whole or it may be put together from different parts of knit fabric. A whole shoe upper or parts of that may, for example, be separated, for example, punched, from a larger piece of knit fabric. The larger piece of knit fabric may, for example, be a circular weft-knitted fabric or a circular warp-knitted fabric or a flat weft-knitted fabric or a flat warp-knitted fabric.

For example, a tongue may be manufactured as a continuous piece and connected with the shoe upper subsequently, or it can be manufactured in one piece with the shoe upper. With regard to their functional designs, ridges on the inside may, for example, improve flexibility of the tongue and ensure that a distance is created between the tongue and the foot, which provides additional air ventilation. Laces may be guided through one or several weft-knitted tunnels of the tongue. The tongue may also be reinforced with polymer in order to achieve stabilization of the tongue and, for example, prevent a very thin tongue from convolving. Moreover, the tongue can then also be fitted to the shape of a last or the foot.

Applications such as polyurethane (PU) prints, thermoplastic polyurethane (TPU) ribbons, textile reinforcements, leather, rubber, etc., may be subsequently applied to the knit fabric of the shoe upper according to the invention. Thus, it is possible, for example, to apply a plastic heel or toe cap as reinforcement or logos and eyelets for laces on the shoe upper, for example by sewing, gluing or welding.

Sewing, gluing or welding, for example, constitute suitable connection techniques for connecting individual parts of knit fabric with other textiles or with parts of knit fabric. Linking is another possibility for connecting two parts of knit fabric. During linking two edges of knit fabric are connected to each other using the stitches (usually stitch by stitch).

A possibility for welding textiles, particularly ones made from plastic yarns or threads, is ultrasonic welding. Therein, mechanical oscillations in the ultrasonic frequency range are transferred to a tool referred to as sonotrode. The oscillations are transferred to the textiles to be connected by the sonotrode under pressure. Due to the resulting friction, the textiles are heated up, softened and ultimately connected in the area of the place of contact with the sonotrode. Ultrasonic welding allows rapidly and cost-effectively connecting particularly textiles with plastic yarns or threads. It is possible for a ribbon to be attached, for example glued, to the weld seam, which additionally reinforces the weld seam and is optically more appealing. Moreover, wear comfort is increased since skin irritations—especially at the transition to the tongue—are avoided.

Energy may be applied to fabric and/or yarns in particular to melt or fuse the yarns or portions of the fabric. For example, melt yarns or fuse yarns may be used in areas to be welded. Heat may be selectively applied to areas of an upper to melt the yarns in order to weld sections to each other or to other components.

In some instances, melt yarns may include a low melt temperature material with melting temperatures in a range from 60° C. to 150° C. Melt yarns may include materials having a melting temperature and/or glass transition point in a range from about 80° C. to about 140° C. (e.g., 85° C.).

Melt materials include thermoplastic materials such as polyurethanes (i.e., thermoplastic polyurethane "TPU"), ethylene vinyl acetates, polyamides (e.g., low melt nylons), and polyesters (e.g., low melt polyester). Examples of melting strands include thermoplastic polyurethane and polyester.

In some instances, melt material present in a yarn flows when melted such that the melt material may surround at least a portion of the adjacent material. When cooled the melt material may form a rigid sections that strengthen the textile and/or limit the movement of the surrounding material.

Fibers

The yarns or threads, respectively, used for the knit fabric of the present invention usually comprise fibers. As was explained above, a flexible structure which is rather thin in relation to its length is referred to as a fiber. Very long fibers, of virtually unlimited length with regard to their use, are referred to as filaments. Fibers are spun or twisted into threads or yarns. Fibers can also be long, however, and twirled into a yarn. Fibers may include natural or synthetic materials. Natural fibers are environmentally friendly, since they are compostable. Natural fibers include cotton, wool, alpaca, hemp, coconut fibers or silk, for example. Among the synthetic fibers are polymer-based fibers such as polypropylene, acrylic, polyamide ("PA"), for example, Nylon™, polyester, polyethylene terephthalate ("PET"), polybutylene terephthalate ("PBT"), polyurethane (e.g., thermoplastic polyurethanes, elastane, or spandex), para-aramid (e.g., Kevlar™), synthetic silks (e.g., synthetic silks based on those from spiders or silkworms), which can be produced as classic fibers or as high-performance fibers or technical fibers.

The mechanical and physical properties of a fiber and the yarn manufactured therefrom are also determined by the fiber's cross-section, as illustrated in FIG. 8. These different cross-sections, their properties and examples of materials having such cross-sections will be explained in the following.

A fiber having the circular cross-section 510 can either be solid or hollow. A solid fiber is the most frequent type, it allows easy bending and is soft to the touch. A fiber as a hollow circle with the same weight/length ratio as the solid fiber has a larger cross-section and is more resistant to bending. Examples of fibers with a circular cross-section are Nylon™, polyester and Lyocell.

A fiber having the bone-shaped cross-section 530 has the property of wicking moisture. Examples of such fibers are acrylic or spandex. The concave areas in the middle of the fiber support moisture being passed on in the longitudinal direction, with moisture being rapidly wicked from a certain place and distributed.

The following further cross-sections are illustrated in FIG. 8:

- Polygonal cross-section 511 with flowers, for example: flax;
- Oval to round cross-section 512 with overlapping sections, for example: wool;
- Flat, oval cross-section 513 with expansion and convolution, for example: cotton;
- Circular, serrated cross-section 514 with partial striations, for example: rayon;
- Lima bean cross-section 520; smooth surface;
- Serrated lima bean cross-section 521, for example: Avril™ rayon;
- Triangular cross-section 522 with rounded edges, for example: silk;
- Trilobal star cross-section 523; like triangular fiber with shinier appearance;
- Clubbed cross-section 524 with partial striations; sparkling appearance, for example: acetate;
- Flat and broad cross-section 531, for example: acetate in another design;
- Star-shaped or concertina cross section 532;
- Cross-section 533 in the shape of a collapsed tube with a hollow center; and
- Square cross-section 534 with voids, for example: AnsoIV™ nylon.

Individual technical fibers with their properties which are of interest for the manufacture of knit fabric for the present invention will be described in the following:

Aramid fibers: good resistance to abrasion and organic solvents; non-conductive; temperature-resistant up to 500° C.

Para-aramid fibers: known under trade names Kevlar™, Techova™ and Twaron™; outstanding strength-to-weight properties; high Young's modulus and high-tensile strength (higher than with meta-aramides); low stretching and low elongation at break (approx. 3.5%); difficult to dye.

Meta aramides: known under trade names Numex™, Teijinconex™, New Star™, X-Fiper™.

Dyneema fibers: highest impact strength of any known thermoplastics; highly resistant to corrosive chemicals, with exception of oxidizing acids; extremely low moisture absorption; very low coefficient of friction, which is significantly lower than that of Nylon™ and acetate and comparable to Teflon; self-lubricating; highly resistant to abrasion (15 times more resistant to abrasion than carbon steel); nontoxic.

Carbon fiber: an extremely thin fiber about 0.0005 to 0.010 mm in diameter, composed essentially of carbon atoms; highly stable with regard to size; one yarn is formed from several thousand carbon fibers; high tensile strength; low weight; low thermal expansion; very strong when stretched or bent; thermal conductivity and electric conductivity.

Glass fiber: high ratio of surface area to weight; with the increased surface making the glass fiber susceptible to chemical attack; by trapping air within them, blocks of glass fibers provide good thermal insulation; thermal conductivity of 0.05 W/(m×K); the thinnest fibers are the strongest because the thinner fibers are more ductile; the properties of the glass fibers are the same along the fiber and across its cross-section, since glass has an amorphous structure; moisture accumulates easily, which can worsen microscopic cracks and surface defects and lessen tensile strength; correlation between bending diameter of the fiber and the fiber diameter; thermal, electrical and sound insulation; higher stretching before it breaks than carbon fibers.

Yarns

A plurality of different yarns may be used for the manufacture of knit fabric which is used in the present invention. As was already defined, a structure of one or several fibers which is long in relation to its diameter is referred to as a yarn.

Yarns may include fibers and/or filaments of various sizes. For example, yarns may be created from flock which are small fiber particles, chopped fiber, fibers and/or filaments.

Functional yarns are capable of transporting moisture and thus of absorbing sweat and moisture. They can be electrically conducting, self-cleaning, thermally regulating and insulating, flame resistant, reflective, and UV-absorbing, and may enable infrared remission. They may be suitable for sensorics. Antibacterial yarns, such as silver yarns, for example, prevent odor formation.

Stainless steel yarn contains fibers made of a blend of nylon or polyester and steel. Its properties include high-abrasion resistance, higher-cut resistance, high thermal abrasion, high thermal and electrical conductivity, higher-tensile strength and high weight.

In textiles made from knit fabric, electrically conducting yarns may be used for the integration of electronic devices. These yarns may, for example, forward impulses from sensors to devices for processing the impulses, or the yarns may function as sensors themselves, and measure electric streams on the skin or physiological magnetic fields, for example. Examples for the use of textile-based electrodes can be found in European patent application EP 1 916 323.

Melt materials may include fibers, filaments, yarns, films, textiles or materials that are activated by supplying energy. In some instances, heat may be applied to activate melt materials. Melt materials for use as melt fibers, filaments or yarns may include thermoplastic polyurethanes, polyamides, copolyamides, copolyesters, other melt materials known and combinations thereof. Melt yarns may be a mixture of materials having different melt temperatures. For example, a low-temperature melt material may be combined with a material having a high melt temperature. In some instances, a low-temperature melt material may have a melt temperature that falls within a range of processing temperatures utilized during shoe construction. The high melt temperature material may be outside the range of processing temperatures during shoe construction. Melt yarns may include constructions having a low melt temperature yarn surrounded by a yarn; a yarn surrounded by a low melt temperature yarn; and pure melt yarn of a thermoplastic material. After being heated to the melting temperature, the low melt temperature yarn fuses with the surrounding yarn (e.g., polyester or Nylon™), stiffening the knit fabric. The melting temperature of the low melt temperature yarn is determined accordingly and it is usually lower than that of the yarn in case of a mixed yarn.

In some instances, a melt yarn may include a thermoplastic yarn and a non-thermoplastic yarn. For example, three types of melt yarns may include: a thermoplastic yarn surrounded by a non-thermoplastic yarn; a non-thermoplastic yarn surrounded by thermoplastic yarn; and pure melt yarn of a thermoplastic material. After being heated to the melting temperature, thermoplastic yarn fuses with the non-thermoplastic yarn (e.g., polyester or Nylon™), stiffening the knit fabric. The melting temperature of the thermoplastic yarn is determined accordingly and it is usually lower than that of the non-thermoplastic yarn in case of a mixed yarn.

A shrinking yarn may be a dual-component yarn. The outer component is a shrinking material, which shrinks when a defined temperature is exceeded. The inner component is a non-shrinking yarn, such as polyester or nylon. Shrinking increases the stiffness of the textile material. Other yarns may also shrink upon application of the energy to the upper. Knowledge of the shrink properties of a material may be used to control the final properties of an upper. For example, an elastic yarn may shrink upon application of heat, thus it may be used in areas where shrinkage is desired. Further yarns for use in knit fabric are luminescent or reflecting yarns and so-called "intelligent" yarns. Examples of intelligent yarns are yarns which react to humidity, heat or cold and alter their properties accordingly, for example, contracting due to environmental conditions and thus making the stitches smaller or changing their volume and thus increasing permeability to air. Yarns made from piezo fibers or yarn coated with a piezo-electrical substance are able to convert kinetic energy or changes in pressure into electricity, which may provide energy to sensors, transmitters or accumulators, for example.

Yarns may be a combination of materials, in particular, some yarns may have a core material and have one or more materials wrapped around it. For example, an elastic yarn may be used as a core material and a polyester may be wrapped around it.

Further, yarns, fibers and/or filaments may be combined to form blended yarns.

Blending may refer to a process by which fibers, yarns, and/or filaments of various materials, lengths, thicknesses and/or colors are combined. Blending may allow for creation of yarns having specific predetermined properties. In some instances, a blended yarn may exhibit similar properties of a much thicker multiple ply yarn.

Blended yarns may include two or more yarns filaments and/or fibers. For example, a blended yarn may include two polyester yarns of different colors combined with low melt temperature fibers. In an illustrative example, two polyester yarns having different colors are combined with fibers formed from low melt temperature copolyamide to form a blended yarn.

Blended yarns allow for more consistent distribution of materials throughout a length of the yarn.

In some instances, for example, multiple plies of a base yarn may be combined with a single ply of a functional yarn to form a conventional yarn to be knitted into a knit element. In contrast, fibers of different materials may be mixed and then twisted together to form a blended yarn. When creating a blended yarn having the same or similar predetermined properties as the conventional yarn, it may be possible to combine fibers of a base yarn with fibers of a functional yarn. Fibers may be chopped to a particular size.

For example, polyester fibers may be mixed with fibers from a low melt temperature material, such as a low melt copolyamide, copolyester, polyester, polyamide, thermoplastic polyurethane and/or mixtures thereof, and then twisted to form a blended yarn. In an illustrative example, a mixture of 50% by weight polyester fibers and 50% by weight copolyamide fibers are mixed and then spun together to form a blended yarn.

In some instances, blended yarns may include polyester in a range from about 20% to 80% by weight and a low-melt temperature material in a range from about 20% to 80% by weight. For example, in a zone requiring high stability a yarn having a composition of 30% by weight polyester and 70% by weight low-melt temperature material may be used. For areas requiring slightly less stability, a yarn having 70% by weight polyester and 30% by weight low-melt temperature material may be used.

In some instances, the composition of the yarn may be determined by the requirements for the knit material on the shoe. In some instances, use of a higher amount of copolyamide fibers may be predetermined for uses requiring higher stiffness and/or better abrasion.

Further, some instances may call for lower levels of low melt temperature fibers. For example, while blended yarns may have a low melt temperature fiber content in a range from about 8% to 80% by weight, in some instances a yarn having a lower content is desirable, for example, a low melt fiber content in a range from about 10% to 30% may be useful in areas requiring some support as well as flexibility. In some cases, the low melt fiber content of a blended yarn may be in a range from about 15% to 20%. Determination of the low melt fiber content is dependent on the predetermined properties that resulting knit element should possess, as well as the material types. Various parts of a knit element may, for example, need varying levels of stiffness. Further, the low melt temperature fiber content of the upper may vary from zone to zone depending on the properties of the upper.

When replacing a conventional yarn with a blended yarn, it is possible to reduce a number of yarn feeders (i.e., yarn carriers or fingers) used to produce a knit element having similar predetermined properties. When using a conventional yarn 10 plies of a polyester may be delivered to a needle using one yarn feeder and 1 ply of a melt yarn (e.g., copolyamide) may be delivered to the needle using a second yarn feeder. When using a blended yarn, a similar ratio of the materials in the conventional yarn may be used. That is, a similar ratio of polyester to melt yarn may be used to maintain the predetermined physical properties. In some instances, the ratio between the yarns may differ between the conventional yarn and the blended yarn. In one illustrative example, three (3) percent copolyamide fiber (i.e., EMS Grilon® K85) and ninety seven (97) percent polyester fiber are blended to together to create a blended yarn for use in the knit element. As can be seen by the values, the amount of low temperature melt fiber is reduced. This reduction may result in lower material costs.

In some instances, for example, 12 plies of polyester may be combined with a single ply of melt yarn to form a conventional yarn. This may be replaced by a single blended yarn having thickness equivalent to nine plies of a conventional yarn and still maintain the predetermined properties of the thicker conventional yarn in an illustrative example. Thus, blending may allow for thinner yarns to replace thicker more conventional yarns.

Use of blended yarns may allow for easier processing of yarns during knitting. A blended yarn with properties equivalent to standard multiple ply conventional yarn may be softer and thus is easier to form into loops. Thus, the blended yarns may be less likely to break or to drop a stitch.

Blended yarns allow for control of properties of the yarn without having to use complete yarns. This may reduce the amount of material used, for example, the number of yarns or plies used and/or the volume of material, and therefore the cost of the yarn. Further, by reducing the number of yarns or plies of yarns knitted the knitting time may be reduced. Blended yarns may allow better control of the mix ratio of materials than for example in a "folded" yarn.

Use of blended yarns may result in a more consistent distribution of the functional material, for example, a low melt temperature material along the length of the blended yarn when compared to a conventional twisted yarn made from multiple plies.

Further reducing the number of plies fed to a knitting machine to create a knit element having predetermined properties may result in a more efficient and/or cost-effective system. In particular, supply chain issues, knitting time and quality control may be improved.

In an illustrative example, a number of threads supplied to a knitting machine was reduced from 113 threads to 20 threads. This reduction decreased knitting time by providing a more stable system. Reducing the threads supplied to the knitting machine reduces the risk of broken stitches, and therefore reduced potential downtime of the machine.

Use of blended yarns may simplify machine set up as the number of bobbins on a given machine may be greatly reduced. Reducing the number of yarns and/or bobbins may reduce the risk of processing delays. For example, reducing the number of yarns reduces the risk of yarn breakage and delays associated with it. By reducing the number of bobbins set up times are reduced.

Yarns may furthermore be processed, for example, coated, in order to maintain certain properties, such as stretching, water resistance/repellency, color or humidity resistance.

Polymer Coating

Due to its structure, weft knitted or warp knitted knit fabric is considerably more flexible and stretchable than weaved textile materials. For certain applications and requirements, for example, in certain areas of a shoe upper according to the present invention, it may therefore be necessary to additionally reduce flexibility and stretchability in order to achieve sufficient stability.

For that purpose, a polymer layer may be applied to one side or both sides of knit fabric (weft-knit or warp-knit goods), but generally also to other textile materials. Such a polymer layer causes a reinforcement and/or stiffening of the knit fabric. In a shoe upper in accordance with the present invention, it may, for example, serve the purpose of supporting and/or stiffening and/or reducing elasticity in the toe area, in the heel area, along the lace eyelets, on lateral and/or medial surfaces or in other areas. Furthermore, elasticity of the knit fabric and particularly stretchability are reduced. Moreover, the polymer layer protects the knit fabric against abrasion. Furthermore, it is possible to give the knit fabric a three-dimensional shape by means of the polymer coating by compression-molding. The polymer coating may be thermoplastic urethane (TPU), for example.

In the first step of polymer coating, the polymer material is applied to one side of the knit fabric. It can also be applied on both sides. The material can be applied by spraying on, coating with a doctor knife, laying on, printing on, sintering, ironing on or spreading. If it is polymer material in the form of a film, the latter is placed on the knit fabric and connected with the knit fabric by means of heat and pressure, for example. The most important method of applying is spraying on. This can be carried out by a tool similar to a hot glue gun. Spraying on enables the polymer material to be applied evenly in thin layers. Moreover, spraying on is a fast method. Effect pigments such as color pigments, for example, may be mixed into the polymer coating.

The polymer is applied in at least one layer with a thickness of preferably in a range from 0.2 mm to 1 mm. One or several layers may be applied, with it being possible for the layers to be of different thicknesses and/or colors. For example, a shoe upper according to the invention may comprise a polymer coating with a thickness of 0.01 to 5 mm. Further, with some shoes, the thickness of the polymer coating may be between 0.05 and 2 mm. Between neighboring areas of a shoe with polymer coatings of various thicknesses there can be continuous transitions from areas with a thin polymer coating to areas with a thick polymer coating. In the same manner, different polymer materials may be used in different areas, as will be described in the following.

During application, polymer material attaches itself to the points of contact or points of intersection, respectively, of the yarns of the knit fabric, on the one hand, and to the gaps between the yarns, on the other hand, forming a closed polymer surface on the knit fabric after the processing steps described in the following. However, in case of larger mesh openings or holes in the textile structure, this closed polymer surface may also be intermittent, for example, to enable air ventilation. This also depends on the thickness of the applied material: The more thinly the polymer material is applied, the easier it is for the closed polymer surface to be intermittent. Moreover, the polymer material may also penetrate the yarn and soak it and thus contributes to its stiffening.

After application of the polymer material, the knit fabric is pressed in a press under heat and pressure. The material liquefies in this step and fuses with the yarn of the textile material.

In a further optional step, the knit fabric may be pressed into a three-dimensional shape in a machine for compression-molding. For example, the area of the heel or the area of the toes of a shoe upper can be shaped three-dimensionally over a last. Alternatively, the knit fabric may also be directly fitted to a foot.

The following polymer materials may for example be used: polyester; polyester-urethane pre-polymer; acrylate; acetate; reactive polyolefins; co-polyester; polyamide; copolyamide; reactive systems (mainly polyurethane systems reactive with $H_2O$ or $O_2$); polyurethanes; thermoplastic polyurethanes; and polymeric dispersions.

The described polymer coating can be used sensibly wherever support functions, stiffening, increased abrasion resistance, elimination of stretchability, increase of comfort, increase of friction and/or fitting to prescribed three-dimensional geometries are desired. It is also conceivable to fit the shoe upper in accordance with the present invention to the individual shape of the foot of the person wearing it, by polymer material being applied to the shoe upper and then adapting to the shape of the foot under heat.

Additionally or alternatively to a reinforcing polymer coating, knit fabric may be provided with a water-repellent coating to avoid or at least reduce permeation of humidity. The water-repellent coating may be applied to the entire shoe upper or only a part thereof, for example, in the toe area. Water-repellent materials may, for example, be based on hydrophobic materials such as polytetrafluoroethylene (PTFE), wax or white wax. A commercially available coating is Scotchgard™ from 3M.

Monofilaments for Reinforcement

As was already defined, a monofilament is a yarn consisting of one single filament, that is, one single fiber. Therefore, stretchability of monofilaments is considerably lower than that of yarns which are manufactured from many fibers. This also reduces the stretchability of a knit fabric which is manufactured from monofilaments or comprises monofilaments. Monofilaments are typically made from polyamide. However, other materials, such as polyester or a thermoplastic material, are also conceivable.

So whereas knit fabric made from a monofilament is considerably more rigid and less stretchable, this knit fabric does, however, not have the desired surface properties such as, for example, smoothness, color, transport of moisture, outer appearance and variety of textile structures as usual knit fabric has. This disadvantage is overcome by the knit fabric described in the following.

FIG. 9 depicts a weft-knitted fabric having a weft-knitted layer made from a first yarn, such as a multi-fiber yarn, for example, and a weft-knitted layer made from monofilament. The layer of monofilament is knitted into the layer of the first yarn. The resulting two-layered knit fabric is considerably more solid and less stretchable than the layer made from yarn alone.

FIG. 9 particularly depicts a front view 61 and a back view 62 of a two-layered knit fabric 60. Both views show a first weft-knitted layer 63 made from a first yarn and a second weft-knitted layer 64 made from monofilament. The first textile layer 63 made from a first yarn is connected to the second layer 64 at stitch position 65. In particular at stitch position 65, tuck stitch 66 connects first textile layer 63 to second textile layer 64. In addition, stitch 67 from the second textile layer 64 is knitted at stitch position 65. Thus, the greater solidness and smaller stretchability of the second textile layer 64 made from the monofilament is transferred to the first textile layer 63 made from the first yarn.

A monofilament may also be slightly melted in order to connect with the layer of the first yarn and limit stretching even more. The monofilament then fuses with the first yarn at the points of contact and fixes the first yarn with respect to the layer made from monofilament.

Combination of Monofilaments and Polymer Coating

The weft-knitted fabric having two layers as described for example in the preceding section may additionally be reinforced by a polymer coating as was already described in the section "polymer coating". The polymer material is applied to the weft-knitted layer made from monofilament. In doing so, it does not connect to the material (e.g., polyamide material) of the monofilament, since the monofilament has a very smooth and round surface, but essentially penetrates the underlying first layer of a first yarn (e.g., polyester yarn). During subsequent pressing, the polymer material therefore fuses with the yarn of the first layer and reinforces the first layer. In doing so, the polymer material has a lower melting point than the first yarn of the first layer and the monofilament of the second layer. The temperature during pressing is selected such that only the polymer material melts but not the monofilament or the first yarn.

Melt Yarn

For reinforcement and for the reduction of stretching, the yarn of the knit fabric which is used according to the invention may additionally or alternatively also be a melt yarn which fixes the knit fabric after pressing. There are substantially three types of melt yarns: a thermoplastic yarn surrounded by a non-thermoplastic yarn; a non-thermoplastic yarn surrounded by thermoplastic yarn; and pure melt yarn of a thermoplastic material. In order to improve the bond between thermoplastic yarn and the non-thermoplastic yarn, it is possible for the surface of the non-thermoplastic yarn to be texturized.

Pressing preferably takes place at a temperature ranging from 110 to 150° C., especially preferably at 130° C. The thermoplastic yarn melts at least partially in the process and fuses with the non-thermoplastic yarn. After pressing, the knit fabric is cooled, so that the bond is hardened and fixed. The melt yarn may be arranged in the entire knit fabric or only in selective areas.

In one embodiment, the melt yarn is weft knitted or warp knitted into the knit fabric. In case of several layers, the melt yarn may be knitted into one, several or all layers of the knit fabric.

In another embodiment, the melt yarn may be arranged between two layers of knit fabric. In doing so, the melt yarn may simply be placed between the layers. Arrangement between the layers has the advantage that the melt yarn does not stain the mold during pressing and molding, since there is no direct contact between the melt yarn and the mold.

Thermoplastic Textile for Reinforcement

A further possibility for reinforcing a knit fabric which is used for the present invention is the use of a thermoplastic textile. Thermoplastic textiles may include, but are not limited to thermoplastic non-wovens, thermoplastic woven fabrics and/or thermoplastic knit fabrics. A thermoplastic textile may melt at least partially when subjected to heat and stiffen as the textile cools down. A thermoplastic textile may, for example, be applied to the surface of the knit fabric by applying pressure and heat. When it cools down, the thermoplastic textile stiffens and specifically reinforces the shoe upper in the area in which it was placed, for example.

The thermoplastic textile may specifically be manufactured for the reinforcement in its shape, thickness and structure. Additionally, its properties may be varied in certain areas. The stitch structure, the knitting stitch and/or the yarn used may be varied such that different properties are achieved in different areas.

A weft-knitted fabric or warp-knitted fabric made from thermoplastic yarn is an embodiment of a thermoplastic textile. Additionally, the thermoplastic textile may also comprise a non-thermoplastic yarn. The thermoplastic textile may be applied to the shoe upper according to the invention, for example, by pressure and heat.

A woven fabric whose wefts and/or warps are thermoplastic is another embodiment of a thermoplastic textile. Different yarns can be used in the weft direction and the warp direction of the thermoplastic woven fabric, so as to achieve different properties, such as stretchability, in the weft direction and the warp direction.

A spacer weft-knitted fabric or spacer warp-knitted fabric made from thermoplastic material is another embodiment of a thermoplastic textile. For example, only one layer may be thermoplastic so as to be attached to the shoe upper according to the invention. Alternatively, both layers are thermoplastic, for example, in order to connect the sole to the shoe upper.

A thermoplastic weft-knitted fabric or warp-knitted fabric may be manufactured using the manufacturing techniques for knit fabric described in the section "knit fabric".

A thermoplastic textile may be connected with the surface to be reinforced only partially subject to pressure and heat so that only certain areas or only a certain area of the thermoplastic textile connects to the surface. Other areas or another area do not connect, so that the permeability for air and/or humidity is maintained there, for example.

Designing a knitted shoe upper may involve multiple steps to determine and outline the specifications for the upper. Input may be collected from a designer, developer, various end users having very different requirements, etc. In addition, requirements for the upper may depend on use, for example, lateral sports have different requirements than, for example, running. Thus, when designing a knitted upper it may be useful to collect a list of requirements for the various zones on a shoe. Machine limitations and/or possibilities should also be considered. Knitting machines may differ in their capabilities.

Use of test methods to knits that include various stitches, yarns, knit structures and/or their combinations may allow for characterization of the properties of the knits based on properties of materials, structures, stitches used in the knit. These reference values may then be used to define or determine the factors that should be selected to create a zone having the predetermined or desired properties for that zone in the knit. In some instances, it may be necessary to rank order the priorities in order to create a priority list or a target requirements list that outlines measurable standards for the knit zones.

Zones on an upper may have predetermined characteristics to meet the needs of the user, desires of the designer, specifications of the developer and/or the requirements of a particular use. For example, zones may be defined to have a predetermined strength, elasticity, cushioning, permeability, water resistance, heat transfer capability, stiffness, and/or other desirable characteristics known in the art of shoe making.

To evaluate these characteristics, it may be helpful to define methods for evaluating these predetermined characteristics. Table 2 depicts various characteristics of interest for different zones of a shoe upper, in particular, a lightweight running shoe, as well as different metrics and/or standards for evaluating the characteristics.

Table 2 depicts characteristics of interest and methods to quantify them for a lightweight shoe:

| | | Test method | |
|---|---|---|---|
| Requirements | F/W | Textile level | Shoe level |
| HAPTICAL ASPECTS | | | |
| Cushioning | F | Thickness<br>DIN EN ISO 5084 | Shoe fit and feel<br>Athlete Questionnaire |
| Feel | W | — | Shoe fit and feel<br>Athlete Questionnaire |
| Fit | W | — | Shoe fit and feel<br>Athlete Questionnaire |
| OPTICAL ASPECTS | | | |
| Shape | W | — | Shoe fit and feel<br>Athlete Questionnaire |
| Look/Colour | W | — | Shoe fit and feel<br>Athlete Questionnaire |
| IN-USE ASPECTS | | | |
| Air permeance | F | Air permeability<br>DIN EN ISO 9237 | — |
| MECHANICAL PROPERTIES | | | |
| Weight | F | Mass per unit area<br>DIN EN ISO 12127 | Shoe Weight $m_s$<br>Shoe fit and feel<br>Athlete Questionnaire |
| Areas with special needs | F | Realised by creating different zones<br>→ Zone specific requirements | |
| Strength/ Elasticity | F | Strength/Strain<br>DIN EN ISO 13934-2 | Shoe Stability<br>High Speed Video Analy. |
| Stiffness | F | — | Energy Return<br>Shoe Torsion |

As can be seen in Table 2, for this illustrative example there are certain requirements that are fixed (depicted as "F") and others that are wished (depicted as "W"). Various industry standards may be used to evaluate properties of interest in the uppers. Table 1 lists DIN (i.e., Deutsches Institut fuer Normung) standards as representative examples for the various metrics including thickness, air permeability, mass per unit area, and strength/strain measurements, all of which are herein incorporated by reference.

Tests should be conducted in similar conditions. For example, after exposure of the samples to standard atmosphere for twenty four hours, as defined in DIN EN 139 as a temperature of 20+/−2° C. in a temperate region and 27+/−2° C. in a tropical region. In addition, the humidity of the standard atmosphere lies in a range between 61% to 69% as defined in DIN EN 139.

Due to the nature of knit and the differences in materials in the wale and row direction, tensile tests as outlined in DIN EN ISO 13934-2, used to evaluate strength and/or elasticity, should be conducted in both directions, along a wale, as well as along a knitted row. In order to maintain consistent results, testing should occur in the middle of the fabric sample to ensure that the threads of the wale or row in question are loaded evenly. Values measured to determine strength include strength at 20% elongation ("$F_{\varepsilon 20}$") and the maximum strength ("$F_{max}$"). $F_{\varepsilon 20}$ refers to the force required to reach 20% elongation of the fabric in a particular direction either along the row or the wale. $F_{\varepsilon 20\text{-}SR}$ represents the strength value along the row and $F_{\varepsilon 20\text{-}SW}$ represents the strength value along the wale at 20% elongation of the textile. $F_{max\text{-}SR}$ and $F_{max\text{-}SW}$ represent the maximum force that the fabric sample could withstand along a row or wale, respectively.

For many of the tests, multiple samples should be tested to ensure accurate calculation of average values. In some instances, 3 or more samples may be tested. For example, when testing it may be preferred to test at least five different samples in order to have a representative sample.

Factors that influence the various properties of the textile include, but are not limited to type of yarns, thickness of the yarns, thickness of fabric, stitches used, the resulting pore structure defined by the various stitches used, amount of tension, machine settings, etc. In particular, air permeability of a fabric, for example, may be influenced by a pore structure in the fabric which may be defined by the selected stitches, the thickness of the fabric, the type of yarn and the diameter of the yarn.

Shoe fit and feel may be evaluated using the following metrics as shown in Table 3.

TABLE 3

Parameters for Evaluating Shoe

| Parameters | Step-In FIT Test | Short-time Running Test | Long-Time Running Test |
|---|---|---|---|
| Test Time | 2 min | 8-10 min | ~6 weeks |
| Focus | First impression<br>Step-In comfort<br>Overall comfort | First impression<br>during use<br>Running comfort | Long term<br>behaviour<br>Occurred failures/<br>weak spots |
| Evaluation | Questionnaire | Questionnaire | Questionnaire |

Based on these tests and the requirements defined by the use, designer, and/or developer, the values shown in Table 4 in FIG. 53 were determined for an illustrative example of a lightweight running shoe.

In particular, a shoe may have zones that have predetermined properties, for example, strength, elasticity, cushioning, air permeability as shown in Table 4. As shown in Table 4, a strength zone for a shoe upper may be defined by have specific values for force at 20% elongation in both the direction of the wale and the row of greater than or equal to 30 N, as well as the maximum force that can be applied along the wale or the row of greater than or equal to 1300 N. As shown in Table 4, the desired shoe upper would have a mass per unit area of less than or equal to 750 g/m$^2$ and a thickness in range from about 1.8 mm to 2.2 mm.

An elastic zone that corresponds to the instep and/or part of the collar may be defined by the values for the properties listed under elasticity in Table 4. Here the strength properties may be reduced as is shown in Table 4, and the maximum elongation in both the wale and row directions, respectively, "$\varepsilon_{max\text{-}SW}$", "$\varepsilon_{max\text{-}SR}$", should be greater than or equal to at least 150%. Further, to meet the demands of a running show it has been determined that the maximum strength (i.e., $F_{max\text{-}SR}$, $F_{max\text{-}SW}$) needs to be greater than 300 N. However, to ensure that the shoe stretches enough to be put on a low strength value at 20% elongation is desired. As shown in Table 4, $F_{\varepsilon 20\text{-}SR}$ and $F_{\varepsilon 20\text{-}SW}$ should be less than or equal to 5 N. Thickness in this area may fall within a range from about 1.8 mm to 2.2 mm, while an air permeability should be greater than or equal to 600 mm/s.

As shown in Table 4, cushioned zones may be found in the heel and/or toe regions. Cushioned zones for the shoe defined in Table 4 should have a thickness greater than or equal to 2.5 mm. In the cushioned areas of a heel and/or toe region, as shown in Table 4, the textile will need to have a maximum strength value greater than 500 N in both the wale and row direction. Strength at 20% elongation should be greater than 10 N and the maximum strength should be greater than 500 N, in both directions.

Breathability zones as shown in Table 4 should have an air permeability of greater than or equal to 600 mm/s. Thickness of the textile in a breathability zone may be within a range of 1.8 to 2.2 mm while the weight should be less than or equal to 750 g/m$^2$ for the shoe upper defined by Table 4. The maximum strength value should be greater or equal to 100 N in both the wale and row directions.

In order to achieve the desired properties in a knitted zone, various parameters during the knitting may be controlled. In order to determine how the final properties of the knit were affected by changes in the parameters, an evaluation phase was conducted. During the evaluation phase multiple trials were conducted and in each a different parameter was evaluated for its effect on the resulting knit element.

The evaluation phase was conducted using a small circular knitting machine with four knitting systems, 192 needles, a maximum speed of 280 rpm, a diameter of 3.75 inches and a machine gauge of E16. In addition, an electronic yarn feeder having a maximum tension of forty cN and adjustable to 0.1 cN. The yarn used throughout the evaluation was 167 dtex 30 filament single ply polyester.

During the evaluation phase each parameter was evaluated individually while the other four parameters of interest were held constant at the standard machine settings as shown in Table 5 in FIG. 54.

Table 6 in FIG. 55 indicates the range of values evaluated during the trials for each of the parameters evaluated. The influence ("I") of each parameter on textile properties ("P") was calculated by determining the percent change from the default value. In particular, comparing the property value at the default value for the parameter as shown in Table 5 which outlines the default machine parameter, to the property value at the new parameter value, that is somewhere in the range of values evaluated.

$$I = \left(\frac{P_{New\ Value}}{P_{Default}} - 1\right) * 100$$

For example, the influence of the parameters on the strength in the wale ("$I_{F_{\varepsilon 20SW}}$") direction at 20% elongation would have been calculated using the following equation:

$$I_{F_{\varepsilon 20SW}} = \left(\frac{F_{New\ \varepsilon 20SW}}{F_{Default\ \varepsilon 20SW}} - 1\right) * 100$$

where "$F_{New\ \varepsilon 20SW}$" refers to the strength in the wale direction necessary to reach 20% elongation. The influence ("I") was calculated as a percentage change from the property value at the default parameter value to the parameter value being evaluated. These were then graphed for each parameter and property value so that a best-fit curve is determined as is shown in FIGS. 36-43.

For the yarn tension and the knock over depth it is important to note that the default value does not correspond to the start of the parameter range evaluated in the trials, but rather at some point within the range. For example, during the trials examining yarn tension, yarn tension is varied between 1 and 24 cN, while the default value is 6 cN. A similar situation exists for the knock over depth which is varied from 280 to 80, while the default position is 130. These starting points for yarn tension and knock over depth were chosen due to the effect of these parameters on the textile. If the interval started at the beginning for these parameters, the starting textiles would be too loose or too tight to provide relevant data.

A number of plies may be varied to change the properties of the knit. For example, utilizing an increased number of plies of a yarn within a particular area of knit may increase stiffness in that area. The number of plies used may also be related to the gauge of machine used.

Yarn tension may be controlled by a device, such as an electronic yarn feeder. In the parameter evaluation, the yarn feeder used was able to control the tension within a range from 1 to 40 cN. In general, this range may vary depending on the feeder type and/or yarns used. Further, a desired range of tension may also depend on the desired properties of the textile and the used of the textile. Adjustments in tension of the yarn during the evaluation were made in increments as low as 0.1 cN. By varying the yarn tension of the provided yarn, stitch size could be affected. Generally, the higher the tension in the provided yarn, the smaller the resulting stitch. For example, in the evaluation conducted to determine the relationship between the knitting parameters and the properties of the resulting knit, a yarn tension of the provided yarns was varied within a range from about 1 to about 24 cN by increments of 2 cN.

Stitch size was also controlled using machine settings. For example, it is possible to control the position of the needle hook at the moment an "old" stitch slides over the needle head and a "new" stitch is formed. In this knock over position, the available positions for the needle may depend on the machine used. Each machine may have machine settings which may be selected in order to influence the stitch length. For example, the Lonati small circular machine used in the evaluation has settings between 80 and 280, which result in stitch heights between 0.1 to 0.95 mm when using a single ply of 167 dtex, 30 filament polyester yarn. The machine stetting was varied from between 280 and 80, in increments of 20. A reverse order for the machine settings was chose as a lower knock over depth results in smaller loops and a stiffer fabric.

A variety of stitches may be used to create patterns in the knit element. Pattern elements may include knit loops, miss loops, tuck loops, held loops, and transferred loops. During the evaluation of the parameters, it was determined that may be desired to create textiles having at least fifty percent knit loops. The amount of tuck stitches and missed stitches was varied up to fifty percent to determine the effect of the stitch type on the properties of the resulting knit element.

FIG. 36 depicts the various parameters and their influence on the resulting strength at 20% elongation in a row direction. Along the X-axis, the legend lists the minimum and maximum values for the parameters. The Y-axis indicates the influence each parameter on a resulting textile characteristic with respect to the default value. The lines represent the best-fit curve for the influence that a parameter will have on the textile property at different values for the parameter from a minimum value to a maximum value, the values are shown in FIG. 36. The influence value graphed and indicated on the Y-axis corresponds to a percent change from a default value. The legend indicates which line refers to which parameter.

The curves for the various parameters were approximated by the equations found in Table 7 in FIG. 56. Further, Table 7 indicates the change in strength at 20% elongation that was accomplished over the range of the parameters. For example, by changing the number of plies from 1 to 5 plies of yarn, the strength of the textile along a knitted row at 20% elongation increased by 313 N in this illustrative example.

During the trials related to strength at 20% elongation in the row direction, it was determined as the number of plies increased there was an increase in the yarn strength. As the number of plies was increased linearly, the strength at 20% elongation in the row direction also appeared to be linear as is shown in FIG. 36. It appears that each ply of yarn may take a portion of the load, thus increasing the strength of the overall yarn. From all of the parameters evaluated, the number of plies of yarn used had the greatest influence on strength at 20% elongation along a row of knit for these illustrative examples.

In a similar vein, an increase in the yarn tension led to a 100% increase in strength at 20% elongation along a row. A textile having smaller loops may have more rows of yarn in a specific area when compared to a sample having larger loops. By having an increased number of smaller loops, there are more loops over which to disperse forces during the tensile test. Thus, as expected, a correlation between yarn tension and strength at 20% elongation along the row was linear.

A similar result was seen for the knock over depth. Smaller loops may as result when the knock over depth is changed. It was observed that smaller loops led to a higher strength at 20% elongation in a row direction. However, the relationship between the knock over depth and the strength at 20% elongation was not linear. In contrast, until a knock over depth of approximately 200, according to the machine settings, the curve is constant. Afterwards, a linear relationship was evident. Adjustments in knock over depth can create larger loops then can be produced by adjusting the yarn tension. Thus, loops are so large initially, that no effect was observed during the strength at 20% elongation test can be seen. At some point, the loops were smaller and the shape of the curve representing the relationship between knock over depth and the strength at 20% elongation resembled the curve representing the yarn tension.

The influence that a percentage of tuck stitches had on the strength at 20% elongation in the row was surprising. It had been assumed that as a percentage of tuck stitches increased, there would be a decrease in strength. While the curve shows a decrease at first, there is a maximum strength at 20% elongation along a row when the textile includes around 30% tuck stitches. After this point, the maximum strength at 20% elongation along the row decreases.

As the tuck stitches are straightened, they are able to take on some of load which may allow the strength at 20% elongation along the row to increase. However, above a threshold value of percent tuck stitches, the tuck stitches cause the knitted loops in the textile to be less stable. It may be that density of tuck stitches and the likelihood that tuck stitches will be in contact increases and decreases the strength.

As can be seen in FIG. 36, a change in the percentage of miss stitches affected strength at 20% elongation.

An equation that approximates each best-fit curve shown in FIG. 36, as well as the coefficient of determination for the equations are listed in Table 7.

Values for strength in the wale direction were also measured ("$F_{\varepsilon 20SW}$") which refers to the force required to reach 20% elongation. During the evaluation, it appeared that the number of plies used had the greatest effect on $F_{\varepsilon 20sw}$ of the textile as is shown in FIG. 37 and Table 8 in FIG. 57.

According to Table 8, knock over depth had a smaller effect on the strength at 20% elongation, followed by the yarn tension and the number of miss stitches which both appeared to have little impact on Fε20sw.

The number of plies, the yarn tension and the knock over depth appeared to have a linear relationship with $F_{\varepsilon 20sw}$ in the wale direction.

Controlling the yarn tension and the knock over depth allowed for the formation of a dense fabric by increasing the number of loops per unit area. Thus, an increased number of wales is tested for a similarly sized sample due to the increased density. The higher density textile is capable of handling a higher force.

Introduction of tuck stitches into a textile led to a decrease of the strength at 20% elongation in wale direction. However, when the number of tuck stitches approached the maximum (i.e., 50%) $F_{\varepsilon 20sw}$ increased. The integration of tuck stitches may lead to less points of connection of the yarns. Therefore, the strength may be reduced. When the maximum amount of tuck stitches were used, the fabrics stitch density increased.

Using and/or increasing the percentage of miss stitches did not appear to affect the strength at 20% elongation in wale direction.

Table 8 depicted the correlation equations, as well as their respective coefficients of determination.

FIGS. 38-39 show correlations between the parameter values and influence on the maximum tensile strengths of the textile.

As can be seen in FIG. 38, which corresponds to the maximum tensile strength along a knitted row, the number of plies of yarn and then the knock over depth appear to have the most influence on the maximum tensile strength of the textile given the limitations of the illustrative example. It appears that yarn tension, percentage of miss stitches and percentage of tuck stitches exhibit less influence in the maximum tensile strength along a knitted row. As can be seen in Table 9 in FIG. 58, the maximum change in tensile strength as measured is about 1340 N and resulted from varying the number of plies.

Further, Table 9 lists correlation equations for the curves, as well as the respective coefficients of determination.

During the evaluation the influence of the parameters on the maximum strength in wale direction was also determined as is depicted in FIG. 39. As is shown in Table 10 in FIG. 59, the number of plies of yarn used has the greatest influence on maximum strength along a wale direction where increases from one ply to five plies of yarn caused an increase in strength equivalent to about 1500 N.

As can be seen in the table, changing the knock over depth from a minimum to a maximum value caused a change in strength of 172 N. Values for the other parameters are listed in Table 10.

It was observed that the strength values for most of the parameters fell within expected ranges. However, when the amount of miss stitches was increased, the properties of the resulting fabric were outside of the expected values. At 50% miss stitches there was a decrease in the maximum strength along the wale. This may be due to the number of points of connection of the yarns in the final textile.

The maximum elongation for the textile samples was evaluated using DIN EN ISO 13934-2 and the resulting best-fit curves for the parameters are shown in FIGS. 40-41, along a knitted row and wale, respectively.

As can be seen in Table 11 in FIG. 60, along a knitted row, a maximum change in the percent elongation occurs when the knock over depth is adjusted within the range specified. As the knock over depth changes along the range from 280 to 80, the stitch size decreases. Smaller stitch sizes may lead to less elongation along the knitted row, as was observed here.

As can be seen in FIG. 40, when tuck stitches approach 50% elongation increases. However, when miss stitches are increased elongation increases at first and then decreases. It is surmised that when a few miss stitches are introduced the fabric is flexible, as the number of miss stitches increases so does the density which may reduce potential movement of the yarns.

The relationships between the parameters and the maximum elongation in the wale direction is shown in FIG. 41. From the $\Delta\varepsilon_{max}$ values, it appears that an amount of missed stitches and the knock over depth have the most influence on the properties of the textile as can be seen by the $\Delta\varepsilon_{max}$ values listed in Table 12 in FIG. 61.

Further, Table 12 shows the correlation equations and coefficients of determination for the parameters.

The effects of the parameters on mass per unit area were evaluated using the DIN EN 12127 test standard. Influence of the various parameters on the mass per unit area of textile is shown in the best-fit curves of FIG. 42.

As depicted in Table 13 in FIG. 62, the greatest change in mass per unit area of the textile was shown when the plies of yarn increased from 1 to 5 with a change of 430 g/m$^2$. In addition, as the knock over depth setting was changed from 280 to 80, the change in mass per unit area of the resulting textile changed by 70 g/m$^2$. Changes to yarn tension, amount of tuck stitches and the amount of miss stitches showed a smaller influence on the mass per unit area values of the resulting textiles.

Influence of the various parameters on the thickness of the resulting textiles is shown in FIG. 43 as was evaluated using DIN EN ISO 5084. During the evaluation, it was observed that the amount of tuck stitches and the amount of miss stitches have the highest influence on the textile thickness as can be seen in Table 14 in FIG. 63.

Changes to yarn tension and the knock over depth created no visible effect in the resulting textile. As expected, by increasing a number of plies the fabric thickness increased.

As is depicted in FIG. 43, increasing the amount of miss or tuck stitches up to 25% increased the textile thickness. However, the textile thickness decreased between 25 to 50%. These observations may be the result of the positioning of the stitches. A textile that includes only knit loops will have a relatively smooth surface. By adding miss and/or tuck stitches the surface of the textile may become irregular and therefore the thickness increases. However, as the number of miss or tuck stitches increases, the fabric may become regular again if the stitches miss or tuck stitches are evenly distributed, as was the case in the evaluation. Thus, for example, when the textile includes 50% miss or tuck stitches, the textile had a relatively smooth profile and a decreased thickness.

Textile samples were evaluated for air permeability using DIN EN ISO 9237. Influence of the various parameters on the air permeability of the textiles is shown in the best-fit curves depicted in FIG. 44. As is shown in Table 15 in FIG. 64, the knock over depth appears to have the most influence on the air permeability with a change in air permeability across the range of knock over depths of 4800 mm/s.

The influence of all of the evaluated parameters was shown to be linear as is depicted in FIG. 44.

All parameters had a linear influence on the air permeability.

The information collected during the evaluation was compiled and Table 16 was generated to provide guidance when determining how to design knit materials. Changes in parameters and the effect they have on the properties of the textile are clearly shown in Table 16 in FIG. 65. Table 16 allows a developer to see the relative effect of changing certain parameters on a knit.

From Table 16, it appears that a number of plies and the knock over depth have the highest influence on a number of textile properties.

Using this matrix, manufacturing parameters for the production of a lightweight running shoe upper prototype were determined. Process parameters were selected in order to meet the requirements of the shoe upper, as well as the predetermined properties of the textile and/or zones of the textile.

Generally, a shoe upper may include multiple zones to provide different properties to different parts of the shoe. For example, different levels of support and/or stretch may be needed in different parts of the upper and the resulting shoe in order to meet the requirements of a running shoe.

The data compiled during the evaluation was used create an illustrative example of a shoe upper for a lightweight running shoe.

In an illustrative example of the lightweight running shoe, the various knit parameters described herein may be varied in order to create a shoe upper. Table 17 in FIG. 66 outlines minimum and maximum values that were evaluated for use in a lightweight running shoe and to evaluate the relationship between the parameters and the resulting properties of the knit zones.

The shoe upper prototype was produced with a polyamide yarn, in particular a 2-ply, 78 dtex, 23 filament polyamide that was treated, utilizing the data from the evaluation. To ensure that yarn change did not affect the anticipated textile properties, a further evaluation was conducted. The yarns, both the PES 167F30/1, SET from the evaluation and the PA66 78F23/2, SET for the prototype, were tested for fineness and tensile properties. The resulting average strength/strain test determined that both yarns showed a maximum strength of about 520 cN. Further, it was determined that the polyamide yarn had an increased average maximum elongation by about 22%. This difference was determined to be within allowable limits. Thus, it was determined that the correlation matrix would be still be valid for the prototype yarn, PA66 78F23/2.

The knitted upper prototype was produced as a three-dimensional upper. It was desired to complete this on a single knitting machine. Thus, the knitting machine used for the prototype development was different from that used for the textile properties versus parameters evaluation. This was largely changed due to the ability of the prototype machine to close an opening on the upper. In particular, an opening proximate the toe region in the upper. Further, it was determined that the correlation results were transferable to other small circular machines. A comparison of the two machines is shown in Table 18.

TABLE 18

Comparison of Knitting Machines for Machine and Prototype Trials

| Machine | Material Trials | Prototype Trials |
|---|---|---|
| Gauge | E16 | E16 |
| Diameter | 3¾" | 3¾" |
| Knitting Systems | 4 | 1 |
| Yarn feeders per Sys. | 8 (10) | 6 (+color) |
| Max. machine speed | 280 rpm | 250 rpm |

TABLE 18-continued

Comparison of Knitting Machines for Machine and Prototype Trials

| Machine | Material Trials | Prototype Trials |
|---|---|---|
| Toe closing | no | yes |
| Plush sinkers | no | yes |

For the production prototype, the production parameters were adjusted using the correlation matrix in order to meet the requirements for the various zones. An example of these zones is depicted in FIG. 10A. Based on the requirements and target values previously determined, the target zones may be developed and the method for constructing them determined using aspects of the evaluation detailed herein. For example, zone 92 may be a strength zone which provides stability to the foot. Zone 93 may need to be elastic to ensure ease of step in. In some instances, zone 93 may replace a tongue. Zone 94 may provide cushioning in areas of the shoe that require it. Zone 95 may need to have an increased air permeability to ensure comfort for the user. Zone 96 may including cushioning. In some instances, zone 96 may require a certain level of elasticity to ensure ease of entry into the shoe, as well as fit during use.

FIGS. 10B and 10C show illustrative examples of a shoe upper 70. FIGS. 10B and 10C show the same shoe upper 70. However, while FIG. 10C shows a plurality of zones that will be described below, those zones have not been highlighted in FIG. 10C for clarity.

As shown in FIG. 10B, shoe upper 70 comprises a circular knit portion. One such circular knit portion is denoted in FIG. 10B by the reference numeral 71. However, it should be noted that the shoe upper in the exemplary embodiment of FIGS. 10B and 10C was manufactured as one piece on a circular knitting machine without joining two or more components. Hence, the location and size of the particular circular knit portion 71 in FIG. 10B is for illustration purposes only. In principle, the shoe upper 70 comprises many more circular knit portions of varying location and/or size, in particular in the toe, heel and ankle areas.

However, in other embodiments, the circular knit portion 71 may have a structural equivalent. For example, instead of manufacturing the shoe upper from a single piece of knit fabric, the shoe upper could be manufactured from different pieces joined, for example, by gluing, stitching or welding. In this case, one of these pieces could be a circular knit portion in the sense of the present invention.

In the illustrative example of FIG. 10B, the circular knit portion 71 is formed on a small circular knitting machine in one piece. Such machines have already been described in the section "knit fabric". A small circular knitting machine allows to manufacture the circular knit portion 71 in a single knitting process without any seams, that is, the result of the process is a circular knit portion having a cylindrical geometry of the size of a shoe upper. Examples of possible yarns and fibers which can be used in the context of the present invention have already been described.

As shown in FIG. 10B, the circular knit portion 71 forms a tube-like portion of the shoe upper 70. The upper is constructed from a piece of knitwear created on a circular knitting machine. In the example of FIG. 10B, a circular knit portion 71 extends from a toe area to an area just before the ankle. Further, as explained above, the circular knit portion 71 may generally have a different location and/or size in the upper. For example, the circular knit portion may extend for the entire length of the upper or for just a portion of the upper.

The circular knit portion 71 is arranged to receive a portion of a foot, that is, if a wearer would insert a foot into the shoe upper 70, all or a portion of the foot would be surrounded by the circular knit portion 71. In the example of FIG. 10B, the circular knit portion 71 would cover the entire instep, part of the medial and lateral side, a rear portion of the toes and most of the sole.

The shoe upper 70 of FIGS. 10B and 10C is entirely manufactured on a small circular knitting machine, in other words, the toe portion and the heel and collar portion of the shoe upper 70 are knitted in one piece together with the circular knit portion 71. It should be noted, that generally, those pieces could also be manufactured separately and then joined, for example, by stitching, gluing or welding. It is also possible that for example the toe and heel portions are not manufactured by knitting, but rather by a different process, for example weaving, molding, or other processes known in the art.

The circular knit portion 71 (shown on FIG. 10B) comprises at least one circular row. One such row is exemplarily marked by a dotted line and denoted by the reference number 72 in FIGS. 10B and 10C. However, it should be noted that in the example of FIGS. 10B and 10C, the circular knit portion 71 comprises a number of further rows which have not been marked or denoted. As such, the row 72 is an example only to illustrate the invention. As can be seen in the example of FIGS. 10B and 10C, the row 72 is essentially perpendicular to a longitudinal axis of the shoe upper, for example, the row follows the circumference or perimeter of the circular knit portion 71.

In some instances, the upper could be configured so that the row is positioned in an alternate arrangement with respect to the longitudinal axis. However, by positioning a row of stitches such that it follows the circumference of the circular knit portion, the upper provides more flexibility to adjust the knit along the length of the foot. Stretch is greatest in the knit along a row. In general, there is less stretch along a wale. Thus, stretch may be greatest around the foot using the current configuration allowing for a better fit.

The row 72 comprises a first section 73 and a second section 74 as shown in FIG. 10C. In the illustrative example of FIG. 10C, the first section 73 is arranged on a lateral side of the shoe upper 70 and the second section 74 is arranged on an instep portion of the shoe upper 70. However, it should be noted that in the context of the present invention the first section 73 and the second section 74 could also be located in different portions of the shoe upper. Also, in the illustrative example of FIG. 10C, the first section 73 and the second section 74 are adjacent. However, it is also possible that the first section 73 and the second section 74 are not adjacent.

In the illustrative example of FIG. 10C, the number of plies in the first section 73 is different than the number of plies in the second section 74. Specifically, in the illustrative example of FIGS. 10B and 10C, the number of plies in the first section 73 is higher than in the second section 74. For example, in one instance five plies of a base yarn, one ply of an elastic yarn and one ply of a plating yarn have been used in the first section 73. In the second section 74, two plies of a base yarn, one ply of an elastic yarn and one ply of a plating yarn have been used. By varying the number of plies of a particular yarn in different sections, effect of the properties of that yarn may be controlled in the sections such that sections may be created having particular predetermined properties. In the example described above, the number of plies of base yarn is increased in the first section 73 over second section 74, thus, the properties of the base yarn may have a greater effect in section 73.

The circular knit portion 71 comprises a number of rows with corresponding first and second sections. Zones 75A, 75B, 75C, 75D and 75E formed in the shoe upper 70 may define areas having particular predetermined properties. For example, the needs of the user, the requirement of the use (e.g., lateral sport), and/or the desire of the designer and/or developer may affect the selection of the predetermined properties for any given zone. which are described in the following.

Zones may be designed to meet specific predetermined properties. For example, Table 19 in FIG. 67 lists average benchmark values that may be of interest in the various zones.

As shown in FIG. 10C, row 72 has two sections. The first section 73 of row 72 forms part of the zone 75A, while the second section 74 forms part of the zone 75B. Zone 75A is a zone on the lateral side and medial side (not visible in FIGS. 10B and 10C) of the shoe upper 70. Zone 75A of a shoe provides support to the foot, in particular in an athletic shoe, in order to ensure that the shoe remains on the foot during activity, for example, while running, and further provides lateral support. Therefore, a high stiffness is desired, in particular to reduce the amount or even eliminate the need for reinforcements which is usually achieved through the application of additional components or coatings.

Utilizing an increased number of plies of a yarn within a particular area of knit may increase stiffness in that area. In some instances, a high stiffness is provided mainly by an increased number of plies. A number of plies used may also be related to the gauge of machine used. For example, small gauge needles may limit the number of plies of yarn that can be used at any given needle location.

Yarn tension may be controlled by a device, such as an electronic yarn feeder. In some instances, a yarn feeder may allow for tension in the provided yarn to be in a range from 1 to 40 cN. This range may vary depending on the use of the textile and the materials used to create the textile. Adjustments in tension of a yarn may be made in increments. In particular for the electronic yarn tensioners used to evaluation the parameters, the increments could be as low as 0.1 cN. By varying the yarn tension of the provided yarn, stitch size may be affected. The higher the tension in the provided yarn, in general, the smaller the resulting stitch. For example, a yarn tension of the provided yarns was varied within a range from about 1 to about 24 cN while knitting the textiles used to conduct the parameter evaluations.

Stitch size was also controlled using machine settings. For example, it is possible to control the position of the needle hook at the moment the an "old" stitch slides over the needle head and the "new" stitch is formed. In this knock over position the length of the knock over depth may be depend on the machine used. Each machine may have machine settings which may be selected in order to influence the stitch length. For example, the Lonati small circular machine used to create the illustrative example of FIGS. 10B-C has settings between 80 and 280, which result in stitch heights between 0.1 to 0.95 mm when using 167 dtex, 30 filament polyester yarn.

A variety of stitches may be used to create patterns in the knit element. Pattern elements may include knit loops, miss loops, tuck loops, held loops, and transferred loops. In the illustrative example of FIGS. 10B-C it was determined that may be desired to create textiles having at least fifty percent knit loops. Knit patterns may include a variety of stitch types to generate the desired properties in the knit.

In an illustrative example of a shoe upper, shown in FIG. 10A, zone 92 provides stability. Further, it may allow the upper to "secure" the foot close to the sole. This may be accomplished, in whole or in part, by increasing the number of plies of yarn in these areas. For example, in one illustrative example, five threads (i.e., plies) of a nylon yarn, in particular, PA66 78F23/2 SET(rd), were used in zone 92. In addition, this illustrative example, included the use of an elastic yarn plated together with a nylon yarn (1× PA66 118f30/1-Covered Lycra®). Due to using a circular production process, for ease of production plated yarns including an elastic yarn were included in zone A is this example. If the plated elastic yarn would have been put only in zone 93, the yarn would have had to been cut. Cutting the yarn would reduce the force that zone 93 could have withstood. In some instances, a cut yarn may be forced out of the fabric.

Inclusion of a plating yarn, such as a nylon or polyamide yarn, may allow for a cleaner integration of a specialty yarn, such as the elastic yarn or any yarn having a desired and/or predetermined property for use in a particular zone. In particular, this may be necessary where yarn types are changed from one zone to the next. The plating yarn may help to maintain consistency from one zone to the next.

In this particular illustrative example, the knock over depth was set to 100 to ensure efficient production. While the best strength results are achieved when the knock over depth is set to 80 on the machine used for production of the illustrative example, this setting may increase a likelihood of errors and/or downtime during production. In was found that by setting this particular machine to 100 for knock over depth when using multiple plies of yarn production may be improved.

During the parameter evaluation process and production of the illustrative example, it was found that the yarn tension had limited influence on the maximum strength. Thus, the yarn tension was set to 8 cN for the polyamide yarn and 3 cN for the elastic yarn.

It was found that higher values for knock over depth and yarn tension resulted in needle breakage. Further, while higher percentages of miss stitches led to an increase in strength of the textile along a row, it decreases strength along a wale. For tuck stitches, it was observed that strength characteristics increased along a row up to about 25% tuck stitches. Thus, it was determined that for this illustrative example, the stitch pattern included 25% tuck stitches, 25% miss stitches, and 50% knit stitches.

The specific parameters for zone 92 in the illustrative example of FIG. 10A are shown in Table 20 in FIG. 68.

Zone 93 of the illustrative example shown in FIG. 10A provides an elastic zone. This zone may allow for easy access of the foot to the shoe. As can be seen in Table 21 in FIG. 69, the number of threads (i.e., No. of plies as shown in Table 21) supplied to the feeder in this section has been reduced. Further, the knock over depth has been increased to a value of 150, thereby generating larger stitches. This may increase elasticity along a row and may in some instances reduce elasticity along a wale. Tuck stitches were used at 25% in order to improve elongation along the wales.

For zone 94 in the illustrative example shown in FIG. 10A, it was desired to create a zone having both cushioning and support, in particular for the toe and heel areas. To achieve this plush stitches were used. Other parameters were adjusted to ensure that the necessary stability was provided as can be seen in Table 22 in FIG. 70.

In particular, the number of threads (i.e., plies in Table 22) of yarn were modified to three polyamide base yarns and 1 polyamide plating yarn, each yarn including 2 plies. For example, three polyamide 66 yarns having 2 plies of 78 dtex and 23 filaments were used as the base yarn, while the plating yarn included a single yarn having two-plies of polyamide 66 with 44 dtex and 13 filaments. In zone 94, the tension was increased to 14 cN. The increased knock over depth of 250 may have enhanced the production of the ply structure.

Zone 96 in FIG. 10A depicts a collar region of the upper. Collar regions generally must be elastic. Further, it is often desirable for a collar to have cushioning. Zone 96 was designed to incorporate a textile having both elastic and cushioning properties. The particular parameters used to produce Zone 96 are listed in Table 23 in FIG. 71.

As is indicated in Table 23, one ply of elastic yarn was included in zone 96 and plated with a yarn that include 2 plies of 44 dtex 13 filament polyamide. The base yarn was used as 2 threads (i.e., No. of plies as shown in Table 23) where each yarn included 2 plies of 78 dtex, 23 filament polyamide. The knock over depth was increased to L250 to help accommodate the production of plush structures. Miss structures were used in the knit pattern of zone 96 at 50% to help provide the necessary elasticity for the collar region.

Zone 95 of the illustrative example requires a textile exhibiting high permeability to air. The production parameters selected for this zone are shown in Table 24 in FIG. 72.

Use of an open knit structure allowed for additional permeability in this zone. As is shown in Table 24, the knit pattern included both knit and tuck stitches alternating. Further, in this zone, one row is knit using 2 threads of polyamide yarn (i.e., PA66 78F/23/2 SET (rd.)) and the next row is knit with a monofilament of polyamide (i.e., PA66 60F/1/1 monofil (rd.)). By alternating the materials from row to row the resulting knit structure was more open. The monofilament yarn is listed in Table 24 as the plating yarn, however, it is not plated in the manner of the illustrative example of FIG. 10A, but rather is a secondary base yarn.

Values for the various properties of zones 92, 93, 94, 95 are depicted in Table 25, along with the stated goal value that was determined necessary based on the requirement list for the shoe.

TABLE 25

Textile Properties of the Various Zones

| | | Zone 92 | | Zone 93 | | Zone 94 | | Zone 95 | |
|---|---|---|---|---|---|---|---|---|---|
| Textile Property | Units | Goal | FIG. 10A | Goal | FIG. 7A | Goal | FIG. 10A | Goal | FIG. 10A |
| Strength ($F_{\varepsilon 20\text{-}SR}$) | N | ≥30 | 30 | ≤5 | 5 | ≥10 | 6 | — | — |
| Strength ($F_{\varepsilon 20\text{-}SW}$) | N | ≥30 | 44 | ≤5 | 6 | ≥10 | 11 | — | — |

TABLE 25-continued

| Textile Properties of the Various Zones | | | | | | | | | |
|---|---|---|---|---|---|---|---|---|---|
| | | Zone 92 | | Zone 93 | | Zone 94 | | Zone 95 | |
| Textile Property | Units | Goal | FIG. 10A | Goal | FIG. 7A | Goal | FIG. 10A | Goal | FIG. 10A |
| Max Strength ($F_{MAX\text{-}SR}$) | N | ≥1300 | 1925 | ≥300 | 500 | ≥500 | 418 | ≥100 | 256 |
| Max Strength ($F_{MAX\text{-}SW}$) | N | ≥1300 | 1671 | ≥300 | 692 | ≥500 | 566 | ≥100 | 94 |
| Max Elongation ($\varepsilon_{MAX\text{-}SR}$) | N | — | — | ≥150 | 245 | — | — | — | — |
| Max Elongation ($\varepsilon_{MAX\text{-}SW}$) | N | — | — | ≥150 | 178 | — | — | — | — |
| Mass per Unit Area | $g/m^2$ | ≤750 | 797 | ≤750 | 300 | ≤750 | 456 | ≤750 | 121 |
| Thickness | mm | 2 ± 0.2 | 1.98 | 2 ± 0.2 | 2.13 | ≥2.5 | 3.25 | 2 ± 0.2 | 1.84 |
| Air permeability | mm/s | — | 118 | ≥600 | 1016 | ≥600 | 686 | ≥600 | 5943 |

Values for the textile properties for zones 92, 93, 94, 95 are depicted in FIGS. 45-47. In FIG. 45, the maximum strength values along both a row and a wale are shown. The maximum strength results along the row are shown in the darker columns. Thus, the maximum strength values along a row for zone 92 are shown in column 4202, while the maximum value along a wale is shown at column 4204. Further, the maximum strength values for zones 93, 94, 95 along a row are depicted at columns 4206, 4210, 4214 and along a wale are depicted at columns 4208, 4212, 4216, respectively.

The mass per unit area target value was achieved for zones 93, 94, 95 (see columns 4304, 4306, 4308, respectively) while being slightly exceed in zone 92, column 4302, as can be seen in FIG. 46.

Air permeability values 4402, 4404, 4406, 4408 for zones 92, 93, 94, 95 are shown in FIG. 47. The values for all zones fell within their respective zone targets as can be seen in Table 25.

In the illustrative example, shown in FIGS. 10B and 10C, the base yarns and the plating yarns are fed to the knitting needles with a tension of 8 cN. The elastic yarn is fed with a tension of 3 cN.

Tension of elastic yarn during the knitting process may be lower in order to ensure that the elastic yarn does not break during the knitting process. Further, in some instances, a high tension on the elastic yarn might impede the final product to keep its shape as it would shrink under its own internal tension.

As depicted, the knitting pattern in the zone 75A includes a knitting structure known as "FELPA". For example, the knitted stitches within the FELPA knitting pattern may include 50% knit stitches, 25% miss stitches and 25% tuck stitches. Any configuration of stitches could be used here with the same 50% knit, 25% miss, and 25% tuck stitches ratio. In some instances, the ratio of these structures can be amended to provide different predetermined physical properties of the knit element.

In some instances, FELPA may be used to impart strength around the circumference which was determined during the evaluation described herein. A pique knitting structure may be used where elastic behavior is required since during the evaluation process a pique knitting structure showed elastic behavior around the circumference of a small circular knit portion. A jersey structure may be used in in heel and/or toe areas to in order to utilize selective knitting and holding of stitches to shape the heel and/or toe areas on the machine used.

Physical properties of a knit portion may also be controlling the height of stitches. For example, by adjusting or removing a sinker the height of the stitches can be adjusted. The sinking of the knitting needles may be controlled using machine settings. As an example, machine settings as outlined in Lonati L 130 (hereinafter referred to as "L130") may be used to adjust the height of stitches. Due to this small sinking, small loops are created which improves the stiffness even further.

The second zone 75B is mainly located on the instep portion, but also extends partly above and over the ankle. It comprises the second section 74 of the row 72 as described above. This zone needs some stretch in order to allow the step in and out of the foot, in particular as regards the collar and instep areas. Also, the collar must provide a fitting sensation. During manufacturing, in order to ensure a high stretch in this illustrative example, only 4 yarns are knit together, namely, two plies of Nylon yarn, one ply of elastic yarn and one ply of plating yarn of a polyamide yarn (e.g., Nylon). A larger stitch size is used than in zone 75A, Lonati L 150. The knitting pattern used in zone 75B is a Pique knitting structure, formed from a combination of 75% knit stitches and 25% tuck stitches. The resulting knit structure is lightweight because of the few yarns used and also breathable.

In this illustrative example, the resulting material characteristics in zone 75B include a stitch count of 95 per $cm^2$, a weight of 300.4 $g/m^2$, an air permeability of 1016 mm/s, a strain of 245% at 500 N stress for a row and 178% at 692 N for a wale.

In another example, elastane yarn may be used in zone 75B or generally in the instep area of a shoe upper according to the invention. Elastane yarn may be used as pure elastane, in combination with a staple fiber, such as polyester, or as a plating yarn.

Zone 75C is located on the toe and heel portion of the shoe upper 70. During manufacturing of this zone, four yarns are knit together, namely, three plies of base yarn of Nylon and one ply of plating yarn of Nylon. A larger stitch size is used than in the area 75A and 75B, namely, Lonati L270 in the heel and Lonati L130 in the toe portion. In some instances, using a relatively thick plating yarn and a higher height of stitches, may result in the material thickness being higher in these areas in order to provide for cushioning. Selection of stitch type may also affect the properties of the final textile. For example, in zone 75C a plush knit structure may be used which may affect, for example, a weight of the material and/or the air permeability of the zone. In some instances, the plush knit structure may result from the use of special sinkers used for plush structures.

In this illustrative example, the resulting material characteristics in zone 75C include a stitch count of 62 per $cm^2$, a weight of 456.4 $g/m^2$, an air permeability of 686 mm/s, a strain of 403% at 418 N stress for a row and 285% at 566 N for a wale.

As can be seen, in the midfoot portion it is possible to create different structures on a same row. In particular, for each stitch, the needle may be able to select between two to five plies of base yarns in order to vary the stiffness and stretch. It should be noted that the number of possible plies of base yarns is specific for this embodiment and that the invention is not limited to these exemplary number of plies or yarns. Also, Nylon is used in this illustrative example as base yarn. However, the base yarn can be made from other materials as well.

Zone 75D is the collar of the shoe upper 70. Four plies of yarn are used in this zone, namely, two plies of base yarn, one ply of elastic yarn and one ply of plating yarn. The tension used for the base and plating yarn is 8 cN and for the elastic yarn 3 cN. The pattern used in zone 75D is 1×1 rib and the sinking of the needles (stitch size) is Lonati L250 inside the collar and L100 outside. The combination of elastic yarn and a 1×1 rib pattern provides for the necessary stretch in order to ensure an easy step-in and step-out of the shoe. Additionally, a plush structure is added inside the collar to provide some padding.

Tension in the yarns may be controlled to control the properties of the knit. In general, a higher yarn tension, for example for an elastane material, may result in a denser structure with more elastic effect in it. Utilizing a higher tension in a yarn, in particular an elastic yarn may allow for more compression and/or recovery properties.

Zone 75E is the front top area of the shoe upper 70 above the toes. As this zone needs to be breathable, an open knit structure is used in this area. To do so, only three plies of yarn are used during knitting this zone, namely, two plies of base yarn and one ply of secondary yarn which is very fine to create the open structure. The knit structure includes two tuck stitches followed by two knit stiches repeated every two rows. This results in a structure that includes approximately 50% knit stitches and 50% tuck stitches. The resulting weight is very low and the breathability is particularly high.

In the illustrative example of zone 75E defined above, the resulting material characteristics in zone 75E include a weight of 121.2 $g/m^2$, an air permeability of 5943 mm/s, a strain of 193% at 256 N stress for a row and 136% at 94 N for a wale.

In some instances, the number of yarns or plies may be varied along a row in order to provide specific predetermined characteristics to a part of the upper. For example, in an instep portion fewer plies may be used to allow for more stretch than along the medial & lateral sides. In another configuration, the number of plies or yarns may be reduced in a flex zone in the forefoot to allow for increased flexibility and stretch when compared to a midfoot region. Further, stiffness of a section of an upper may be increased by adding additional plies. For example, in a toe region more plies may allow for a stiffer construction that would have less stretch.

In other embodiments (not shown in the figures), the shoe upper comprises two layers, namely, an inner layer and an outer layer. The inner layer may be more technical, while the outer layer may be knit with a method providing a good look, a good quality fabric, flexible design possibilities, etc. Nonetheless, in some embodiments, each layer may have a technical function, alone or in combination with the other layer.

The two layers may be bonded to each other. The internal layer may comprise a melt yarn on the outer face and/or the outer layer may comprise a melt yarn on the inner face. The two layers may then be bonded to each other by application of heat and/or pressure. The two layers may be attached to a last when doing so, in order to ensure that the bonding is made with each layer in the right position relatively to each other.

A layer may comprise melt yarn only in some areas where it is desired to lock one layer relatively to the other layer. In the same manner, some areas of each layer may be devoid of any bonding between each other in order to ensure the possibility of a local relative movement between the two layers. Such technique may also be used to form pockets in which an intermediate component may be placed.

In some embodiments, an additional layer of a low-temperature melting layer may be added between the two layers to bond them to each other through pressure and heat.

Also, additional elements may be added between the two layers. For example, a waterproofing layer, a padding, a reinforcement or similar may be added.

FIG. 11 is an illustrative example of a shoe 80 according to the invention. The shoe 80 comprises a shoe upper 70 as described with respect to FIGS. 10B and 10C and a shoe sole 81 attached thereto. The shoe upper 70 is directly joined to an upper surface of the shoe sole 81, that is, without an intermediate layer in between. To this end, the upper surface of the shoe sole 81 comprises melt material which softens and/or melts by the application of heat and optionally pressure. The shoe upper 70 may be lasted when pressed to the shoe sole 81 to provide for a uniform application of pressure. As the shoe upper 70 is directly joined to the shoe sole 81, the shoe 80 does not comprise a strobel sole.

The shoe upper 70 of the shoe 81 of FIG. 11 does not comprise laces, that is, it is a laceless shoe. This is made possible by the invention which allows to provide the shoe upper 70 with the necessary support and stiffness at the medial and lateral side by adding a sufficient number of plies of yarn. By using less plies in the instep area of the shoe upper 70, the stretch (i.e., elasticity) is increased to allow for an easy donning of the shoe.

FIG. 12 is another illustrative example of a shoe 80 according to the invention. The shoe upper 70 and the shoe sole 81 of this embodiment are similar to FIG. 11. However, compared to the embodiment of FIG. 11, the shoe upper 70 of FIG. 12 does comprise laces 91. To this end, eyelets are directly provided during knitting the shoe upper 70 by controlling the knitting machine correspondingly. The area of the eyelets is additionally reinforced by a coating as described herein. In some instances, yarns may be selected for the areas of the eyelet such that they are capable of providing support to the eyelet.

Eyelets may be created during the knitting process, for example, by transfer stitches or held stitches. In some instances, one or more stitches may be held for a number of rows to create an area with the yarns can be pushed to the side to create an eyelet. For example, yarn may be held on two stitches for four knitted rows (i.e., four consecutive revolutions). The number of stitches held and the number of revolutions for which they are held may vary depending on the predetermined size of the hole. In some cases, eyelets may also be cut out of knitted material. Alternatively or additionally, reinforcement material may be added (by knitted-in yarn or by secondary application) and then the eyelet is created by punching or cutting through the combination of materials to create the opening.

The shoe upper 70 of the embodiment of FIG. 12 also comprises a collar 92 which is generated during the knitting process. After knitting a first row (or more rows), the loops are transferred to a dial which holds those knitted loops while the machine continues to knit the main inner portion and then the outer portions of the collar before the knitting machine picks back up the parked starter rows of knit structure and then continues to knit the main body of the upper. In some instances, a terry knit structure may be used on the inner surface of the collar which after completion creates extra loops of yarn which add a bit of softer or padding-like structure to the collar region.

FIG. 13 depicts a material map for a shoe according to yarn carriers used. Each section depicts a different zone on the shoe in which the yarns are delivered by one or more different yarn carriers. Zones may include different materials and/or different knit structures or elements.

In FIG. 13, zones 1310, 1312, 1314 include a melt yarn. For example, in an illustrative example, zones 1310, 1312, 1314 include a blended yarn of polyester and melt yarn plated together with a melt yarn. In some instances, the melt yarn may have a melt temperature of less than about 100° C. For example, a copolyamide yarn with a melt temperature of about 85° C. may be used as is the case in the illustrative example of FIG. 13.

The yarns in each zone 1310, 1312, 1314 are provided to the upper by separate feeders in order to optimize flexibility of positioning of yarns in the upper. By providing the yarns using separate feeders, zone 1314 can be positioned between zones 1310, 1312 without the necessity of having extended floats between zone 1310 and zone 1312. Use of individual feeders for particular zones allows the yarns to be limited to those zones, thereby reducing cost due to, for example, a reduction in the amount of yarn necessary to create the separate zones. In the illustrative example, zone 1314 includes elastic yarns in an area of the shoe upper that corresponds to the instep of the foot.

The toe region of the upper includes one or more plies of a blend non-elastic and elastic fibers. For example, zone 1316 includes two plies of a polyester fiber and an elastic polyurethane fiber (e.g., Lycra®) blended together. These plies are combined with a further ply of polyester to knit zone 1316.

In sections requiring stability, such as a heel, yarns having less elastic properties and/or yarn capable of being fixed may be used. In particular, polyester fibers may be combined with melt yarns. For example, in FIG. 13 zone 1318 surrounding the heel and the underside of the foot are knit using a blend of polyester fiber and low melt temperature copolyamide and a ply of blend of polyester fiber and an elastic polyurethane fiber.

Zone 1320 which forms a collar on the upper, elastic yarns are used in order to meet the predetermined properties needed for the collar. For example, in a collar element stretch and recovery properties are very important to maintain proper fit, thus yarns having elastic properties, such as polyurethane fibers may be used. To control the stretch and recovery properties, the thickness of the plies, the number of the plies, and/or the other materials used in the collar element may be controlled. For example, a collar element may include multiple plies of an elastic yarn, in particular a polyurethane (e.g., Lycra®, spandex). In an illustrative example, three plies of an elastic polyurethane yarn are used in the collar of FIG. 13.

In some instances, the zones of FIG. 13 may be created using other combinations of yarns, or even limited to one type of yarns. For example, it might be desirable to reduce the number of materials. It may be desired to have an upper constructed from one material to allow for easy recycling. In particular, thermoplastic polyurethane may be selected to create the knit along with other elements of the shoe. The properties of the zones in the knit material may be controlled by changing the number of plies of yarns in the different zones. For example, stretch might be reduced where plies are increased are relative to areas that require stretch. In addition, energy, for example, heat may be selectively applied to the upper to create zones of limited stretch and/or stability. In these zones of controlled stretch and/or stability, heat may melt a portion of the yarn which them creates fixation points within the knit structure, thereby reducing stretch.

In some instances, yarns of the upper shown in FIG. 13 may include primarily a thermoplastic polyurethane yarn. The number of plies of this yarn may be controlled in various zones of the upper in order to create predetermined properties for the various zones. Further, the upper may be treated with processes in order to create zones of predetermined properties. For example, energy may be provided to specific zones to melt a portion of the yarns thus creating areas of fixation. In particular, heat may be selectively applied to areas requiring additional stability, for example, the heel region and/or the toe region. Further, an amount of heat may be controlled such that an amount of heat provided may be varied from either region to region or predetermined area to predetermined area. This control of the supplied heat may allow for zones to have different amounts of stability, for example, by providing more heat to a heel region, the heel region may provide more stability than the toe region of the upper. By combining the variation in the number of plies of yarns with selective provision of energy (e.g., heat) an upper may be created having zones of different predetermined characteristics (e.g., stability and/or stretchability) from a single type of yarn, for example, a thermoplastic polyurethane yarn. An upper created in this manner may be combined with a midsole and/or outsole formed using thermoplastic polyurethane to create an easily recyclable shoe.

Figure 14A:
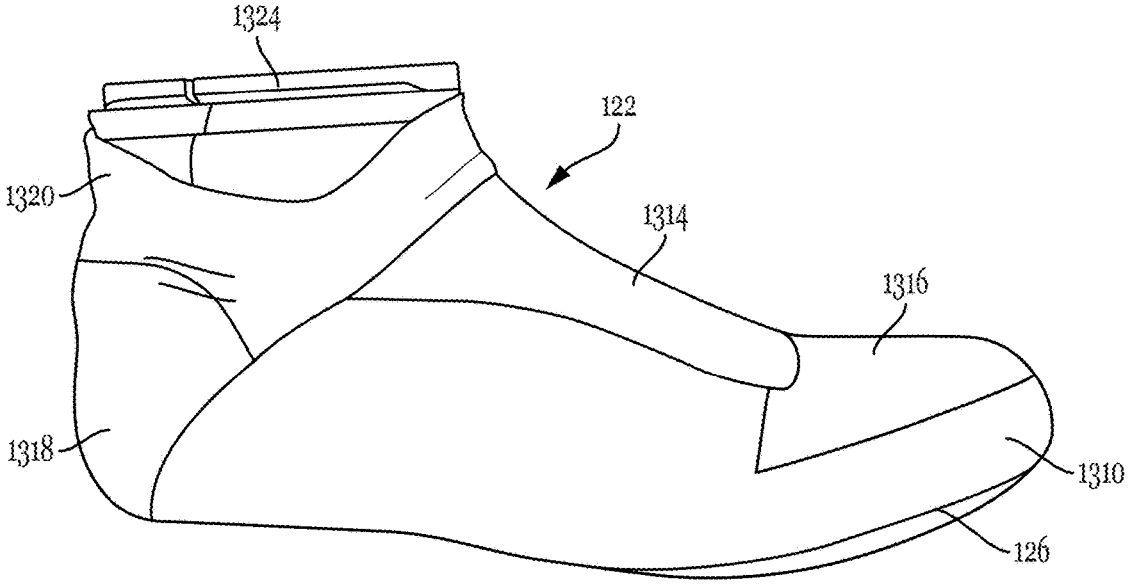

FIG. 14A depicts a single layer upper 122 on last 1324. Upper 122 includes multiple zones 1310, 1314, 1316, 1318, 1320. The illustrative example of upper 122 depicted in FIG. 14 was created on a small circular knit machine creating an elongated hollow knit element. In general, one opening would be used to create the collar element 1320 and the second opening would be closed in some manner in the forefoot or toe region. In the illustrative example, shown in FIG. 14A, this closure is not apparent.

Figure 14B:
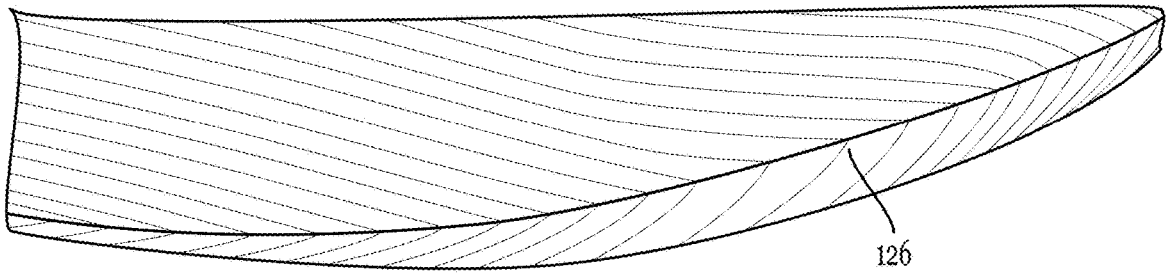

As is shown in FIG. 14B there is a knitted juncture line 126 where the direction of the knitted rows changes. For example, in upper region 146 a plane through an individual row is substantially perpendicular to the longitudinal access of the shoe. However, in at least a portion of sole region 144 the knitted rows appear to be rotated relative to the rows in upper region 146. A majority of the rows in sole region 144 appear to be offset from the rows in upper region 146.

An upper for an article of footwear may be knit in a manner similar to a sock. Use of a machine knitting sequence as depicted in FIG. 35, in combination with use of blended yarns, and knitting on a small circular knitting machine may result in an upper having many predetermined zones having specific properties. The knitting sequence 748 depicts various sections of the upper including leg section 750, heel section 752, foot section 754, and toe section 756. Each section may include different types and/or numbers of stitches, yarns, and/or plies of yarn. As depicted in FIG. 35, knitting may begin in leg section 750. As can be seen in the machine knitting sequence, stitches appear to be knit along the majority of the cylinder such that an elongated hollow knit structure would be formed. In heel section 752, selective knitting and holding of stitches occurs to generate shape. By selective knitting and holding stitches, rows of various lengths are formed which for example, at needle position 758 at row 760, stitch 762 is held. Knitting continues in subsequent rows at needle positions in a smaller portion of the cylinder. Needle position 758 is knit again at row 766 where stitch 764 is coupled to stitch 762. In foot section 754 needle positions are knit at in a regular manner along the cylinder. In toe section 756, selective knitting starts again. At needle position 758 on row 768 stitch 774 is held. Needle position 758 is then knit again at row 772 at stitch 770. An opening (not shown) is created in toe section 756 by knitting at most positions, if not all, along the cylinder in section 776. Section 776 may encompass two or more knitted rows to form the opening.

This configuration may be highly customizable. Further, the use of blended yarns may greatly reduce processing time by reducing the number of yarns needed to knit. For example, an upper may be created having zones for the collar, the heel, toe, instep, sole, among others. Further, these zones may include subsections where specific properties are desired.

Use of blended yarns along with placement of the yarns in a manner such that a number of plies may vary in the zones and/or subsections may allow for creation of an upper using a minimal number of yarns that has specific predetermined properties that is produced in less time than a similar upper produced in a conventional manner.

Thus, processing times for the knitted upper may be greatly reduced. For example, an upper knitted as depicted in FIG. 35 may be knit in less than about four minutes. An opening (not shown) in the upper created in toe section 756 may be closed in less than one minute. Closing the opening may include stitching, welding, linking, adhesive and/or combinations thereof. Shaping of the upper may occur in about one minute. Addition of a sole may be completed in less than about 5 minutes.

For example, a single layer sock construction having multiple zones as shown in FIG. 35 with predetermined properties that vary from zone to zone may be knit in about 4 minutes. The closure seam may be formed at the opening in about thirty seconds, for example, using a linking machine. Shaping of the upper may occur on a last by heating the knitted upper for about one minute. Finally, a soling process, for example, a direct injection process, may be completed in about four minutes. Thus, a completed shoe having a single layer sock construction, multiple zones of predetermined properties, and utilizing blended yarns may be constructed in less than about ten minutes.

Thus, it may be possible to produce a highly customizable shoe in less than about 15 minutes. In some instances, a shoe may be produced in less than about 20 minutes. Timing of production may vary based on the size of the shoe, number of yarns, number and types of stitches, complexity, number of layers, machine capabilities, operating speed, and/or design elements.

FIG. 15A depicts upper 122 on last 1324. Opening 1530 corresponds to the second end of the tubular knit element. Sole region 144 is connected to upper region 146 using knitted juncture line 126.

FIG. 15B depicts a machine knitting sequence used for the shoe depicted in FIG. 15A. As can be seen from FIG. 15B, knitting begins in the collar and continues through the upper region 146 (shown in FIG. 15A) including the heel section 151, midfoot section 153, toe section 155 and sole section 154. As shown in FIG. 15A, partial knitting is used throughout the upper to create shape.

For example, partial knitting in the sole region 144 (shown in FIG. 15A) corresponds to the machine knitting sequence in the heel section 151, upper section 152 and sole section 154 (shown in FIG. 15B). Partial knitting in the forefoot area of sole region 144 is used to create opening 1530 as depicted in FIG. 15A. Further, partial knitting is also used in portions of the upper corresponding to, for example the collar region, the instep region, and anywhere shaping is determined to be useful.

As shown in FIG. 15B, knitting begins at collar section 150. Knitting continues along the longitudinal axis of the shoe. In heel section 151, partial knitting is used to shape the heel of the shoe. At the start of upper section 152, in the midfoot section 153, it appears that knitting is occurring at all positions on the cylinder of the small circular knitting machine. As knitting progresses down the knit sequence, as shown in section 152, the active knit area on the cylinder decreases with each subsequent row. In this case, some of the stitches are held on the needles and not knit along the edges 156 shown. For example, stitch 158 is held at needle positon 162 until section 154 when stitch 160 is formed at needle position 162. By holding the stitches in this manner and continuing to knit, the knit element may be shaped using a combination of partial knitting and folding of the fabric. Due to the partial knitting in section 152 and section 154, a fold occurs in the textile at approximately the juncture line shown in FIG. 15B.

By folding at a line between section 152 and section 154, depicted as the connection of knit areas in FIG. 15B, the stitches of the two adjoining sections proximate the toe region are upside down relative to each other. The closer the stitches are to this "line of inflection", the closer the new stitches are to being upside down relative to the old stitches. The "line of inflection" for this construction refers to the point at which the stitches change direction due to, for example, a fold of the knit. As one moves away from the line of inflection, and continues to partially knit the stitches rotate approximately up to 90° from their initial position after the fold. This is a combination of folding and partial knitting creates unique geometries for a knitted upper.

FIG. 15C depicts an exploded view of the knitted junction line 161 between sections 152, 154 (shown in FIGS. 15B, 15C) at multiple stitch positions.

FIG. 16A shows an elongated hollow knit portion created on a small circular knitting machine that will be formed into a double-layer upper, having openings 232, 234 in both layers similar to opening 1530 of FIG. 15A. FIG. 16A illustrates how partial knitting, or in other words, a combination of holding stitches and selectively knitting in particular areas is used to create shape. Rows of stitches are formed having varying length are created to generate shape and/or structures in the upper. By creating rows of varying length it is possible to generate shape.

In the illustrative example depicted in FIG. 16A, knitting begins at opening 232. In some instances, this may be reversed and knitting may begin at opening 234. A combination of selective knitting, i.e., knitting in particular rows or wales, and holding of stitches is utilized to create shape in the elongated hollow knit portion so that after forming the upper and the final shoe, the upper conforms to the foot. Thus, throughout the upper the direction of the knitted rows varies.

In particular, use of the selective knitting and holding of stitches creates an upper with shaping. To create inner forefoot sole region 214 and outer forefoot sole region 216 selective knitting and holding of stitches is used. Thus, areas with openings 232, 234 are generated in the forefoot sole regions 214, 216. Edges of the openings 232, 234 are the beginning and end of the knitting process for the depicted two-layer sample. In some instances, the knit process may be reversed and the starting rows could be proximate the outer layer.

Knitting continues along the inner knit layer to the collar region 434 depicted in FIG. 16C. At the collar region the internal knit layer 202 is connected to external knit layer 204. The external knit element is a continuation of the inner knit element. During knitting, the internal and external knit elements are knit as a continuous knitted tube. Openings 232, 234 are the start and end of the knitted elongated hollow element, respectively.

Generally, when knitting footwear on a small circular knitting machine knitting begins in the collar region or in the toe region, thus there are openings at both ends of the knitted tube created by the small circular knitting machine. For example, socks knitted on a small circular knitting machine generally have a closure seam perpendicular to a longitudinal axis of the shoe upper. In some cases, this seam is visible on the top or side of the footwear.

As shown in FIGS. 15A, 16C-D, openings 1530, 232, 234 are formed in the upper such that a closure seam of the finished upper would run substantially parallel to the longitudinal axis of the upper. This change in positioning of the opening may allow the seam to be positioned in such a manner that friction between the upper and the foot is reduced. Further, the construction may allow for design freedom in the toe region 178 of the upper as the seam will be hidden on the sole. In addition, by moving this seam out of the forefoot region of the shoe there is more flexibility with shaping the forefoot. Further zones of yarns in the forefoot may be continuous rather than be interrupted by a seam.

By positioning the opening on the sole, it has been found that this construction allows increased utility of designs across a size range. Thus, designs created for one size using this construction can be used for shoes across a broad range of sizes, for example, from child to adult. In contrast, when the seam was positioned near or on the toe area perpendicular to the longitudinal axis of the shoe, multiple designs and/or patterns needed to be created to accommodate the different sizes of shoes.

As can be seen in the illustrative example of a shoe upper depicted in FIG. 16A, selective knitting and holding of stitches is used to create an elongated hollow structure 1600 which includes openings 232, 234 at either end of the elongated hollow structure. For this configuration, knitting begins at opening 232 on what will become the inner layer 202 of the shoe upper and ends at opening 234 which is on the outer layer 204 of the shoe upper. There is a folding or inflection point 208 on collar region 206. Various areas including, collar region 206, heel regions 1610, 212, sole regions 214, 216, toe regions 218, 1620 and instep regions 222, 224 are knit to form the elongated hollow structure.

FIG. 16B depicts knitting directions 226 in the elongated hollow structure. Due to the use of selective knitting and parking of needles (i.e., partial knitting), as well as folding of the elongated hollow structure, the knitting direction 226, designated by the blue arrows in the various zones of the upper, changes throughout the upper. Lines 228 shown on the upper represent the direction of the knitted row in a particular zone of the upper. As is shown in FIG. 16B, the knitting direction changes many times during knitting to create the shaped elongated hollow structure 1600 which will be formed into a double-layer knitted upper. The depicted knitting directions 226 and lines 228 are not meant to comprehensively depict all of the knitting directions or directions of knitted rows, but rather act as a representation. As can be seen in FIG. 16B the knitted rows are in a multitude of configurations.

FIG. 16C depicts images of a machine sequence for a double-layer knit upper. The sequence is split into two sections. This flat representation of a circular knitting sequence shows all needle positions in each row. However, stitches may not be made at all needle positions on all rows. By selectively controlling where stitches occur shape and design are controlled. In some instances, if a stitch occurred at a needle position in a previous row, in the subsequent row the stitch may be knit (e.g., form a loop, a tuck loop or a float loop), transferred, held, or bound off.

In the illustrative example of FIG. 16C, knitting starts at the top of sequence section 270 and continues from the top of sequence section 272. Each row of the image corresponds to a knitted row or course. In the illustrative example of FIG. 16C, each row or course corresponds to a machine movement, in this case a rotation, which may be full or partial, on the circular knitting machine. At the various needle positions stitches may be created, floated, held, and/or transferred. As shown in FIG. 16C, at needle position 406 the stitch may be held. Subsequent stitches may also be held along row 402 which corresponds to a pass of the cylinder.

As shown in FIG. 16B, knitting begins with the inner layer 202. This is depicted in FIG. 16C at the top of sequence section 270 in start section 278 with starting rows that define the opening that will be formed on the inner layer 274 that will become part of the sole region. Sole section 282 of sequence section 270 corresponds to inner forefoot sole region 214 (shown in FIG. 16A).

Knitting of the inner knit layer 274 continues through sole section 282, toe section 284, midfoot section 286, heel section 288, and collar section 290. As depicted here, the sole section includes the inner knit layer that will be positioned under the toes. Due to a combination of selective holding of stitches and selective stitches, stitches in the sole section 282 are connected to stitches in the toe section, and/or midfoot section. In some instances, stitches in the sole section may be connected to stitches in the toe section, midfoot section, and/or heel region. Depending on the predetermined shaping necessary for the shoe, these connections may vary. For example, in the illustrative example of FIG. 16C, stitches in the sole section 282 are connected to stitches in the toe section 284, and midfoot section 286. Due to the selective knitting and holding of stitches a three-dimensional shape of the upper is achieved due to, in part to folding of the knit that is the result of the stitch configuration.

In other instances, the connections between the various zones may vary to create different shaping and/or structures within the elongated hollow knit structure.

At the start section 278 it appears that knitting is occurring at all needle positions to create opening 232 (shown in FIG. 16A). Start section 278 may include multiple knit rows as depicted. As knitting progresses down the knit sequence, as shown in sole section 282, the knit area (i.e., the number of needle positions at which knitting occurs) is limited. For example, at needle position 408 stitch 412 is held. In sole section 282, selective knitting occurs in order to create shaping in the elongated hollow structure 1600. For example, at needle position 408 stitch 410 of the sole section is connected to stitch 412 of the start section at knit row 414. This selective knitting and connection between the start section and the sole section 282 creates shaping in the inner layer of the upper.

As the knitting continues, in a subsequent knit row 416 at needle position 408 stitch 418 is held. Stitch 418 is held on needle position 408 until knit row 420 where stitch 422 is made. In this manner, stitches are used to connect the various knit sections depicted in FIG. 16C forming, for example, knit juncture line 172 (shown in FIG. 16F) in outer knit layer 276 and knit juncture line 230 (shown in FIG. 16A) in inner knit layer 274. Additional knit juncture lines can be found throughout the upper wherever two rows having different orientations are connected together during knitting.

The differential in the length of the rows, as well as the selective connection of the stitches in combination with folding of the elongated hollow knit structure, creates the shape of the upper. By connecting stitches in the manner outlined above the textile is folded in the vicinity of position 285. In particular, due to the configuration of the stitch connections along the knit juncture line 230. This results in the stitches of section 282 have a different orientation from the stitches in sections 284, 286. As the fabric folds, or bends at position 285, the stitches of section 282 are upside down relative to the stitches in sections 284, 286.

By folding at position 285, depicted as the connection of knit areas in FIG. 16C, the stitches of the two adjoining sections proximate the toe region are upside down relative to each other. The closer the stitches are to this "line of inflection", the closer the new stitches are to being upside down relative to the old stitches. The "line of inflection" for this construction refers to the point at which the stitches change direction due to, for example, a fold of the knit. As one moves away from the line of inflection, and continues to partially knit the stitches rotate from their initial position after the fold. This is a combination of folding and partial knitting creates unique geometry for the knitted upper.

Thus, heel region 210 (shown in FIG. 16A) is formed using the machine knitting sequence shown in heel section 288. In particular, on needle position 408 of row 424 stitch 426 is held. At knitting row 428, stitch 426 is knitted again forming stitch 430. Needle position 408 continues to be knit for the rest of heel section 288 and collar section 290.

At the collar region 206 (shown in FIG. 16A), knitting connects the inner layer 202 to outer layer 204. In FIG. 16C, this connection occurs between collar section 290 of sequence section 270 and collar section 434 of sequence section 272. Heel section 436 is used to create heel region 212 in the outer layer 204 as shown in FIG. 16A. At the start of upper section 440 it appears that knitting is occurring at all positions on the cylinder of the small circular knitting machine. As knitting progresses down the knit sequence, as shown in section 440, the knit area on the cylinder decreases with each subsequent row. In this case, some of the stitches are held on the needles and not knit along the edges 450 shown. For example, stitch 452 is held at needle positon 448 until section 446 when stitch 444 is formed at needle position 448. By holding the stitches in this manner and continuing to knit, the knit element may be shaped using what is called partial knitting.

FIG. 16F depicts an exploded view of the knitted junction line 172 between regions of knit having different knit directions such that the knit rows of region 170 and region 174 have differing orientations. In the illustrative example of FIG. 16F the knitted rows appear to be offset by close to 90 degrees.

FIG. 16D depicts a shoe upper 201 of FIGS. 16A-B where the inner layer has been folded and inserted inside the outer layer to form a two-layer upper. In this design shown in FIGS. 16A-C, the fold occurs at the collar region 206 (shown in FIG. 16A). As shown in FIG. 16D, upper 201 has not yet been formed into a shoe. Openings 232, 234 are positioned in such a manner that they are coextensive as is shown in FIG. 16D.

As is depicted in FIG. 16E, the direction of the knitted rows differ across the upper. The changes in the direction of the knitted rows are due to partial knitting, or selectively knitting in some areas while holding the stitches in other areas. As can be seen in FIG. 16E, rows within section 170 turn from being substantially perpendicular to the longitudinal axis of the upper near row 166 to being close to perpendicular row 166 at row 173 of section 174 as is shown in FIG. 16E. The particular relationship between the rows in section 170 and section 174 may depend on the position of the stitches on the final shoe.

FIG. 16F is an enlarged view of the junction between section 170 and section 174. As shown in FIG. 16F, the rotation of the rows in section 170 cause at least some of the rows in section 170 to be perpendicular to the rows in section 174. In this manner, a knitted juncture line 172 has essentially been created at the junction of section 170 and section 174. This junction line may join stitches from different rows that extend in different directions. Configurations of the stitches connected by juncture lines may vary depending on the shaping that is desired for the elongated hollow structure to be formed in to a shoe upper 201. Further, partial knitting is used as shown in FIG. 16E to create a continuous and shaped elongated hollow knit structure and having openings 232, 234 which are at least partially coextensive.

FIG. 17A shows shoe upper 201 where openings 232 (not shown), 234 are coextensive and closed. The closure of openings may be done using stitching, welding, linking, adhesive and/or combinations thereof. In addition, in some instances a strobel board may be used either in combination with a closure as outlined above. In some instances, a strobel board may be used to create the closure alone. For example, in FIGS. 17A-B, closure 244 is a seam that closes openings 232 (not shown), 234. In FIG. 17B, strobel board 246 is visible at juncture line 248.

Yarns may vary along a row, and/or along a wale. In some instances, a first section may include yarns and/or structures which are selected to provide particular properties to an interior portion of an upper. For example, the interior portion of the finished upper may include a functional yarn, such as a thermal regulating yarn, a clima yarn, flame resistant yarn, reflective yarn, conductive yarn, or any other known in the art. The exterior portion of the knitted element may include yarns which increase durability and/or stability, for example.

In some instances, inner layer 202 as shown in FIG. 16A may include elastic portions created from one or more plies of an elastic yarn. For example, a polyurethane yarn, such as spandex, elastane, Lycra®, may be used in areas requiring substantial stretch and/or recovery properties. For example, collar region 206 shown in FIG. 16A may include multiple plies of an polyurethane yarn. In some instances, the collar region of the inner layer may include more plies of the elastic yarn than the collar region of the outer layer of the upper. In an illustrative example, the collar region on the inner layer may include four plies of an elastic yarn while the collar region on the outer layer may include three plies of an elastic yarn.

Some areas of the inner layer 202 may include portions having polyamide yarns (e.g., nylon). For example, areas that may require further processing such as separation, linking, and/or sewing may include a smooth synthetic fiber yarn, such as a polyamide yarn, a polyethylene, or a polyester yarn. A polyamide yarn may, in some instances, be used as a marker yarn. For example, a polyamide yarn may be used in an area that will be linked to ease the linking process. Use of a polyamide yarn in combination with other yarns allow the specific row of stitches to be identified when linking. Further, a smooth polyamide yarn makes the linking process easier by reducing friction when combining the yarns.

Further, a majority of the inner layer may include one or more yarns made from multiple materials. For example, a yarn with an elastic core (e.g., spandex) wrapped by one or more polyester plies may be combined with multiple plies of polyester.

FIG. 18 depicts a medial view of a shoe upper that includes an inner layer 180 and outer layer 182 attached at the collar region 176. Upper 250 includes various regions such as heel region 254, midfoot region 256, and forefoot region 258. Various zones may be created to impart specific properties to areas of the shoe upper. For example, in zone 252 which covers the instep and/or collar region 176 it may be desirable to have a stretch zone, thus, multiple plies of an elastic yarn may be used in this area. In some instances, different amounts of stretch will be necessary in a collar region than in the instep zone. Thus, materials, thickness, and/or processing may differ from one zone or region to the next. In contrast, in zone 178 which includes the toe box it may be predetermined by a designer, developer or end user that additional support and/or stability is desired. Thus, zone 178 may be knitted with yarns having some content of low melt temperature materials. This zone may be treated with energy, for example, heat while being formed. Thus, a portion of the low melt temperature component may melt and fix the shape of zone 178. At least a portion of midfoot region 256 may also include low melt temperature material. It is important to note that the physical properties of the various zones or regions, in particular stiffness, may be controlled by the composition of the yarns used, as well as the treatments the different zones or regions receive. For example, the energy provided during fixing of the shape of the upper may vary across or along the upper. In particular, it may be desirable to have more support or stiffness in the toe box, for example, than in the midfoot. These preferences depend on the end user's desire, type of sport being practiced, and/or physical properties of the end user. The shoe upper described herein is customizable to meet the needs of end user for any particular sport due to the high level of specificity with which yarns may be delivered to the upper and/or energy may be provided to the upper. The same customization in the placement of the yarns is possible for the inner layer 180 of the upper. In some instances, it may also be possible to selectively deliver energy to the interior of the upper to control properties of the upper, for example, by selectively applying heat and/or steam.

FIG. 19A depicts a machine knitting sequence for the upper shown in FIG. 19B. As shown in FIG. 19A, the upper includes varying the number of stitches in almost every knit row of the upper. This means that partial knitting is occurring over the majority of the shoe. The upper has multiple sections including an internal section 700, collar section 702, and external section 705. Knitting occurs along the full length of the cylinder during the formation of the openings in sections 706, 724. After start section 706, selective knitting and holding of stitches on needles occurs throughout inner sole section 708, inner foot section 709, inner heel section 710, inner collar section 712, outer collar section 716, outer heel section 718, outer midfoot section 720, outer forefoot section 722, and outer sole section 726. While there are rows in these sections where stitches are knit on a majority of the needles all of these sections include selective knitting and holding of stitches in order to create a shaped elongated hollow knit portion that is capable of being used as a shoe.

One skilled in the art will understand from the machine knitting sequence that the elongated hollow knit portion will be shaped in order to create the final upper. For example, as depicted in FIG. 19A, an elongated hollow knit portion may be folded at lines of inflection 714, 730,732.

By folding at these lines of inflection, the stitches of the held needles will be joined to stitches are initially upside down relative to the stitches that being knit after the fold. The closer the held stitches are to the line of inflection, the closer the new stitches are to being upside down relative to the held stitches. As one moves away from the line of inflection, the stitches rotate approximately up to 90° from their initial position after the fold. This is a combination of folding and partial knitting which creates unique geometries for a knitted upper.

In particular, at line of inflection 730, the elongated hollow knit folds back as section 709 is knit. For example, at needle position 734 on row 736 of inner sole section 708 stitch 738 is coupled to stitch 742 when row 740 is knit.

For example, a standard size upper, such as a UK sized 8.5, may be knit in less than about 15 minutes. This upper may include two or more layers and have multiple zones with predetermined properties. In some instances, it is possible to knit a double-layer upper with multiple zones of predetermined properties in less than about fourteen minutes. In some cases, when using blended yarns to reduce the number of yarns needed, a shoe upper having an inner and outer layer and having multiple zones with properties predetermined by the designer, developer, and/or wearer may be knit in less than about 13 minutes, 30 seconds.

Further, in some instances, the manufacturing times of the processes outlined above may vary. For example, openings in the upper may be closed in less than about three minutes using stitching, welding, linking, adhesive and/or combinations thereof. In some instances, the openings may be closed in about two minutes. For example, the openings in the upper may be closed in less than two minutes using a strobel seam.

Using application of energy, the knit upper may be shaped in less than about 6 minutes if energy is applied in a controlled manner to the upper such that it forms the upper in a predetermined way. Using standard heating processes in an oven, uppers may be formed in less than about five minutes and thirty seconds. If a continuous heating process is used shaping of the upper may take less than three minutes. For example, some upper configurations can be shaped in less than 2 minutes and 30 seconds using a continuous heating process. For example, an oven having a conveyor belt may allow for a reduced heating time.

Soling of the shaped upper may include adding a midsole and/or outsole component to the shaped upper. In some instances, soling may be done using a direct injection process. It may be possible for such a process to be completed in less than about four minutes.

FIG. 19B shows an illustrative example of a knit shoe that utilizes an elongated hollow knit portion as the upper. The elongated hollow knit portion includes multiple zones within some of the knit rows in order to impart specific physical properties to the zones. For example, row 1900 (depiction is approximate due to shaping) includes stretch section 302 between medial section 304 and lateral section 306. By varying the number of plies of yarns, as well as potentially the materials of the yarns, different properties may be imparted to sections 302, 304, 306. A further example is found in the forefoot at row 308 which include stability medial section 1910 and stability lateral section 312. In zones requiring stability, the number of plies may be increased and/or materials may be specified with provide stability. For example, melt yarns may be provided in sections 1910, 312 of row 308 which are activated using energy, for example, heat. After activation, the melt material may secure portions of the surrounding yarns to each other, thereby increasing stability in these zones.

A medial view of an illustrative example of multilayer elongated hollow knitted upper is depicted in FIG. 20. In this illustrative example, the outer layer is connected to the inner layer by knitting at the collar 390. Other configurations may be created depending on the needs of the wearer and requirements of the use.

FIG. 21 depicts a lateral view of the illustrative example of FIGS. 19-20. Due to the colors of the yarns it is easier to see knitted juncture line 382 here, between heel region 380 and midfoot region 388. FIG. 21 clearly depicts knitted row 384 of the heel region connected to knitted row 386 of the midfoot region at knitted juncture line 382. These two rows 384. 386 are offset by about 45° at the knitted juncture line 382.

In FIG. 22, a shoe upper having multiple zones having an inner and outer knit layer is depicted. In addition, in this upper yarns are controlled and placed in predetermined locations to create design elements and interest in the upper. For example, letters are created using individual stitches on collar region 476. Further, a combination of color and knitting structures are used in knit elements 472, 482. Heel region 460 includes rows that are coupled to rows of midfoot region 462 at knitted juncture line 464. As is depicted in FIG. 22, the rows of the two regions are offset from each other by approximately 45°. A similar knitted juncture line 478 is present between upper region 484 and sole region 486. Due to the construction of the knitted elongated hollow portion using selective knitting and holding of stitches in combination with folding the elongated hollow structure, it is possible that rows of stitches are combined in such a manner that the stitches in one row have an opposite or close to opposite configuration of the stitches in the row to which it is joined at the knitted juncture line 478.

FIG. 23 depicts an illustrative example of a material map for a shoe upper that includes multiple zones. Zones may have different yarn compositions based on the location of the zone on the upper. As depicted in FIG. 23, some knitted rows may include multiple zones and therefore multiple yarns. Areas that require additional stability, such as, the heel and/or midfoot region may include additional yarns to increase the stability of the region. For example, yarns having melt content may be used. The amount of melt material in the area may, in some cases, reflect the stability needed. Plating melt yarns may provide additional stability and/or reduce stretch where needed, for example, in a heel region of the upper.

Heel regions may generally require support. In the illustrative example of FIG. 23, zone 650 located in heel region 662 includes polyester yarn, a blended yarn including polyester and melt material, as well as additional melt yarn that is plated to the other yarns. The blended yarn in zone 650 has a melt content of about 35% by weight. For example, the blended yarn may include polyester blended with copolyamide melt material having a low melt temperature. In particular, a copolyamide material having a melt temperature of 85° C. was used in the illustrative example. In contrast, in zone 652, the blended yarn has a melt content of about 20% by weight. By varying the amount of melt material in the blended yarn different stretch and/or stability capabilities can be achieved. Zone 652 also includes two plies of the polyester yarn and three plies of a melt yarn that is plated. The decrease in the melt content of the blended yarn may result in zone 652 being slightly less stable than zone 650.

In some regions of an upper, for example, in the vamp stretch may be desired. In these areas an elastic yarn may be used alone, or in combination with other materials. For example, in the illustrative example of FIG. 23, zone 656 includes two plies of an air tacked yarn that includes a polyester yarn (76 filaments) and an elastic polyurethane yarn having 44 filaments (e.g., lycra). In some instances, polyester fiber and polyurethane fiber could be intermingled and/or blended together to form a yarn to be used in the vamp or anywhere there is a need for stretch in the shoe.

Further, an inner layer of an upper may include polyester and elastic. As shown in the illustrative example shown in FIG. 23, the inner layer includes five plies of a polyester yarn having a weight of 167 dtex and 30 filaments and one ply of an elastic yarn having a weight of 167 dtex and 78 filaments.

FIG. 24 depicts a side perspective view of an illustrative example of a shoe upper. Areas of enhanced stretch may be found in all regions of the upper, for example, heel region 672 having collar zone 674, midfoot region 670 having instep zone 676, and forefoot region having vamp zone 678. Depending on the use of the shoe and/or the preferences of the wearer stretchability in various zones may vary. For example, as depicted in FIG. 24, vamp zone 678 and instep zone 676 may include multiple plies of an elastic yarn to provide stretch and/or recovery properties required. As the construction depicted in FIG. 24 is laceless, stretch and recovery properties of the instep zone and collar zone ensure proper fit of the shoe upper while allowing for entry of the foot.

Use of blended yarns in the illustrative example reduced the number of yarns necessary to achieve the desired effects in the upper. Use of fewer yarns may reduce production costs by reducing knitting time and potentially reducing downtime due to a decreased likelihood of breaks in the yarns that occur during processing.

FIG. 25 shows a rear perspective view of an illustrative example of a shoe upper. Heel zone 680 may include melt yarns in order to provide stability to the heel. In contrast, collar zone 682 may include elastic yarns to allow for entry of the foot into shoe 684. Depending on the desired properties of the zones, the number of plies of yarns may vary to, for example, increase recovery in the collar zone or increase stability in the heel zone.

The illustrative example of FIG. 26 shows a medial side perspective view of the shoe upper. As can be seen in FIG. 26, upper 686 has been shaped. Shaping may involve apply energy to the upper while it is positioned on a form, for example, a last, mold, foot, or the like. In some instances it may be possible to use an activatable yarn that allows the upper to be shaped to fit upon application of energy. For example, yarns may be activated while a user is wearing the shoe to create a customizable shoe. In some instances, the activation may cause one or more components in the yarns to shrink, melt or a combination of both.

In some instances, an activatable yarn may be selectively positioned during knitting so that areas of the upper may be fixed upon activation. In an illustrative example, an elongated hollow knit portion may be knit having multiple areas which when the elongated hollow knit portion is folded and/or tucked inside create overlapping areas. When knit on a circular knitting machine these areas may be knit in succession and then folded over so that areas of the outer and inner sock overlap. As is described herein, zones in the upper may include areas of different yarns.

In an illustrative example, a single jersey elongated hollow knit portion may be knit. The elongated hollow knit portion may have a base zone with a base yarn and a plated zone where a base yarn is knit together with a plated yarn. The plated yarn may be a yarn that is capable of being activated upon application of energy. The yarns may be positioned such that upon folding the elongated hollow knit portion, the plated is positioned proximate the base zone of the upper. Thus, upon activation of the activatable plated yarn, for example a low melt temperature yarn, the low melt temperature yarn may couple the base zone to the plated zone. In some instances, the low melt temperature yarn melts upon activation and couples the layers of the elongated hollow knit portion together. Plating may be controlled such that the activatable yarn is positioned with more activatable yarn on one side of the elongated hollow knit portion. Even on a single jersey fabric this is possible by controlling the position of the yarns in the loop. Further, as discussed herein plated yarns may be selectively formed into loops or floated in some areas to control positioning of the yarns, and in some cases, the location of the activatable yarn.

FIG. 27 depicts a top perspective view of a shoe upper 688 showing the shaping that is achieved.

FIGS. 28-29 depict uppers 188 positioned on lasts 190. Due to the use of partial knitting, that is, selective knitting and holding of stitches, and the repositioning of the opening on the sole region of the knit element, designs and/or knitting sequences or portions thereof may be developed and utilized over a large number of shoe sizes as shown in FIGS. 28-29. The combination of selectively placing yarns in particular zones and selectively holding and/or knitting needles to create shape allows patterns to be customized for a particular user or use based on user input or predetermined characteristics that a shoe for a particular sport requires.

For manufacturing and design purposes, when using small circular knit the diameter of the machine will generally remain the same in order to minimize costs. Thus, designs must adaptable to many sizes using a standard circumference on the machine. The width of upper may be controlled in part by using a combination of selective holding of stitches and/or selectively knitting to create shape in the upper and adjust the width for the smaller sizes. Thus, partial knitting may help adjust the width of uppers knit on a small circular knit machine. Further, material selection, in particular selectively placing yarns may help control the width of the upper in particular regions or zones. On a small circular knit machine the length of the tube may be variable.

A width of the shoe may be adjusted by placing the upper on a last and apply energy to form the upper to the shape of the last. For example, heat may be applied to the lasted upper to "fix" the upper. Yarns may be selected for use in particular zones of the upper based on the yarns ability to activate when energy is applied to the yarn. In this regard, yarns that shrink upon application of energy and/or heat may be placed in areas that should shrink. In some instances, the composition of the yarns in a particular area may be controlled to control the shrinkage. Further, the amount of energy supplied may also be controlled.

In some instances, energy may be supplied to an upper positioned on a last. This energy may be in the form of heat. For example, a knit upper may be heat set on a form, for example, a last, a mold, etc. using a conveyor system. Heat may be applied to substantially a majority of the upper to ensure that the upper is fitted to the form. In some cases, heat may be applied selectively to portions of an upper that require additional shaping or forming.

FIGS. 30-31 show elongated hollow structure 192 which has been folded to form two-layer uppers having inner layers 194, 260 and outer layers 196, 262 and mounted on a combined mid-sole and outsole structures 198, 264, respectively.

In some instances, inner and outer layers of the upper may folded at a different point on the upper. There may be instances when it is desired to have a multilayer upper that includes three or more layers folded on top of each other. In some cases, this layered upper may have a different number of layers in different parts of the upper depending upon the needs and/or desires of the end user, the designer, the developer and/or the requirements of the use of the shoe.

In some instances, an inner layer may be designed for comfort, while an outer layer of knit includes technical elements necessary for the function of the shoe. Multiple layers in the upper may allow for the use of layers that include conductive and/or light emitting fibers. For example, an upper may include an inner layer designed to wick moisture from the foot, a middle layer that includes conductive fibers, and a protective outer layer that allows for support structures and waterproofing of the shoe.

In the illustrative example of FIG. 32, elongated hollow structure 600 has a two-layer structure over most of the upper where outer layer 602 overlaps inner layer 600 after the inner layer has been folded and tucked into the outer layer. Thus, in toe region 606 and heel region 610, upper 600 has two layers. In the midfoot region 608 there may be additional knit areas that can be folded over on each other to provide specific characteristics to that section of the knit upper. Areas 612, 614, 616 may include a variety of material, plies and/or structures to provide the predetermined characteristics of the upper. Further, the fold lines of the various areas may be adjusted to meet the needs of the wearer and/or the requirements of the use.

In an illustrative example, area 612 may include additional plies, materials, and/or structures that provide additional support to the midfoot. Area 614 may include a melt yarn or material capable of coupling the various layers together. Area 616 may include, for example conductive yarns. The folds may occur at one or more lines 618, 620, 622, 624 to create an upper with the predetermined characteristics. Further, midfoot region 608 is a multilayer construction that may provide additional support. Thickness of the various areas of the upper can be controlled by material choice, number of plies of yarn used, knit structures used, and/or thickness of the plies of yarn. These variables may be selected such that an area with the desired knit density is created. Thus, when multiple areas overlap the thicknesses of the overlapping areas may be controlled to limit the overall thickness of the upper in that zone or region. Areas 612, 614, 616 shown in this example may be arranged in other configurations in further examples to meet the needs of the user and/or use.

The elongated hollow structure may be folded in a manner that creates, for example, a toe region, a collar region, a leg region, a sole region and/or heel region having three or more layers.

Depending on the knitting sequence the three or more layers may be positioned at various locations on the shoe. In some instances, yarns may be used at the end of the elongated hollow structure that allow it to bond to another portion of the upper. For example, melt yarns may be used to ensure that the layers of the upper maintain their position after the application of energy.

FIG. 52 depicts an illustrative example of a shoe in which the number of threads supplied to the knitting machine has been reduced. Reducing the number of yarn materials may provide processing benefits due to less likelihood of breakage of the yarns and/or less bobbins on the machine.

Further, reducing a number of distinct ply type of yarns used may allow for more streamlined processing conditions. "Distinct ply type(s) of yarn" refers to a ply made from a specific material. For example, a distinct ply type of yarn that includes polyester may be combined with a distinct ply type of yarn that includes a low-melt material.

The upper shown is a two-layer upper formed after knitting an elongated hollow knit structure on a small circular knitting machine. Each layer is knit as part of the elongated hollow knit structure. A portion of the elongated hollow knit structure is folded, in this case, at the collar such that an inner layer is positioned inside an outer layer.

Further, upper 4902 of the illustrative example shown in FIG. 52 includes three materials, in particular polyester, low-melt temperature material and an elastic material, for example, spandex. Various zones in the shoe require different properties, thus, distinct ply types of yarns and a number of plies used may vary across a shoe upper. Further, the materials may be combined in various ways to create a shoe upper that has multiple zones with different properties. The inner layer of the upper corresponds to zone 4916 of the elongated hollow knit structure. As shown, the inner layer includes multiple plies of a polyester yarn. The inner layer is a single-layer knit as shown.

Areas requiring stretch, such as zone 4914, include one or more plies of an elastic yarn, in particular, spandex. The number of plies in such an area may vary depending on the desired stretch and/or recovery properties for the zone and/or a section of the zone. Zones requiring stability may include blended yarns. In particular, zone 4908 includes a ply of a blended yarn having 50% polyester and 50% low-melt temperature material. Depending on the desired properties of a zone the low-melt temperature material content may be in a range from about 20% to 80%.

Zones requiring additional stability may include a blended yarn, in combination with plies of a low-melt temperature yarn. As shown in FIG. 52, Zones 4904, 4910, 4912 included one-ply of a 50% polyester and 50% low-melt temperature material blend, combined with three plies of low-melt material yarn. As is shown in FIG. 52, these four threads are introduced into the same feeder with the blended yarn being used as the base yarn and the 3 plies of low-melt material being used as a plated yarn. After providing the 4 threads to the feeder, the base yarn is positioned so that during knitting it appears on an outer surface of the knit.

The plated yarn that includes 3 separate plies of low-melt temperature yarn is positioned on an inner surface of the knit. Zones 4904, 4910, 4912, correspond to a portion of the toe region, a portion of the midfoot region and the heel region, respectively. These regions in may require additional stability which the low-melt temperature yarns may provide.

In addition, the low-melt temperature yarn may be activated upon application of energy, in particular heat. Providing heat to zones 4904, 4910, 4912 may allow the low-melt temperature material of the 3 plies of yarn to melt, at least in part. This melted material may flow partially into the interstices between the yarns of the inner layer, in particular into zone 4916. Upon cooling the low-melt temperature material may solidify joining the inner layer to the outer layer of the upper at least in part. Zones having pure low-melt material plies, in particular, zones 4901, 4910, 4912 may provide a bond between the inner and outer layers of the upper.

A number of plies of the various materials may be varied, in accordance with the desired properties of the zone, and/or the ability to bond with other materials. For example, plies of low-melt temperature yarns may be positioned during knitting such that they are on an outer surface of the outer layer. In this manner, these melt materials may be used upon activation to connect various elements to the upper, midsole, and/or outsole, for example, stability elements, such as heel counters, toe guards, etc., design elements, textile elements, lacing elements, cushioning elements, midsoles, cleats, and/or soles elements.

In some instances, it may be desirable to plate low melt temperature yarns in zones where they will be positioned on an exterior surface of the inner sock. This portion of the inner sock would contact the outer sock and upon activation could bond at least in part to the outer sock.

Zones of plated yarns using low-temperature melt yarns may be positioned throughout the upper in a manner that upon activation of the yarns tunnels, pockets, and/or elements where the bonded areas surround areas that are not bonded. In some areas, these bonded areas may have a particular geometry or predetermined shape. In other embodiments, the upper may be selectively activated. For example, heat may be applied in particular areas to join a portion of the inner sock to a portion of the outer sock. In the case of elongated hollow knit element that is annular structure, portions of the annular structure may be joined together.

Plies of yarn may be provided to the knitting machine and/or feeder in an untwisted or twisted state. When multiple plies of the same yarn are used they may be twisted so that one thread is provided to the knitting machine and/or the feeder. For example, three plies of low-melt temperature yarn may be supplied directly to the knitting machine and/or feeder, or they may be twisted together so that only a single thread is provided to the knitting machine and/or feeder. Twisting of the multiple plies to create a single thread may allow for a more consistent material throughout the textile. In addition, by reducing a number of individual threads provided to the knitting machine and/or feeder a number of bobbins of yarn may be reduced. Reducing the number of bobbins supplying yarn to the knitting machine and/or feeder reduces the complexity of the knit process, and may reduce a knitting time and/or processing time. The fewer threads provided to the knitting machine and/or bobbins, the less likely it is that there will be a broken thread, thereby slowing down production.

Yarns may be of the same type, but vary by a number of constituent plies. For example, a 3 ply polyester yarn may be viewed as the same type of yarn as a 2 ply polyester yarn, provided that the constituent plies have the same materials and construction (i.e., dtex value and number of filaments).

A number of plies used in an area may depend a thickness of the yarn, the gauge of machine used and/or a need hook size. Thickness of the yarn, for example, may be influenced by a number of filaments and/or the density of the fibers.

Properties which may be referred to as predetermined properties may include properties of interest for a particular zone, area, portion and/or layer of an upper. In particular predetermined properties may include, but are limited to strength, for example as measured at 20% elongation and/or maximum strength, both along a row and a wale, the maximum elongation along both a row and a wale, mass per unit area, air permeability, wicking capability, conductivity, for example, thermal and/or electrical, stretchability, cushioning, thickness, recovery, stability, and/or other properties that are important for type of shoe and/or user.

In the illustrative examples, uppers 630, 640 may include three layers as is shown in FIGS. 33-34. An inner layer 632, 642 may be knit from materials suitable for an inner layer of a shoe, for example, yarns that affect fit or comfort of the shoe, in particular elastic and/or functional yarns. A middle layer 634, 644 could be knit from a yarn capable of adhering the inner layer to the outer layer of the upper, for example, a melt yarn. The outer layer 636, 646 could be knit from materials appropriate for the external surface of the shoe, for example, materials that are abrasion resistant, water resistant, provide grip and/or are desirable from a design perspective.

In some instances, a four layer knit could be provided. A four layer folded knit, for example, could start and end in the same place, if desired. Using a four layer knit, an upper with an inner layer, a bonding layer, a conductive layer and an outer layer could be created. Across the layers the materials, number of plies, thicknesses of the plies, and/or knitting structures may be varied to create layers having different thicknesses and/or stitch densities. For example, if creating an electrically conductive layer it may be desirable to reduce a stitch density for that layer. The stitch density of a layer may be controlled by varying the type of stitches, for example, knit loop, tuck loop, floats, and/or held loops, material types, thickness of materials, use of a plating yarn, and/or the number of plies of yarns. Thus, the bonding layer would still be effective to bond the inner layer to the outer layer of the upper.

In some instances, inner and outer layers of the upper may be separate and/or folded at a different point on the upper. For example, in an illustrative example of two separate elongated hollow structures being combined, the knit sequences of sequence sections 270, 272 of FIG. 16C may be used to generate two elongated hollow structures by not connecting the elongated hollow structures at the collar. Thus, openings may be created at either end of the elongated hollow structures. One opening on the elongated hollow structure may correspond to the collar region and one to the opening in sole region of the forefoot.

The examples and method described herein may result in an upper in which stitched seams are minimized, and in some cases eliminated. In some examples, knitted seams are formed. Knitted seams may help create shape and structure within an elongated hollow knit. Further, some examples include join areas of upper using welds created by the selective application of energy, for example, electromagnetic waves, heat, infrared, ultrasonic, microwave, radio frequency, laser welding, solvent welding, or other types of welding known in the art. For example, heat may be selectively applied to create a weld at the opening of the elongated hollow knit that is positioned on the sole of the upper. In some elongated hollow knit structures, sections of yarns may be linked to each other to create a linked seam. Knit, linked, and/or weld seams may have a lower profile than a sewn seam.

Creating a knit upper using an elongated hollow knit portion may result in significant savings in production cost. This may be due to a reduction in the number of steps and/or touches that the elongated hollow knit structure needs to become a shoe upper when compared to convention materials and/or construction techniques. In addition, the elongated hollow knit structure reduces, and in some cases eliminates waste, by creating an upper that is shaped to the foot.

Knitting on a small circular knitting machine is generally quite fast. Further, a single jersey shaped elongated hollow knit structure that can be folded on itself to create a multilayer upper is generally faster to knit than a comparable double jersey shaped structure knitted on a weft-knitting machine, either flat or circular. Reducing knitting times can greatly affect overall production costs.

These various production advantages may result in significant savings. Further, the methods and examples described herein may allow for significant customization possibilities for an end user, i.e., wearer. Characteristics of the wearer, requirements of the use, and/or design trends among other things, may be taken into account when creating a shoe upper using the methods described herein.

In particular, use of the knitting techniques described herein and in combination with a small circular knitting machine, may result in a significant time savings in the production time for a shoe. For example, a two-layer knitted upper may be generated in less than fifteen minutes. Use of blended yarns may allow for a reduction in the number of yarns used to knit when compared to the use of standard, twisted, and/or intermingled yarns. This may result in a decrease in knitting time due to less material being needed to impart the same predetermined physical properties to the zones of the upper when compared to the multiple yarns or plies that are necessary using standard construction methods.

The closure of the opening(s) on the sole of the foot may take around one minute, while adding the sole could be completed less than about four minutes. Shaping of the shoe upper may require about five minutes. Thus, a complete shoe could be formed in less than about twenty-five minutes. Further, this shoe could also be customized. Customized forms, such as last, or molds could be used to create a highly customized shoe that is fitted to the foot of the wearer. In the past, customized shoes may have required much more time to create, but given the flexibility of this process customized shoes may be created in almost the same amount of time as standard shoes.

The configuration described herein may be constructed using any knitting machine known in the art, for example, a weft-knitting machine, such as a flat knitting machine, or a warp-knitting machine. The double-layer tubular construction with coextensive openings on the sole may be well suited for adapting on other knitting machines.

As discussed herein, materials may be altered or exchanged to meet the needs of the user, type of activity, and design requirements. Customization may allow the wearer to select types of yarns, levels of stretch and/or compression, color, special effects, functional materials, knit structures, or any combination of the like. Post processing may also be used to adjust the properties of the knitted upper, for example, application of energy may be used to create stiffer zones on the shoe upper.

In the following, further examples of the invention are described, in particular with reference to the exemplary embodiment in FIG. 16, in particular FIGS. 16B and 16E:

1. Shoe upper comprising:
   an elongated hollow knit structure arranged to receive a portion of a foot comprising:
   a first end (134) of the elongated hollow knit structure comprising:
   a first axis (132) running through a midpoint (131) of the first end of the elongated hollow knit structure and parallel to a longitudinal axis of the upper; and
   a second axis (133) running through a midpoint of the first end of the elongated hollow knit structure and perpendicular to the longitudinal axis of the upper;
   wherein a first length of a first segment of the first axis positioned within a boundary of the first end of the elongated hollow knit structure is greater than a second length of a second segment of the second axis positioned within the boundary of the first end of the elongated hollow knit structure.
2. Shoe upper according to example 1 wherein the elongated hollow knit structure further comprises a second end (135) comprising:
   a third axis running through a midpoint of the second end of the elongated hollow knit structure and parallel to a longitudinal axis of the upper; and
   a fourth axis running through a midpoint of the second end of the elongated hollow knit structure and perpendicular to the longitudinal axis of the upper;
   wherein a third length of a third segment of the third axis positioned within a boundary of the second end of the elongated hollow knit structure is greater than a fourth length of a fourth segment of the fourth axis positioned within the boundary of the second end of the elongated hollow knit structure.
3. Shoe upper according to example 1 wherein at least one of the first and second ends of the elongated hollow knit structure is positioned on a sole region of the upper.
4. Shoe upper according to example 1 further comprising a closure seam of at least one of the first or second ends of the elongated hollow knit structure is positioned substantially parallel with a longitudinal axis of the upper.
5. Shoe upper according to example 1 further comprising a second end of the elongated hollow knit structure positioned on a sole region of the upper.
6. Shoe upper according to example 1 further comprising an inner layer and an outer layer coupled to each other using knit stitches.
7. Shoe upper according to example 5 wherein the at least one end of the elongated hollow knit structure is positioned such that a closure seam of the second end of the elongated hollow knit structure is substantially parallel with a longitudinal axis of the upper.
8. Shoe upper according to example 1 wherein the closure seam of the at least one end of the elongated hollow knit structure and the closure of the second end of the elongated hollow knit structure are at least partially overlapping.
9. Shoe upper according to example 1 wherein the elongated hollow knit structure is formed on a small circular knitting machine.
10. Shoe upper according to example 1 wherein the elongated hollow knit structure is single layer textile and wherein at least a first portion of the elongated knit is folded over a second portion of the elongated knit such that the upper has an inner layer and an outer layer connected using knit stitches.
11. Shoe upper according to example 1 wherein the elongated hollow knit structure comprises at least one knitted row comprising a first section and a second section, and wherein the number of plies in the first section is different than the number of plies in the second section.
12. Shoe upper according to one of the preceding examples, wherein the first section is arranged on a medial and/or lateral portion of the shoe upper and the second section is arranged on an instep portion of the shoe upper and the number of plies in the first section is higher than in the second section.
13. Shoe upper according to one of the preceding examples, wherein the elongated hollow knit structure comprises a first portion and a second portion, at least one of the first and second portions comprising melt material which joins the first portion and the second portion.
14. Shoe upper according to one of examples 9 or 10, further comprising at least one component arranged between the first circular knit portion and the second circular knit portion.
15. Shoe comprising:
   a shoe upper according to one of the preceding examples; and
   a shoe sole attached to the shoe upper.
16. Shoe according to the preceding example, wherein the shoe upper is directly joined to an upper surface of the shoe sole.
17. Shoe according to the preceding example, wherein the shoe upper is directly joined to the shoe sole by application of heat.
18. Shoe according to one of examples 13 or 14, wherein the upper surface of the shoe sole comprises thermoplastic.
19. Shoe according to one of examples 12-15, wherein the shoe does not comprise a strobel sole.
20. Shoe upper according to example 1 further comprising:
   a knitted juncture line on the sole of the upper coupling a first set of rows of stitches in a first section to a second set of rows of stitches in a second section;
   wherein at one or more points on the knitted juncture line the first set of rows of stitches are upside down relative to the second set of rows of stitches and further comprising an offset between the first and second set of rows of stitches that increases from about 0° to about 90° along a length of the juncture line.
21. Method of manufacturing a shoe upper, comprising:
   knitting at least one elongated hollow knit structure on a knitting machine comprising openings (232, 234) in ends (134, 135) of the elongated hollow knit structure; and
   arranging the elongated hollow knit structure such at least one opening (234) of the elongated hollow knit structure is positioned parallel to a longitudinal axis (132) of the upper.

22. Method according to example 21 further comprising arranging the elongated hollow knit structure such that the at least one opening of the elongated hollow knit structure is positioned on a sole region of the upper.

23. Method according to one of examples 21 or 22 wherein knitting the at least one elongated hollow knit structure on a knitting machine further comprises:
knitting one or more stitches in first row during a first machine movement;
holding one or more stitches on one or more needles in the first row during the first carriage stroke such that the one or more stitches are held;
knitting one or more stitches on a second row during a second machine movement wherein at least a first held stitch is knit; and
knitting one or more stitches on a third row during a third machine movement wherein at least a second held stitch is knit; and
wherein a knitted juncture line is formed at an intersection of the knit stitches and the held stitches.

24. Method according to one of examples 21-23 further comprising: folding at least a portion of the elongated hollow knit structure such that the first held stitch is substantially upside down relative to a subsequent stitch at that needle position made during the second machine movement.

25. Method according to one of examples 21-24 along the knitted juncture line an orientation of the knitted stitches relative to an orientation of the formerly held stitches are upside down and offset by a value in a range from about 0° to 90°.

26. Method according to one of examples 21-25 further comprising closing the opening to form a closure seam of at least one end of the elongated hollow knit structure positioned substantially parallel with a longitudinal axis of the upper.

27. Method according to one of examples 21-26 further comprising folding at least a section of the elongated knit such that a first portion of the elongated hollow knit structure forms an inner layer of the upper and a second portion of the elongated hollow knit structure forms an outer layer of the upper.

28. Method according to one of examples 21-27 further comprising:
arranging a first section on a medial and/or lateral portion of the shoe upper; and
arranging a second section on an instep portion of the shoe upper,
wherein the number of plies in the first section is higher than in the second section.

29. Method according to one of examples 21 to 28, further comprising assembling the elongated hollow knit structure to form the upper without sewn seams.

30. Method according to examples 21 to 29 further comprising arranging at least one component between the inner layer and the outer layer.

31. Shoe upper obtained according to a method of one of examples 21 to 30.

32. A shoe upper comprising:
an elongated hollow knit structure comprising:
a first zone comprising a first predetermined property;
a second zone comprising a second predetermined property;
wherein the elongated hollow knit structure comprises less than ten distinct plies of yarn.

33. The shoe upper according to example 32, wherein the first zone further comprises a first blended yarn comprising melt material, wherein the second zone comprises a second yarn; and wherein the first blended yarn and the second yarn differ by at least one characteristic.

What is claimed is:

1. A method for manufacturing a shoe upper, comprising the steps of:
providing at least one stretchable zone on the shoe upper;
providing at least one stretch yarn in the at least one stretchable zone;
providing at least one zone without the stretch yarn on the shoe upper;
stretching the at least one stretchable zone of the shoe upper for adapting a size of the shoe upper; and
permanently attaching at least one rigid element at least partly on the stretched stretchable zone so that the stretched stretchable zone is locked.

2. The method of claim 1, wherein the at least one stretchable zone is provided at least partly in a bottom part of the shoe upper.

3. The method of claim 1, wherein the shoe upper is integral and continuous from a medial side to a lateral side in an instep part of the shoe upper.

4. The method of claim 1, wherein the at least one stretchable zone is more stretched than any other zone on the shoe upper during the step of stretching the stretchable zone.

5. The method of claim 1, wherein the shoe upper is seamless.

6. The method of claim 1, wherein at least part of the shoe upper is knitted.

7. The method of claim 6, wherein the entire shoe upper is knitted and it is formed with a circular knit technique.

8. The method of claim 1, wherein the attached rigid element covers the entire stretchable zone.

9. The method of claim 1, wherein the rigid element is a shoe sole.

10. The method of claim 1, wherein two or more stretchable zones are provided.

11. The method of claim 1, wherein the step of stretching the stretchable zone is carried out by inserting a last into the shoe upper.

12. The method of claim 11, wherein the last is inflatable.

13. The method of claim 1, further comprising the step of providing a first knit structure on the shoe upper and providing a second knit structure in the at least one stretchable zone, wherein the second knit structure is more stretchable than the first knit structure.

* * * * *